US009493940B2

(12) United States Patent
Collins et al.

(10) Patent No.: US 9,493,940 B2
(45) Date of Patent: Nov. 15, 2016

(54) SLAB CONSTRUCTION SYSTEM AND METHOD FOR CONSTRUCTING MULTI-STORY BUILDINGS USING PRE-MANUFACTURED STRUCTURES

(75) Inventors: Arlan Collins, Seattle, WA (US); Mark Woerman, Seattle, WA (US)

(73) Assignee: INNOVATIVE BUILDING TECHNOLOGIES, LLC, Seattle, WA (US)

( * ) Notice: Subject to any disclaimer, the term of this patent is extended or adjusted under 35 U.S.C. 154(b) by 0 days.

(21) Appl. No.: 13/700,429

(22) PCT Filed: Jun. 7, 2011

(86) PCT No.: PCT/US2011/001039

§ 371 (c)(1),
(2), (4) Date: Nov. 27, 2012

(87) PCT Pub. No.: WO2011/155992

PCT Pub. Date: Dec. 15, 2011

(65) Prior Publication Data

US 2013/0067832 A1 Mar. 21, 2013

Related U.S. Application Data

(63) Continuation-in-part of application No. 12/796,603, filed on Jun. 8, 2010, now Pat. No. 8,950,132, and a continuation-in-part of application No. 12/796,625, filed on Jun. 8, 2010, now Pat. No. 9,027,307.

(51) Int. Cl.
*E04B 1/24* (2006.01)
*E04B 1/343* (2006.01)
(Continued)

(52) U.S. Cl.
CPC . *E04B 1/24* (2013.01); *E04B 1/18* (2013.01); *E04B 1/343* (2013.01); *E04B 2/7448* (2013.01); *E04B 2/90* (2013.01); *E04C 2/00* (2013.01); *E04H 1/06* (2013.01); *E04F 13/08* (2013.01)

(58) Field of Classification Search
CPC .... E04B 1/3433; E04B 1/34321; E04B 1/24; E04B 2/7448; E04B 2/90; E04B 2001/2484; E04H 1/04
USPC ..... 52/232, 302.3, 793.1, 794.1, 408, 52/79.12–79.14, 79.1, 122.1; 428/172
See application file for complete search history.

(56) References Cited

U.S. PATENT DOCUMENTS 1,168,556 A 1/1916 Robinson et al.
1,876,528 A 9/1932 Walters
(Continued)

FOREIGN PATENT DOCUMENTS

AU 2005200682 B1 5/2005
AU 2012211472 A1 2/2014
(Continued)

OTHER PUBLICATIONS

US 8,701,371, 04/2014, Collins et al. (withdrawn)
(Continued)

*Primary Examiner* — Brian Glessner
*Assistant Examiner* — Paola Agudelo
(74) *Attorney, Agent, or Firm* — Dorsey & Whitney LLP

(57) ABSTRACT

The present invention integrates the use of pre-manufactured structures with minimal on-site installation and lift-slab construction to achieve the construction of multi-story buildings. The pre-manufactured structures are designed to be readily integrated with both horizontal and vertically adjacent building components, including lift-slab components, so that multiple building stories may be readily and securely stacked, one on top of the other. The present invention advantageously permits top-down lift-slab construction for multi-story buildings. The present invention also provides for the development of flexible design plans for institutional, residential, office and other types of buildings. The present invention advantageously provides for easier, more efficient, faster, cheaper, safer, higher quality and more consistent, environmentally advantaged, energy-efficient, easier to maintain, intelligently designed, and customizable multi-story building construction.

18 Claims, 57 Drawing Sheets

(51) Int. Cl.

| | |
|---|---|
| ***E04B 1/18*** | (2006.01) |
| ***E04C 2/00*** | (2006.01) |
| ***E04B 2/74*** | (2006.01) |
| ***E04B 2/90*** | (2006.01) |
| ***E04H 1/06*** | (2006.01) |
| *E04F 13/08* | (2006.01) |

(56) References Cited

U.S. PATENT DOCUMENTS 1,883,376 A * 10/1932 Hilpert et al. ..... 52/654.1
2,160,161 A 5/1939 Marsh
2,419,319 A 4/1947 Lankton
2,495,862 A 1/1950 Osborn
2,562,050 A 7/1951 Lankton
2,686,420 A 8/1954 Youtz
2,871,544 A 2/1959 Youtz
2,871,997 A * 2/1959 Simpson et al. ..... 52/93.1
3,017,723 A * 1/1962 Von Heidenstam ..... 52/236.6
3,052,449 A * 9/1962 Long et al. ..... 254/89 R
3,053,015 A * 9/1962 Graham ..... 52/745.13
3,053,509 A 9/1962 Haupt et al.
3,065,575 A 11/1962 Ray
3,184,893 A * 5/1965 Booth ..... E02D 27/10 405/231
3,221,454 A 12/1965 Togni
3,236,014 A 2/1966 Edgar
3,245,183 A 4/1966 Tessin
3,281,172 A 10/1966 Kuehl
3,315,424 A 4/1967 Smith
3,388,512 A 6/1968 Newman
3,411,252 A 11/1968 Boyle, Jr.
3,460,302 A 8/1969 Cooper
3,490,191 A * 1/1970 Ekblom ..... 52/745.13
3,579,935 A * 5/1971 Regan et al. ..... 52/125.1
3,590,393 A 7/1971 Hollander
3,594,965 A * 7/1971 Saether ..... 52/125.1
3,604,174 A 9/1971 Nelson, Jr.
3,638,380 A * 2/1972 Perri ..... 52/79.12
3,707,165 A 12/1972 Stahl
3,713,265 A 1/1973 Wysocki et al.
3,721,056 A 3/1973 Toan
3,722,169 A * 3/1973 Boehmig ..... 52/745.04
3,727,753 A 4/1973 Starr
3,742,666 A 7/1973 Antoniou
3,751,864 A 8/1973 Berger et al.
3,755,974 A 9/1973 Berman
3,762,115 A 10/1973 McCaul, III
3,766,574 A 10/1973 Smid, Jr.
3,821,818 A 7/1974 Alosi
3,823,520 A * 7/1974 Ohta et al. ..... 52/73
3,845,601 A 11/1974 Kostecky
3,853,452 A 12/1974 Delmonte
3,906,686 A 9/1975 Dillon
3,921,362 A * 11/1975 Ortega ..... 52/745.14
3,926,486 A 12/1975 Sasnett
3,971,605 A 7/1976 Sasnett
3,974,618 A 8/1976 Cortina
4,038,796 A 8/1977 Eckel
4,050,215 A 9/1977 Fisher
4,078,345 A 3/1978 Piazzalunga
4,107,886 A 8/1978 Ray
4,142,255 A 3/1979 Togni
4,171,545 A 10/1979 Kann
4,176,504 A 12/1979 Huggins
4,178,343 A 12/1979 Rojo, Jr.
4,214,413 A 7/1980 Gonzalez Espinosa de Los Monteros
4,221,441 A 9/1980 Bain
4,226,061 A 10/1980 Day, Jr.
4,280,307 A 7/1981 Griffin
4,314,430 A 2/1982 Farrington
4,325,205 A 4/1982 Salim
4,327,529 A 5/1982 Bigelow, Jr.
4,341,052 A 7/1982 Douglass, Jr.
4,361,994 A 12/1982 Carver
4,397,127 A 8/1983 Mieyal
4,435,927 A 3/1984 Umezu et al.
4,441,286 A 4/1984 Skvaril
4,447,996 A 5/1984 Maurer, Jr.
4,477,934 A 10/1984 Salminen
4,507,901 A 4/1985 Carroll
4,513,545 A 4/1985 Hopkins, Jr.
4,528,793 A 7/1985 Johnson
4,646,495 A * 3/1987 Chalik ..... 52/236.8
4,655,011 A 4/1987 Borges
4,688,750 A 8/1987 Teague et al.
4,757,663 A 7/1988 Kuhr
4,856,244 A 8/1989 Clapp
4,919,164 A 4/1990 Barenburg
4,991,368 A 2/1991 Amstutz
5,076,310 A 12/1991 Barenburg
5,079,890 A * 1/1992 Kubik ..... E04B 1/16 52/251
5,127,203 A 7/1992 Paquette
5,185,971 A 2/1993 Johnson, Jr.
5,205,091 A 4/1993 Brown
5,233,810 A 8/1993 Jennings
5,307,600 A 5/1994 Simon, Jr.
5,359,820 A 11/1994 McKay
5,361,556 A 11/1994 Menchetti
5,402,612 A * 4/1995 diGirolamo et al. ..... 52/241
5,412,913 A 5/1995 Daniels et al.
5,459,966 A 10/1995 Suarez
5,471,804 A 12/1995 Winter, IV
5,493,838 A 2/1996 Ross
5,509,242 A 4/1996 Rechsteiner et al.
5,519,971 A 5/1996 Ramirez
5,528,877 A * 6/1996 Franklin ..... 52/745.13
5,592,796 A 1/1997 Landers
5,628,158 A 5/1997 Porter
5,660,017 A 8/1997 Houghton
5,678,384 A 10/1997 Maze
5,697,189 A 12/1997 Miller
5,699,643 A 12/1997 Kinard
5,724,773 A 3/1998 Hall
5,746,034 A 5/1998 Luchetti et al.
5,755,982 A 5/1998 Strickland
5,850,686 A 12/1998 Mertes
5,867,964 A 2/1999 Perrin
5,870,867 A 2/1999 Mitchell
5,921,041 A 7/1999 Egri, II
5,987,841 A 11/1999 Campo
5,992,109 A 11/1999 Jonker
5,997,792 A 12/1999 Gordon
6,000,194 A 12/1999 Nakamura
6,055,787 A 5/2000 Gerhaher et al.
6,073,401 A 6/2000 Iri et al.
6,073,413 A * 6/2000 Tongiatama ..... 52/693
6,076,319 A 6/2000 Hendershot
6,086,350 A 7/2000 Del Monte
6,154,774 A 11/2000 Furlong
6,170,214 B1 1/2001 Treister et al.
6,243,993 B1 6/2001 Swensson
6,244,002 B1 6/2001 Martin
6,244,008 B1 6/2001 Miller
6,260,329 B1 7/2001 Mills
6,289,646 B1 9/2001 Watanabe
6,301,838 B1 10/2001 Hall
6,308,465 B1 10/2001 Galloway et al.
6,308,491 B1 10/2001 Porter
6,340,508 B1 1/2002 Frommelt
6,371,188 B1 4/2002 Baczuk et al.
6,393,774 B1 5/2002 Fisher
6,430,883 B1 8/2002 Paz et al.
6,446,396 B1 9/2002 Marangoni et al.
6,481,172 B1 11/2002 Porter
6,484,460 B2 11/2002 VanHaitsma
6,625,937 B1 9/2003 Parker
6,651,393 B2 11/2003 Don et al.
6,729,094 B1 5/2004 Spencer et al.
6,748,709 B1 6/2004 Sherman et al.
6,837,013 B2 1/2005 Foderberg et al.
6,922,960 B2 8/2005 Sataka
7,007,343 B2 3/2006 Weiland et al.

(56) References Cited

U.S. PATENT DOCUMENTS

| | | | | |
|---|---|---|---|---|
| 7,059,017 | B1 | 6/2006 | Rosko et al. | |
| 7,143,555 | B2 | 12/2006 | Miller | |
| RE39,462 | E | 1/2007 | Brady | |
| 7,389,620 | B1 | 6/2008 | McManus | |
| 7,395,999 | B2 | 7/2008 | Walpole | |
| 7,444,793 | B2 * | 11/2008 | Raftery et al. | 52/741.14 |
| 7,467,469 | B2 | 12/2008 | Wall | |
| 7,484,339 | B2 | 2/2009 | Fiehler | |
| 7,574,837 | B2 | 8/2009 | Hagen, Jr. et al. | |
| 7,658,045 | B2 | 2/2010 | Elliott et al. | |
| 7,676,998 | B2 | 3/2010 | Lessard | |
| 7,694,462 | B2 | 4/2010 | O'Callaghan | |
| 7,721,491 | B2 | 5/2010 | Appel | |
| 7,748,193 | B2 | 7/2010 | Knigge et al. | |
| 7,908,810 | B2 | 3/2011 | Payne, Jr. et al. | |
| 7,921,965 | B1 | 4/2011 | Surace | |
| 7,966,778 | B2 | 6/2011 | Klein | |
| 8,051,623 | B2 | 11/2011 | Loyd | |
| 8,109,058 | B2 | 2/2012 | Miller | |
| 8,166,716 | B2 | 5/2012 | Macdonald et al. | |
| 8,234,833 | B2 | 8/2012 | Miller | |
| 8,251,175 | B1 | 8/2012 | Englert et al. | |
| 8,276,328 | B2 * | 10/2012 | Pepin | 52/167.3 |
| 8,322,086 | B2 | 12/2012 | Weber | |
| 8,359,808 | B2 | 1/2013 | Stephens, Jr. | |
| 8,424,251 | B2 | 4/2013 | Tinianov | |
| 8,490,349 | B2 | 7/2013 | Lutzner et al. | |
| 8,505,259 | B1 | 8/2013 | Degtyarev | |
| 8,539,732 | B2 | 9/2013 | Leahy | |
| 8,555,581 | B2 | 10/2013 | Amend | |
| 8,555,589 | B2 | 10/2013 | Semmens et al. | |
| 8,621,806 | B2 | 1/2014 | Studebaker et al. | |
| 8,733,046 | B2 | 5/2014 | Naidoo | |
| 8,769,891 | B2 | 7/2014 | Kelly | |
| 8,950,132 | B2 | 2/2015 | Collins et al. | |
| 8,978,324 | B2 | 3/2015 | Collins et al. | |
| 8,997,424 | B1 | 4/2015 | Miller | |
| 9,027,307 | B2 | 5/2015 | Collins et al. | |
| 2002/0059763 | A1 | 5/2002 | Wong | |
| 2002/0170243 | A1 | 11/2002 | Don et al. | |
| 2003/0005653 | A1 | 1/2003 | Sataka | |
| 2003/0101680 | A1 * | 6/2003 | Lee | 52/745.2 |
| 2003/0140571 | A1 | 7/2003 | Muha et al. | |
| 2003/0167712 | A1 | 9/2003 | Robertson | |
| 2003/0200706 | A1 * | 10/2003 | Kahan et al. | 52/167.3 |
| 2004/0065036 | A1 | 4/2004 | Capozzo | |
| 2004/0103596 | A1 | 6/2004 | Don | |
| 2005/0081484 | A1 | 4/2005 | Yland | |
| 2005/0108957 | A1 | 5/2005 | Quesada | |
| 2005/0188626 | A1 | 9/2005 | Johnson | |
| 2005/0188632 | A1 | 9/2005 | Rosen | |
| 2005/0198919 | A1 * | 9/2005 | Hester, Jr. | 52/236.3 |
| 2005/0210764 | A1 | 9/2005 | Foucher et al. | |
| 2005/0210798 | A1 | 9/2005 | Burg et al. | |
| 2005/0235571 | A1 | 10/2005 | Ewing et al. | |
| 2005/0235581 | A1 | 10/2005 | Cohen | |
| 2005/0247013 | A1 | 11/2005 | Walpole | |
| 2006/0021289 | A1 | 2/2006 | Elmer | |
| 2006/0070321 | A1 | 4/2006 | Au | |
| 2006/0096202 | A1 | 5/2006 | DelZotto | |
| 2006/0117689 | A1 | 6/2006 | Onken et al. | |
| 2006/0137293 | A1 | 6/2006 | Klein | |
| 2006/0179764 | A1 | 8/2006 | Ito | |
| 2006/0248825 | A1 | 11/2006 | Garringer | |
| 2007/0074464 | A1 | 4/2007 | Eldridge | |
| 2007/0107349 | A1 | 5/2007 | Erker | |
| 2007/0157539 | A1 | 7/2007 | Knigge et al. | |
| 2007/0163197 | A1 | 7/2007 | Payne et al. | |
| 2007/0209306 | A1 | 9/2007 | Andrews et al. | |
| 2007/0294954 | A1 | 12/2007 | Barrett | |
| 2008/0057290 | A1 | 3/2008 | Guevara et al. | |
| 2008/0104901 | A1 | 5/2008 | Olvera | |
| 2008/0168741 | A1 | 7/2008 | Gilgan | |
| 2008/0178542 | A1 | 7/2008 | Williams | |
| 2008/0202048 | A1 * | 8/2008 | Miller et al. | 52/281 |
| 2008/0282626 | A1 | 11/2008 | Powers, Jr. | |
| 2008/0289265 | A1 | 11/2008 | Lessard | |
| 2008/0295450 | A1 | 12/2008 | Yogev | |
| 2009/0031652 | A1 | 2/2009 | Ortega Gatalan | |
| 2009/0038764 | A1 | 2/2009 | Pilz | |
| 2009/0077916 | A1 | 3/2009 | Scuderi et al. | |
| 2009/0090074 | A1 | 4/2009 | Klein | |
| 2009/0100769 | A1 | 4/2009 | Barrett | |
| 2009/0107065 | A1 | 4/2009 | LeBlang | |
| 2009/0113820 | A1 | 5/2009 | Deans | |
| 2009/0134287 | A1 | 5/2009 | Klosowski | |
| 2009/0165399 | A1 * | 7/2009 | Campos Gines | 52/79.1 |
| 2009/0205277 | A1 | 8/2009 | Gibson | |
| 2009/0293395 | A1 | 12/2009 | Porter | |
| 2010/0064601 | A1 | 3/2010 | Napier | |
| 2010/0146874 | A1 | 6/2010 | Brown | |
| 2010/0186313 | A1 * | 7/2010 | Stanford et al. | 52/125.1 |
| 2010/0212255 | A1 | 8/2010 | Lesoine | |
| 2010/0218443 | A1 | 9/2010 | Studebaker et al. | |
| 2010/0229472 | A1 | 9/2010 | Malpas | |
| 2010/0235206 | A1 | 9/2010 | Miller et al. | |
| 2010/0263308 | A1 | 10/2010 | Olvera | |
| 2010/0325971 | A1 | 12/2010 | Leahy | |
| 2010/0325989 | A1 | 12/2010 | Leahy | |
| 2011/0023381 | A1 | 2/2011 | Weber | |
| 2011/0056147 | A1 | 3/2011 | Beaudet | |
| 2011/0113709 | A1 | 5/2011 | Pilz | |
| 2011/0162167 | A1 | 7/2011 | Blais | |
| 2011/0268916 | A1 | 11/2011 | Pardue, Jr. | |
| 2011/0296769 | A1 | 12/2011 | Collins et al. | |
| 2011/0296778 | A1 | 12/2011 | Collins et al. | |
| 2011/0296789 | A1 | 12/2011 | Collins et al. | |
| 2011/0300386 | A1 | 12/2011 | Pardue, Jr. | |
| 2012/0151869 | A1 | 6/2012 | Miller | |
| 2013/0025222 | A1 | 1/2013 | Mueller | |
| 2013/0036688 | A1 | 2/2013 | Gosain | |
| 2013/0111840 | A1 | 5/2013 | Bordener | |
| 2013/0133277 | A1 | 5/2013 | Lewis | |
| 2014/0013678 | A1 | 1/2014 | Deverini | |
| 2014/0013695 | A1 | 1/2014 | Wolynski et al. | |
| 2014/0047780 | A1 | 2/2014 | Quinn et al. | |
| 2014/0059960 | A1 | 3/2014 | Cole | |
| 2014/0069035 | A1 | 3/2014 | Collins et al. | |
| 2014/0069040 | A1 | 3/2014 | Gibson | |
| 2014/0069050 | A1 | 3/2014 | Bolin | |
| 2014/0083046 | A1 | 3/2014 | Yang | |
| 2014/0130441 | A1 | 5/2014 | Sugihara et al. | |
| 2015/0096251 | A1 | 4/2015 | McCandless et al. | |

FOREIGN PATENT DOCUMENTS

| | | | |
|---|---|---|---|
| CN | 20137279 | | 3/2008 |
| EP | 1045078 | | 10/2000 |
| EP | 1739246 | B1 | 1/2005 |
| EP | 2128353 | A1 | 12/2009 |
| EP | 2238872 | A2 | 10/2010 |
| EP | 2281964 | A1 | 2/2011 |
| GB | 898905 | | 6/1962 |
| JP | H0130985 | A | 1/1991 |
| JP | 10234493 | | 9/1998 |
| JP | 2000144997 | A | 5/2000 |
| JP | 2008073434 | | 4/2008 |
| JP | 2008110104 | | 5/2008 |
| KR | 20060066931 | B1 | 6/2006 |
| WO | 9107557 | A1 | 5/1991 |
| WO | WO 97/22770 | | 6/1997 |
| WO | 0058583 | | 10/2000 |
| WO | 0235029 | A1 | 5/2002 |
| WO | WO 2007/059003 | | 5/2007 |
| WO | WO 2010/030060 | | 3/2010 |
| WO | 2010037938 | A2 | 4/2010 |

OTHER PUBLICATIONS

Riusillo, "Lift-Slab Construction: Its History, Methodology, Economics, and Applications." vol. 107: Abstract Only, 1988.

International Search Report and Written Opinion of the Interna-

(56) References Cited

OTHER PUBLICATIONS tional Searching Authority for PCT Application No. PCT/US2011/001039 mailed on Oct. 5, 2011.
"Beam to column connection", TATA Steel, http://www.tatasteelconstruction.com/en/reference/teaching_resources/architectural_studio_reference/elements/connections/beam_to_column_connections, Jul. 9, 2014, pp. 1-4.
"Emerging Trends 2012 Executive Summary", Urban Land Institute, Ch. 1, 2011, pp. 3-13.
"How to Soundproof a Ceiling—Soundproofing Ceilings", http://www.soundproofingcompany.com/soundproofing-solutions/soundproof-a-ceiling/, Apr. 2, 2014, pp. 1-7.
Borzouie, Jamaledin, et al., "Seismic Assessment and Rehabilitation of Diaphragms—Technical report", http://www.nosazimadares.ir/behsazi/15WCEE2012/URM/1/Roof.pdf, Dec. 31, 2011, pp. 1-86.
"Structural Insulated Panel", Wikipedia, http://www.en.wikipedia.org//wiki/Structural_insulated_panel, Aug. 15, 2014.
"Structural Insulated Panels", SIP Solutions, http://www.sipsolutions.com/content/structural-insulated-panels, Aug. 15, 2014.
"US Apartment & Condominium Construction Forecast 2003-2017", Jun. 2012, Statista, Inc.
Azari, et al., "Modular Prefabricated Residential Construction—Constraints and Opportunities", PNCCRE Technical Report #TR002, Aug. 2013, pp. i-90.
Giles, et al., "Innovations in the Development of Industrially Designed and Manufactured Modular Concepts for Low-Energy, Multi-Story, High Density, Prefabricated Affordable Housing", Innovations in the Development of Industrially Designed and Manufactured Modular Concepts, 1-15.
Gonchar, "Paradigm Shift—Multistory Modular", Architectural Record, Oct. 2012, pp. 144-148.
Kerin, et al., "National Apartment Market Report—2013", Marcus & Millichap, 2013, 1-9.
McIlwain, "Housing in America—The Next Decade", Urban Land Institute, 2010, pp. 1-28.
McIlwain, "The Rental Boost From Green Design", Urban Land, Jan. 4, 2012, pp. 1-3.
Shashaty, Andre, "Housing Demand", Sustainable Communities, Apr. 2011, pp. 14-18.
Sichelman, "Severe Apartment Shortage Looms", Urban Land, http://urbanland.uli.org/capital-markets/nahb-orlando-severe-apartment-shortage-looms/, Jan. 13, 2011, pp. 1-2.
Stiemer, S F., "Bolted Beam-Column Connections", http://faculty.philau.edu/pastorec/Tensile/bolted_beam_column_connections.pdf, Nov. 11, 2007, pp. 1-16.
International Search Report with Written Opinion for PCT Application No. PCT/US2011/001039 mailed on Oct. 5, 2011.
Final Office Action mailed Apr. 15, 2014, in U.S. Appl. No. 14/077,565, Arlan Collins, filed Jun. 8, 2010.
Final Office Action mailed Apr. 18, 2012, in U.S. Appl. No. 12/796,603, Arlan E. Collins, filed Jun. 8, 2010.
Final Office Action mailed Apr. 18, 2012, in U.S. Appl. No. 13/155,319, Arlan Collins, filed Jun. 7, 2011.
Final Office Action mailed May 9, 2013, in U.S. Appl. No. 13/155,319, Arlan Collins, filed Jun. 7, 2011.
Final Office Action mailed May 11, 2012, in U.S. Appl. No. 12/796,625, Arlan Collins., filed Jun. 8, 2010.
Final Office Action mailed May 6, 2014, in U.S. Appl. No. 12/796,603, Arlan E. Collins, filed Jun. 8, 2010.
Non Final Office Action mailed Dec. 27, 2013, in U.S. Appl. No. 14/077,565, Arlan Collins, filed Jun. 8, 2010.
Non Final Office Action mailed Jul. 18, 2013, in U.S. Appl. No. 12/796,625, Arlan Collins, filed Jun. 8, 2010.
Non Final Office Action mailed Nov. 8, 2012, in U.S. Appl. No. 13/155,319, Arlan Collins, filed Jun. 7, 2011.
Non Final Office Action mailed Oct. 11, 2011, in U.S. Appl. No. 12/796,625, Arlan Collins, filed Jun. 8, 2010.
Non Final Office Action mailed Oct. 19, 2011, in U.S. Appl. No. 13/155,319, Arlan Collins, filed Jun. 7, 2011.
Non-Final Office Action mailed Apr. 11, 2014, in U.S. Appl. No. 13/700,429, Arlan Collins, filed Nov. 27, 2012.
Non-Final Office Action mailed Jul. 18, 2013, in U.S. Appl. No. 12/796,603, Arlan E. Collins, filed Jun. 8, 2010.
Non-Final Office Action mailed Oct. 11, 2011, in U.S. Appl. No. 12/796,603, Arlan E. Collins, filed Jun. 8, 2010.
Corrected Notice of Allowability Action mailed Jun. 9, 2014, in U.S. Appl. No. 12/796,625, Arlan Collins, filed Jun. 8, 2010.
Corrected Notice of Allowabilty Action mailed Mar. 14, 2014, in U.S. Appl. No. 12/796,625, Arlan Collins, filed Jun. 8, 2010.
Notice of Allowance Action mailed May 6, 2014, in U.S. Appl. No. 12/796,625, Arlan Collins, filed Jun. 8, 2010.
Notice of Allowance Action mailed Nov. 15, 2013, in U.S. Appl. No. 12/796,625, Arlan Collins, filed Jun. 8, 2010.
Notice of Allowance mailed Jul. 8, 2014, in U.S. Appl. No. 14/077,565, Arlan Collins, filed Jun. 8, 2010.
Framecad, "FC EW 1—12mm Fibre Cement Sheet + 9mm MgO Board Wall Assembly", 2013.
Notice of Allowance mailed Jan. 7, 2015, in U.S. Appl. No. 12/796,625, Arlan K Collins, filed Jun. 8, 2010.
Notice of Allowance mailed Nov. 6, 2014, in U.S. Appl. No. 12/796,603, Arlan K Collins, filed Jun. 8, 2010.
Notice of Allowance mailed Nov. 13, 2014, in U.S. Appl. No. 14/077,565, Arlan K Collins, filed Nov. 12, 2013.
Notice of Allowance mailed Sep. 12, 2014, in U.S. Appl. No. 12/796,625, Arlan K Collins, filed Jun. 8, 2010.
Notice of Allowance mailed Sep. 23, 2014, in U.S. Appl. No. 12/796,603, Arlan K Collins, filed Jun. 8, 2010.
"Insulspan Installation Guide", Obtained at: http://www.insulspan.com/downloads/InstallationGuide.pdf on Feb. 2, 2016.
Canadian Office Action dated Jun. 9, 2016 received in CA App No. 2,801,287.

* cited by examiner

200A

300C

300B

300A

300E

300D

FLOOR PLAN

ELEVATION VIEW

SLAB CONSTRUCTION SYSTEM AND METHOD FOR CONSTRUCTING MULTI-STORY BUILDINGS USING PRE-MANUFACTURED STRUCTURES

CROSS-REFERENCE TO RELATED APPLICATIONS

The present application is a U.S. national stage filing under 35 U.S.C. §371 of International Application No. PCT/US2011/001039, filed on Jun. 7, 2011, which is a continuation-in-part under 35 U.S.C. §120 of U.S. patent application Ser. No. 12/796,625, filed on Jun. 8, 2010, now U.S. Pat. No. 9,027,307, titled "Construction System And Method For Constructing Buildings Using Pre-manufactured Structures," and is also is a continuation-in-part under 35 U.S.C. §120 of U.S. patent application Ser. No. 12/796,603, filed Jun. 8, 2010, now U.S. Pat. No. 8,950,132, titled "Pre-manufactured Structures For Constructing Buildings." The entirety of these applications are incorporated herein by reference.

FIELD OF THE INVENTION

The present invention relates generally to the construction industry, and relates more specifically to a lift-slab construction system and method for constructing multi-story buildings using pre-manufactured structures.

BACKGROUND OF THE INVENTION

Conventional pre-manufactured building construction has typically focused on single-story buildings or building room modules or components for incorporation into new or pre-existing building structures. Conventional pre-manufactured building structures have been promoted based on the purported cost, timing, and efficiency advantages of having construction pre-manufactured at manufacturing plants or factories prior to delivery and installation at a building site. Conventional pre-manufactured building structures may be delivered either as complete structures that require minimal installation, e.g., mobile homes, or may be partial building structures or components that require labor and costly on-site installation. Installation of these pre-manufactured structures generally occur using conventional construction techniques.

It is not always cheaper, faster and more efficient to pre-manufacture building structures at manufacturing plants or factories to be delivered to the building site for further installation and/or integration and finishing on-site. Handling of such structures can be extremely difficult, time-intensive and cost-prohibitive due to weight, bulk, and craning issues. Shipping modular structures or spaces can raise transportation issues due to weight and space problems. Due to the size of some building structures, transport may be inefficient as trucks may only fit one to two modules for delivery to a construction site. Huge cranes may be required to lift the modules to and from the trucks, or other transport means, at the manufacturing plants as well as at the building sites.

With regard to multi-story building construction, on-site construction is conventionally preferred over use of pre-manufactured constructs because pre-manufactured structures are not typically adapted for building multi-story structures.

Conventional lift-slab construction for building multi-story buildings involves the lifting of heavy slabs by strand jacks located on top of columns. After the slab is lifted into position, it must be secured to the supporting columns which are typically located underneath a lifted slab. Securing such lifted slabs requires construction workers to undesirably and unsafely engage in the dangerous activity of working underneath heavy unsecured slabs in order to adequately secure the slabs to the columns. Such unsecured slabs may fall and crush or kill persons located underneath the slab.

The present invention utilizes pre-manufactured structures together with a lift-slab building process to overcome the limitations of utilizing pre-manufactured structures when constructing multi-story buildings.

The present invention offers several advantages over known construction systems and methods in addition to adapting the concept of pre-manufactured structures for use in multi-story building construction.

Advantages of the present invention include increased ease and efficiency of construction, reduced construction time, reduced construction cost, minimal use of scaffolding, minimal use of field welding, safer construction, higher quality construction, construction of a consistent quality, the practice of more environmentally sound construction practices including "green" building construction, reduced maintenance costs, increased ease of access to intelligently designed building spaces for residential, institutional and/or commercial use, the ready ability to permit limited interior space and finishing details customization by the governments, municipalities, townships, builders, consumers, occupants and/or other purchasers or users of these buildings, the ready ability to manage the cost, delivery, timing, and experience expectations of governments, municipalities, townships, builders, consumers, occupants and/or other purchasers or users of these buildings due to the buildings' familiar and repeated pre-manufactured components and the ability to use experience gained by virtue of constructing other similar buildings in accordance with the present invention.

BRIEF SUMMARY OF THE INVENTION

The present invention integrates the use of pre-manufactured structures with minimal on-site installation and lift-slab construction to achieve the construction of multi-story buildings, while at the same time making building construction easier, more efficient, faster, cheaper, safer, of higher quality and consistency, environmentally advantaged, energy-efficient, easier to maintain, intelligently designed, and customizable. The buildings of the present invention also result in an enhanced building experience for all those involved in the purchase, construction and use of the buildings due, at least in part, to the ability to manage cost, delivery, timing, and experience expectations based on experiences garnered from other similar buildings constructed according to the present invention.

The present invention comprises a set of pre-manufactured structures designed for ready integration with each other and with limited on-site lift-slab construction. The present invention incorporates use of innovative lift-slab construction techniques. The pre-manufactured structures themselves are designed so that they may be arranged to create buildings and interior building units of various sizes and functionality. The pre-manufactured structures are designed so as to be readily integrated with both horizontal and vertically adjacent building components, including lift-slab components and/or other pre-manufactured structures, so that multiple building stories may be readily and securely stacked, one on top of the other. The pre-manufactured components permit development of flexible design plans for institutional, residential, office and other types of buildings, and may be provided with various finish packages customized to order.

The pre-manufactured structures preferably involve the use of as many repetitive and self-sustaining construction methods and as many preassembled and prefinished structures as possible. Preassembled and prefinished structures are constructed in a manufacturing facility, transported to the construction site and installed within and/or on the lift-slab structure in conjunction with other components to create a fully finished, comfortable and weather-tight living environment. The present invention also contemplates use of semi- or largely prefinished components that may be fully and finally finished at the construction site. The pre-manufactured structures are preferably sized and packaged to eliminate wasted shipping space to facilitate efficiency of transport.

Standardizing the pre-manufactured structures and constructing them in a manufacturing facility provides the advantages of, among other things, reduced materials waste, reduced energy costs, quality control, faster production, consistent production, safer production, and increased labor productivity. The initial assembly of the components may eventually become automated. However, another advantage of the present invention is that construction may be carried out by less skilled labor under the supervision of qualified managers. Given that assembly will occur in an environmentally controlled setting, the potential for mold or materials damage due to exposure may also be reduced.

As will be explained in greater detail below, the lift-slab construction involving the pre-manufactured structures of the present invention provides for "top-down" construction. That is, once the building's foundation and any parking or floors below or at grade and the supporting external columns and/or beams are in place, the buildings of the present invention may be built from the top down, starting with the roof and moving sequentially down through each level until construction is complete. Roof slabs and floor slabs are lifted into place using multiple strand jacks located on top of the external columns and/or beams. The external columns and/or beams may be located around the exterior perimeter of the building slabs. Once a slab is lifted into place, connections located at the slab edge are used to secure the slab to the external columns and/or beams. The slab may be connected by various means, including but not limited to, bolted or pinned connections and/or the use of welding. The preferred method of the current invention is the use of bolts and/or pins to secure the slabs to the columns and/or beams to allow for an efficient and quick installation method. The slabs may be readily secured to the external columns and beams via access created by the exterior walkways of the present invention, or by using a man-lift or other similar means. This means of connection eliminates the potential unsafe and hazardous activity of workers being underneath an unsecured slab as utilized in previous conventional lift-slab construction.

The present invention advantageously reduces, and in some cases, completely eliminates the need for exterior scaffolding. The exterior walkways are utilized for access to the utility walls, while the window walls are securely attached to the lifted slabs from the interior of the unit. The end walls at each end of a multi-story building are the only location where exterior scaffolding might be necessary. This need can potentially be eliminated if the end walls are fully prefinished with the exterior components installed prior to being set in place. In this case, a man-lift or other similar means may be used to install final panels to the exterior wall. The lift-slab construction system also reduces, and in some cases, largely eliminates the need for construction cranes. By reducing the need for, and or eliminating entirely, the need for scaffolding and construction cranes, the present invention significantly and advantageously reduces the time and costs involved in multi-story building construction. Furthermore, the present invention limits or eliminates the time consuming and costly practice of field welding. The structural steel may arrive at the site shop welded where necessary and ready for installation. All field connections, whether between the structural members themselves, or between the structural steel and the floor slab, may be bolted and/or pinned connections.

The present invention's top-down lift-slab construction beneficially provides enclosure of the buildings from roof to grade during construction, thus protecting the building's interior space and construction workers from the elements such as rain, snow and wind. Construction of the multi-story building from the top-down also increases the security and safety of partially constructed multi-story buildings as access to the upper building floors is limited during construction. Further, the present invention also permits multiple construction crews to be actively working on completing building construction with, for example, one crew finishing installation and/or final finishing of pre-manufactured building structures on floor slabs that have been secured into place and another crew dedicated to preparing floor slabs and/or pre-manufactured structures to be lifted.

The present invention may reduce construction time by approximately 50%, or one-half. That is, a building constructed according to the present invention that has about 100 units on five or six floors, may be completed in six (6) to eight (8) months from the podium level to the roof. By contrast, construction of a similarly sized building using conventional construction techniques would be expected to take about twelve (12) to sixteen (16) months. The present invention is well-suited for the construction of many types of multi-story buildings, including mid-rise buildings.

The present inventions comprises, in no particular order: pre-manufacturing a plurality of finished, or mostly finished, non-weight bearing walls; pre-manufacturing a plurality of finished, or mostly finished, interior components adapted to connect to the non-weight bearing walls; pre-manufacturing finished, or mostly finished, exterior components adapted to attach to the exterior building surfaces; transporting the pre-manufactured non-weight bearing walls, interior components, and exterior components to a building site; preparing a multi-story building foundation at the building site to support a plurality of load-bearing structural columns and/or beams; forming a plurality of floor slabs and a roof slab to attach to the structural columns and/or beams at each building level; constructing the load-bearing structural columns and beams at the building site; lifting the roof slab and each floor slab to attach to structural columns and/or beams at each level; installing stairs and elevators which attach to the structural columns, beams and/or slabs; installing the non-weight bearing walls and the interior components at each building level; and installing the plurality of exterior components on exterior building surfaces. The non-weight bearing walls, interior components, and exterior components are assembled and installed to provide the multi-story building with the plurality of units which may be identical or have different floor plans and may, optionally, include a retail level with amenity space and underground parking.

The present invention may be used to construct various buildings with a plurality of institutional, office, commercial, and/or residential units including, for example, studio units, one or multiple bedroom units, and/or a mix of such units.

The non-weight bearing walls of the present invention may include: demising walls that are pre-manufactured, pre-wired, pre-plumbed, prefinished, pre-bundled, preassembled, and may include preassembled sections, electrical wiring and electrical radiant heat, acoustic insulation, studs for framing, fire rated sheathing, interior finish material, and may include plumbing for sprinklers; end walls that are pre-manufactured, pre-wired, pre-plumbed, prefinished, pre-bundled, preassembled, and may include preassembled sections, electrical wiring and electrical radiant heat, acoustic insulation, studs for framing, fire-rated sheathing, interior finish material, vapor barrier, thermal insulation, fire rated exterior sheathing, weather resistive barrier, an exterior cladding system, and may include plumbing for sprinklers; exterior walls that are pre-manufactured, pre-wired, pre-plumbed, prefinished, pre-bundled, preassembled, and may include preassembled sections, electrical wiring and electrical radiant heat, acoustic insulation, studs for framing, fire-rated sheathing, interior finish material, vapor barrier, thermal insulation, fire rated exterior sheathing, weather resistive barrier, an exterior cladding system, and may include plumbing for sprinklers and an optional window or door; utility walls that are pre-manufactured, pre-wired, pre-plumbed, prefinished, pre-bundled, preassembled, and may include features that permit stacking of the utility walls, heating, ventilating, and air conditioning (HVAC), electrical and communications wiring for adjacent walls, an electrical service panel, kitchen and bath plumbing, including kitchen and/or bath supply and waste lines and vent ducting, exhaust vents/fans and vent trims, and toilet mounting support with a water-resistant, interior surface, interior sheathing, vapor barrier, acoustic insulation, plumbing chase, studs for framing, exterior sheathing, weather resistive barrier, and an exterior cladding system; and exterior window walls that are pre-manufactured, prefinished, preassembled, pre-bundled and that may be pre-glazed and pre-bundled with a unitized wall system, and may include windows, insulation, insulated aluminum or glass and weather seal. Optionally, pre-manufactured, pre-wired, prefinished and preassembled ceiling panels that may include electrical wiring and acoustical paneling may also be used as part of the present invention. Each of the above components may also be pre-manufactured so as to be only partially prefinished and/or preassembled, with complete finishing and assembly to be done upon or after installation.

The present invention may optionally incorporate several environmentally friendly and/or green building practices. The present invention may utilize recycled products and materials, use low volatile organic compounds (VOC) finishes for improved indoor air quality, provide an abundance of natural day lighting for user comfort and well-being, provide operable windows for natural cross ventilation, incorporate use of alternative energy sources such as solar panels and wind powered turbines, provide solar thermal panels for domestic hot water and radiant heating, aid water and collection retention with green and vegetated roofs and water cisterns, utilize gray water recycling methods, provide water features and landscaping within the courtyard, and may increase cooling by introduction of green walls. The present invention optionally includes the use of external rain screen system on the building itself. The rain screen system may be located directly adjacent to the building exterior and or may include an air gap of, for example, between about 1" to 3," between the insulation and the cladding to allow for air movement within the cavity to provide a means of drying potential moisture behind the cladding material. The external cladding may be comprised of various materials allowed by code, such as, but not limited to, composite panels, phenolic resin panels, metal panels, cement board, lightweight precast concrete panels, wood siding, gypsum fiber reinforced cement panels, ceramic tile, and stone panels, and may be attached to metal or wood furring channels set apart from the insulation with an air gap.

The precise sequence of steps involved in the lift-slab method used to produce a multi-story building according to the present invention may be re-ordered and executed in various different sequence steps, including, for example, those methods disclosed in U.S. patent application Ser. Nos. 12/796,625 and 12/796,603, the contents of which are fully incorporated by reference herein.

The methods and sequence of construction steps disclosed in connection with production of identical unit and mixed unit residential buildings described in detail immediately below are provided as exemplary embodiments of the present invention only and are, in no way, intended to be limiting.

One method of constructing a multi-story building with a plurality of units comprises: (a) pre-manufacturing a plurality of non-weight bearing walls with a finished exterior including all electrical, insulating, plumbing and communications components; (b) pre-manufacturing a plurality of interior components adapted to connect to the non-weight bearing walls; (c) pre-manufacturing a plurality of exterior components adapted to attach to the building's exterior surfaces; (d) transporting the non-weight bearing walls, the interior components, and the exterior components to a building site; (e) preparing a multi-story building foundation at the building site to support a plurality of load-bearing structural columns and/or beams; (f) forming and pouring a plurality of floor slabs and a roof slab to attach to the structural columns and beams at each building level; (g) constructing the load-bearing structural columns and/or beams at the building site; (h) installing the exterior walkways to the structural columns and/or beams; (i) installing stairs and elevators to attach to the structural columns, beams and/or slabs; (j) loading the plurality of exterior components on the first slab; (k) lifting and securing the first slab from the poured slabs up to top of the building; (l) loading the plurality of non-weight bearing walls, the interior components, and the exterior components to the second slab; (m) lifting and securing the second slab to the structural columns and beams forming the top floor; (n) repeating steps (l) through (m) until all building levels are completed; (o) installing exterior components on exterior building surfaces; (p) installing demising walls in a direction perpendicular to the longitudinal direction of the slab and partially enclosing each of the units; (q) installing end walls on the exterior sides of the units at building's ends in a direction parallel to the demising walls and partially enclosing each of the units located at the building's ends; (r) installing utility walls on the interior sides of the units in a perpendicular direction interfacing with the demising walls and connecting with the demising walls to partially enclose each of the units; (s) installing exterior window walls on exterior sides of the units and substantially enclosing each of the units; (t) installing entry doors in line with the utility walls and completely enclosing each of the units; (u) installing kitchen and bathroom components to the utility walls; and (v) installing interior partitions within each of the units for separating rooms and configuring each of the units. Using this method of construction, the non-weight bearing walls, the interior components, and the exterior components may be assembled and installed to provide the multi-story building with units having identical or different floor plans and, optionally, a retail level with underground parking.

Another method of constructing a multi-story building with a plurality of units comprises: (a) pre-manufacturing a plurality of non-weight bearing walls with a finished exterior including all electrical, insulating, plumbing and communications components; (b) pre-manufacturing a plurality of interior components adapted to connect to the non-weight bearing walls; (c) pre-manufacturing a plurality of exterior components adapted to attach to the building's exterior surfaces; (d) transporting the non-weight bearing walls, the interior components, and the exterior components to a building site; (e) preparing a multi-story building foundation at the building site to support to a plurality of load-bearing structural columns and/or beams; (f) forming and pouring a plurality of floor slabs and a roof slab to attach to the structural columns and beams at each building level; (g) constructing the load-bearing structural columns and/or beams at the building site; (h) installing stairs and elevators to attach to the structural columns, beams and/or slabs; (i) installing exterior roof components on the top slab surface; (j) lifting and securing the first slab from the poured slabs up to top of the building; (k) installing the non-weight bearing walls other than exterior window walls and some of the interior components on a second slab located beneath the first slab; (l) loading the exterior window walls and rest of the interior components on the second slab; (m) lifting the second slab with the non-weight bearing walls and the interior components whether installed or loaded to the floor level immediately beneath the first slab; (n) attaching the second slab securely to load-bearing structural columns and/or beams to form a top floor; (o) installing the remaining non-weight bearing walls, exterior window walls, the rest of the interior components on the second slab to complete the top level; (p) repeating steps (k) through (o) until all building levels are secured. Using this method of construction, the non-weight bearing walls, the interior components, and the exterior components may be assembled and installed to provide the multi-story building with units having identical or different floor plans and, optionally, a retail level with underground parking.

The foregoing and other objectives, features, and advantages of the invention will be more readily understood upon consideration of the following detailed description of the invention, taken in conjunction with the accompanying drawings.

BRIEF DESCRIPTION OF THE DRAWINGS

The accompanying drawings, which are incorporated in and constitute a part of this specification, illustrate various exemplary embodiments.

DETAILED DESCRIPTION OF THE INVENTION

Figure 1:
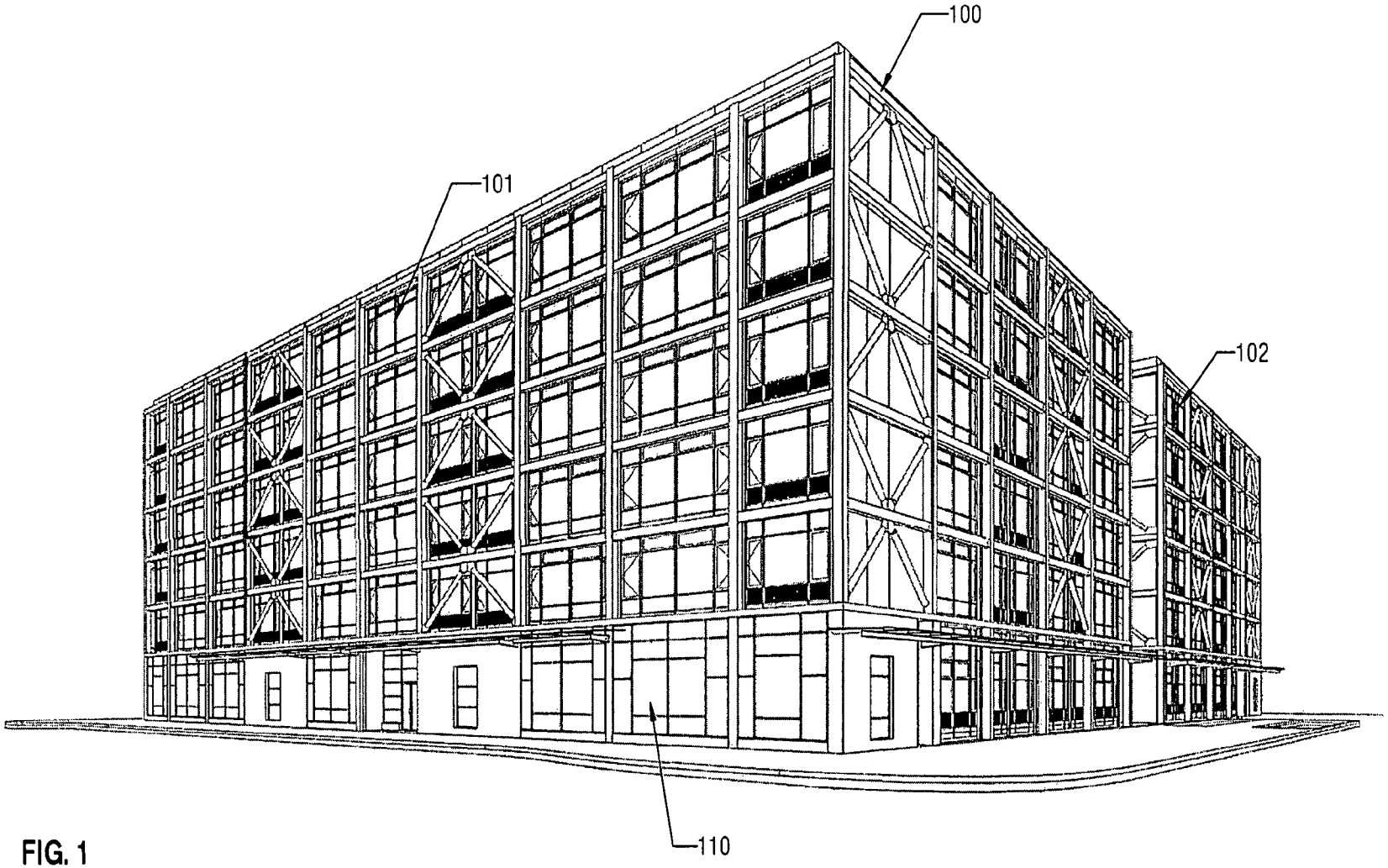
FIG. 1 illustrates a multi-story building according to an embodiment of the present invention.

Before describing the invention and the figures, some of the terminology should be clarified. Please note that the terms and phrases may have additional definitions and/or examples throughout the specification. Where otherwise not specifically defined, words, phrases, and acronyms are given their ordinary meaning in the art. Exemplary embodiments may be better understood with reference to the drawings, but these embodiments are not intended to be of a limiting nature.

As used herein, "prefinished" refers to a component or components that arrive at the building site partially or fully completed and ready to be installed, and may include application of both the interior and exterior finish materials to the component(s).

As used herein, "pre-bundled" refers to a pre-manufactured component or components that are partially or fully protected, packaged, secured or otherwise made ready for transportation to the building site.

As used herein, "preassembled" refers to the partial or full assembly of a pre-manufactured component or components that occurs wholly or in part at a location other than the building site.

The exterior window wall may be an aluminum and glass panel with the possibility of containing an operable window unit. The exterior window wall may include the use of spandrel or fritted glass, as well as metal panel within the frames. The exterior window wall may also include an integral sliding door and railing to create an open wall with a flush 'Juliet' balcony or a full balcony bolted onto the structural frame. A first type of exterior window wall may be used in a straight configuration. A second type of exterior window wall may be used in corner units located adjacent to a building's corners. All of the exterior window walls may be fully weather-sealed and may be able to provide a U-factor of at least about 0.40. A U-factor measures the rate of heat transfer through a building element over a given area.

The entry doors may be a pre-fabricated, pre-bundled entry door unit with operable transom panel above, inner and outer frames, and all associated door hardware with preassembled sections that may include electrical wiring and may include plumbing for sprinklers. The entry door may be set in place at the final exterior wall or adjacent to the utility walls. A threshold may be provided for installation after the entry door is in place.

The kitchen unit may be a pre-fabricated and preassembled kitchen unit and may include cabinets, preinstalled plumbing, plumbing connections, electrical wiring, vent ducting, countertops, at least one sink, exhaust vents/fans and light fixtures that may be installed on, or connected to, the kitchen on the utility walls.

The cabinets may be pre-manufactured and preassembled cabinets that may include integral exhaust fans, light fixtures, refrigerator and/or washer and dryer to be installed on, or connected to, the utility walls.

The bathroom vanity may include at least one sink and preinstalled plumbing that may be installed on, or connected to, the bathroom on the utility walls.

The parapet wall may be a pre-manufactured, prefinished, and preassembled wall at the top portion of the exterior window wall, end wall, exterior wall, or utility wall that may connect to a roof slab and accommodate a building's roofing and/or garden roof conditions.

The exterior walkway may be a pre-fabricated, pre-bundled walkway with preassembled sections that may support railing and decking for rapid installation. The exterior walkway may be used in place of scaffolding during construction. Specifically, the exterior walkway may be used to provide access to secure slabs to the structural columns and/or beams and to provide ease of access for connecting utilities.

It should be noted that although these embodiments are described in relative terms as prefinished, preassembled and/or pre-bundled, the present invention is not limited to pre-manufactured building structures that are completely prefinished, preassembled and/or pre-bundled in the factory or at a site other than the building site. The present invention also encompasses the final finishing or assembly of the pre-manufactured structures and/or the use of non-pre-bundled components at the building site. The use of partially prefinished, preassembled and/or pre-bundled pre-manufactured structures may be determined on a project by project basis.

Referring now in detail to the drawing figures, FIG. 1 illustrates an exemplary embodiment of a building 100 built according to the construction system and method of the present invention. FIG. 1 illustrates an exemplary six-story building 100 that is part of a development including several residential buildings 101 and 102 with a plaza or retail floor 110 at street level for commercial activity and secure, below-grade parking underneath the building 100. All of the residential buildings 101 and 102 in this development are to be constructed using the same construction system and method of the present invention.

Figure 2A:
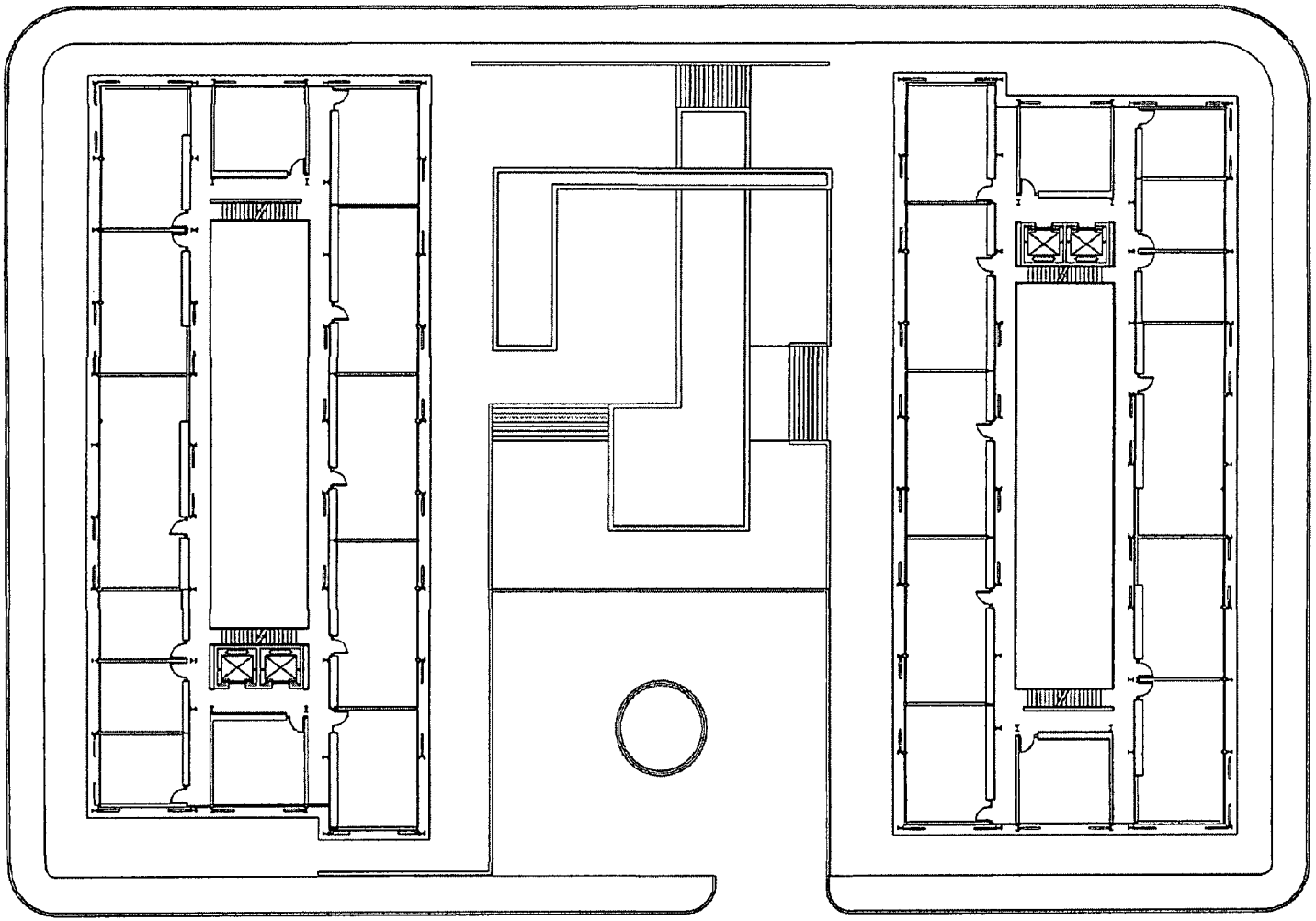
FIGS. 2A-B illustrate a building plan with various unit layouts of FIG. 1.
Figure 2B:
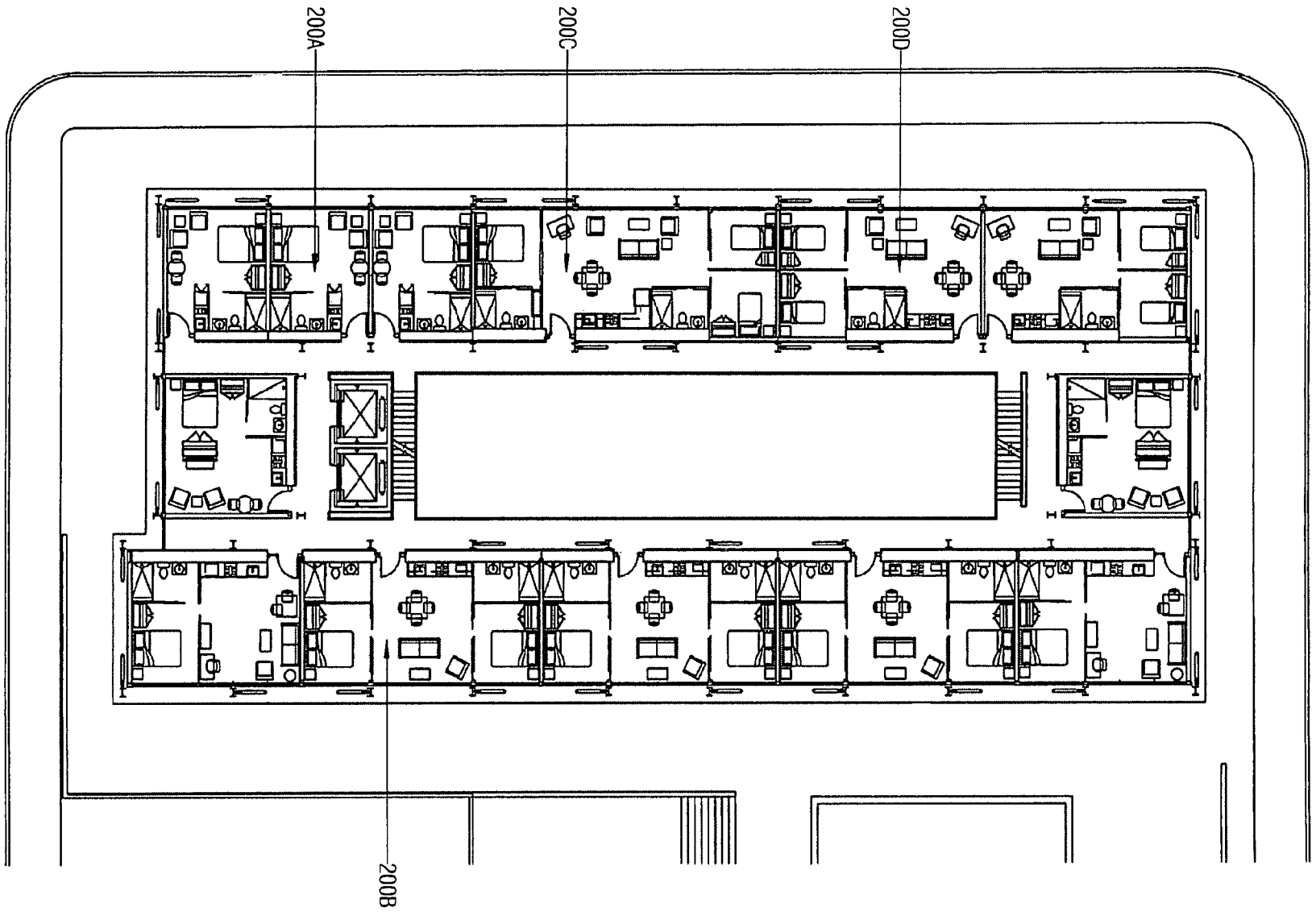

FIGS. 2A-B illustrate a building plan 200 of the exemplary building 100 of FIG. 1. As shown in FIG. 2A, all of the buildings share common exterior walkways. The inventors also note that the present invention may be readily adapted to include courtyards which may provide shared community or amenity space. By enclosing these exterior spaces within courtyards, building residents may enjoy the outdoor shared space and may also enjoy improved security if these spaces are closed off from access external to the building. FIG. 2B illustrates a detailed plan view of exemplary building plan 200 of FIG. 2A with four variations of floor plans 200A-D. Floor plans 200A-D are provided as examples only, and are not limiting with regard to the present invention.

Figure 3:
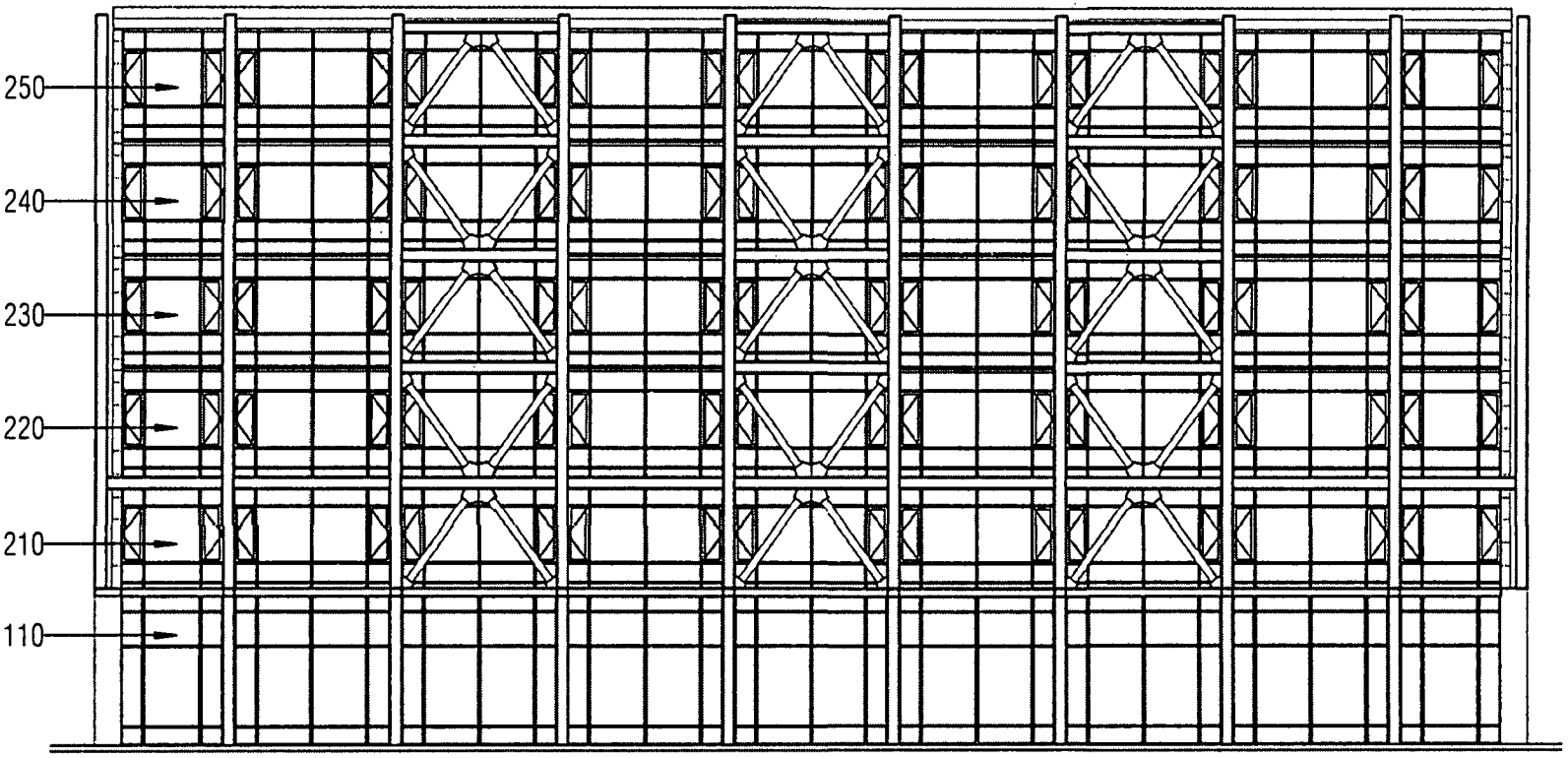
FIG. 3 illustrates a side elevation view of the multi-story building.

FIG. 3 illustrates a side elevation view of an exemplary six-story building. This exemplary building comprises second through sixth levels of residential units 210, 220, 230, 240, 250 above a main, retail floor 110 for commercial development at the street level and a level of below-grade parking (shown in FIG. 4).

Figure 4:
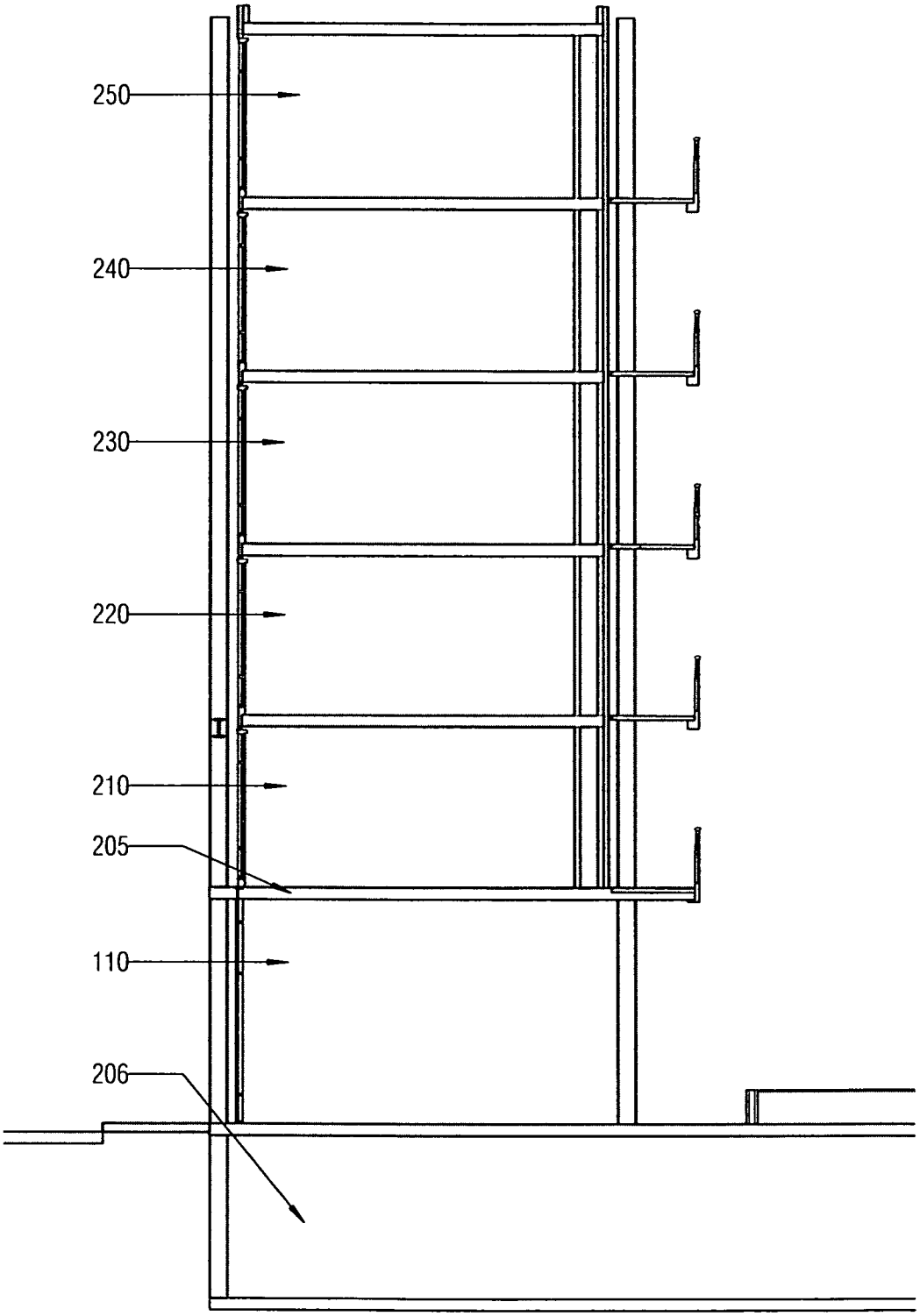
FIG. 4 illustrates a side sectional view of an exemplary portion of the multi-story building of FIG. 3.

FIG. 4 illustrates a side sectional view of an exemplary portion of the multi-story building of FIG. 3. As shown in FIGS. 3 and 4, the retail floor 110 for commercial activity is shown with residential levels 210, 220, 230, 240, 250 above the retail floor 110. Every residential level from second through sixth 210, 220, 230, 240, 250 may be identical in building floor plan and configuration. The present invention may comprise, but is not limited to, identical building floor plans and configurations for every floor. The present invention allows the number of bedrooms in any given residential unit and the layout of the units on any given floor to be modified by the simple relocation of a demising wall. However, with the present invention, the location of the utility wall should remain vertically stacked in order to maintain many of the efficiencies that are currently realized by this invention. These modifications to the layout of the units or number of bedrooms also do not require changing out of the window wall components. Furthermore, depending on the specific circumstances, there may be additional modifications to the exterior walls to accommodate different floor plans and layout of the units for various floor levels. A below grade parking level 206 is shown for parking cars for commercial and/or residential use.

Figure 5A:
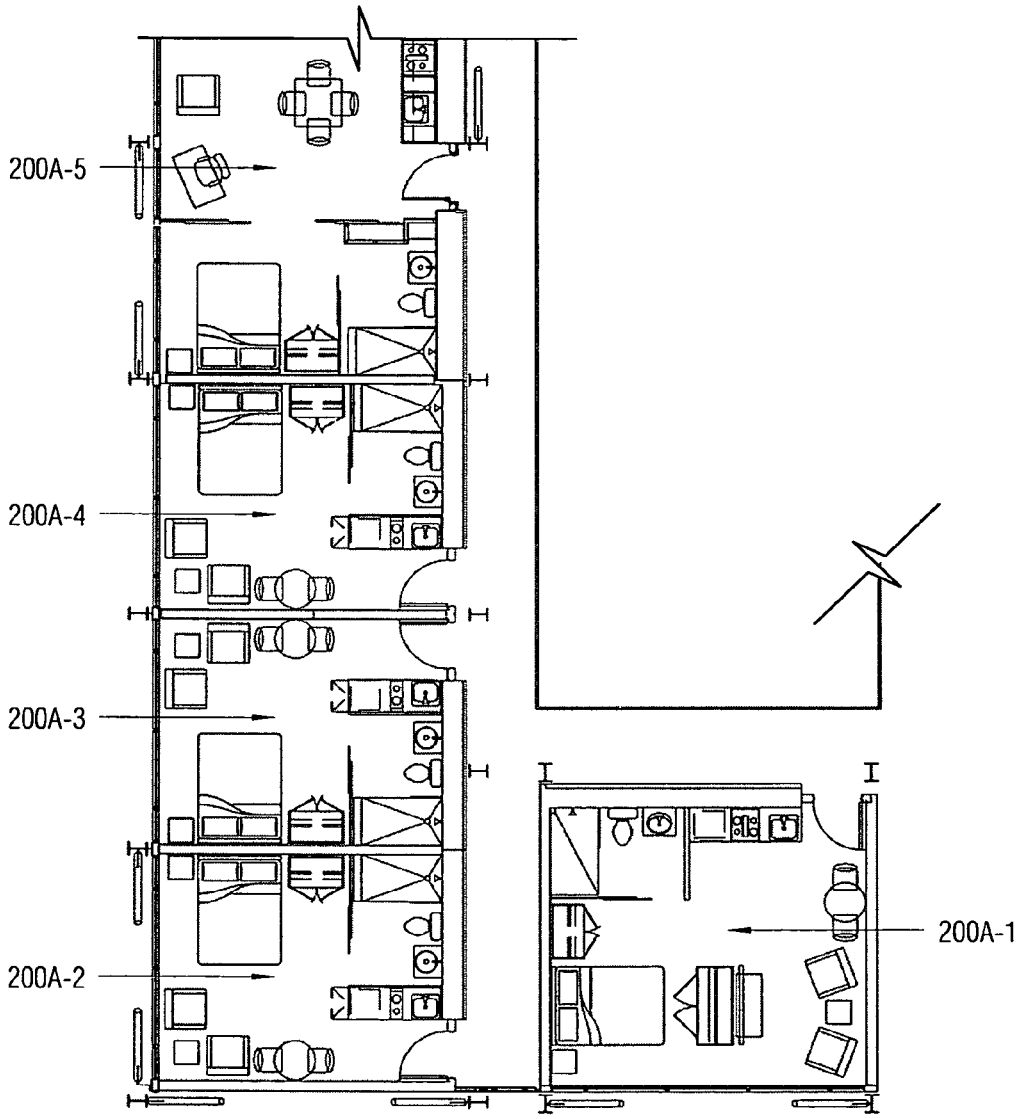
FIGS. 5A-B illustrate a floor plan of an exemplary portion of the various floor plans of FIG. 1.
Figure 5B:
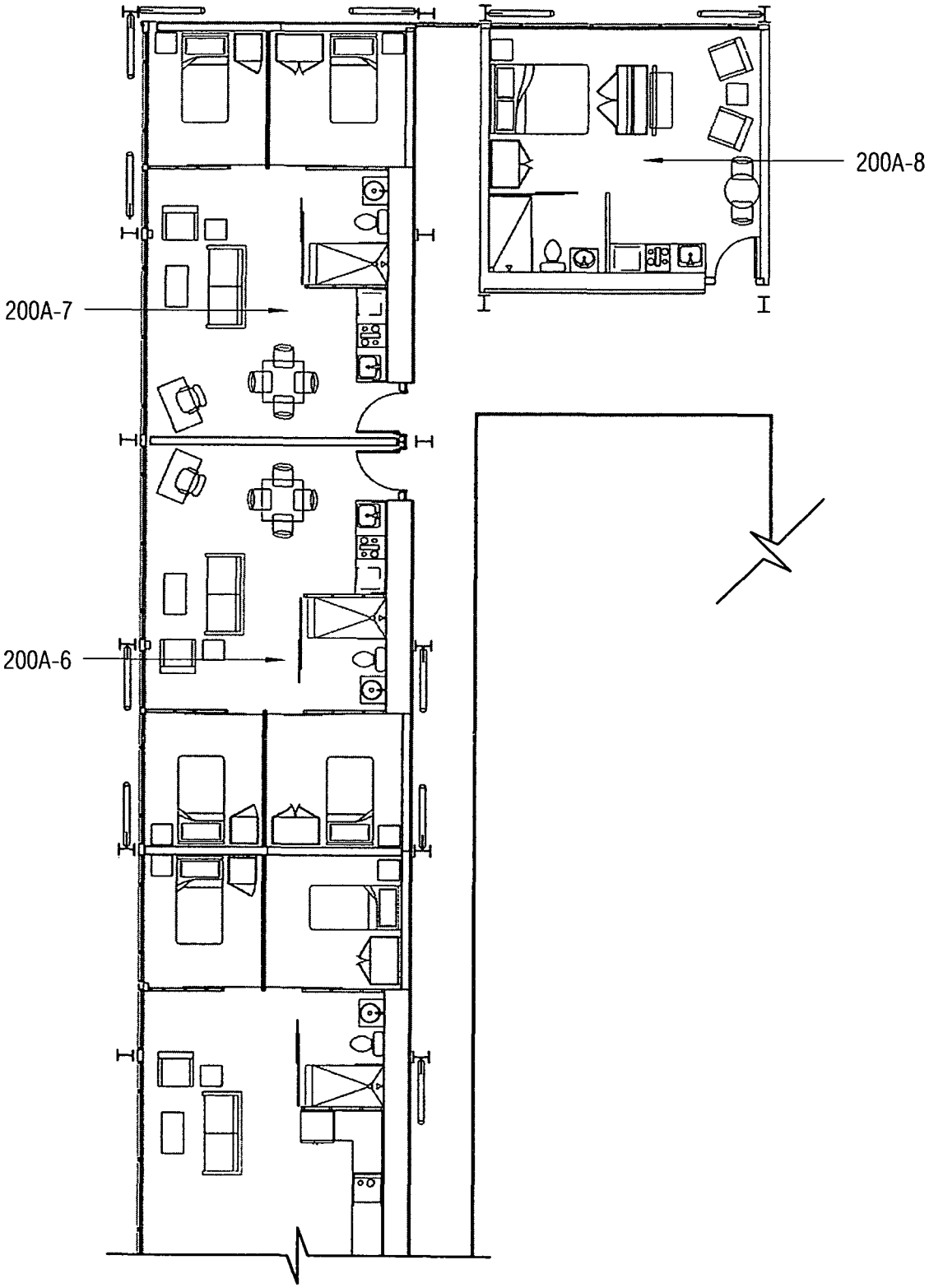

FIGS. 5A-B illustrate a floor plan 200A from FIG. 2B of the building plan 200. The floor plan 200A of the building plan 200 illustrates many different layout types of units 200A-1 to 200A-8.

Figure 6A:
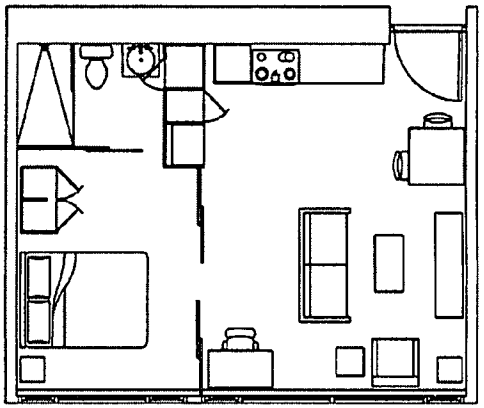
FIGS. 6A-B illustrate various embodiments of a single unit for the building of FIG. 1.
Figure 6A:
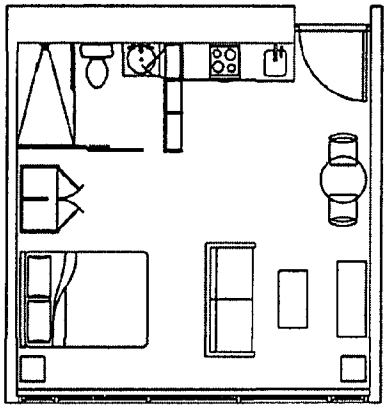
Figure 6A:
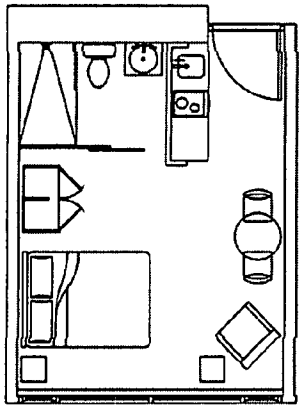
Figure 6A:
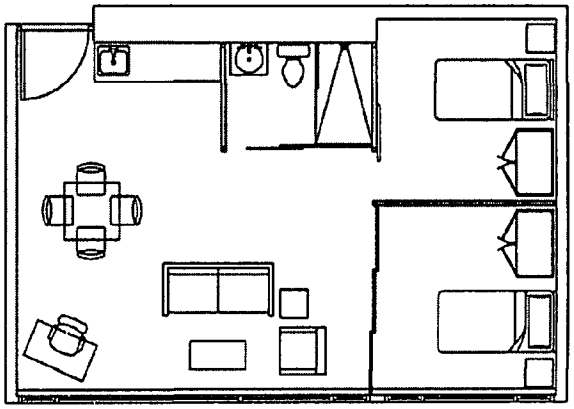
Figure 6A:
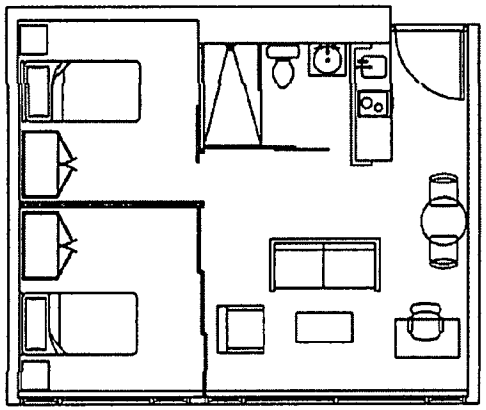
Figure 6B:
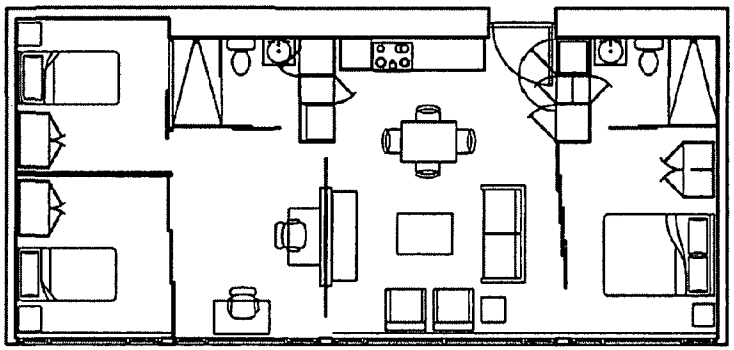
Figure 6B:
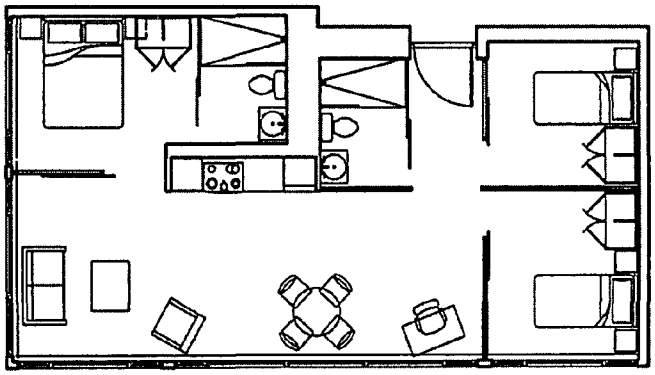
Figure 6B:
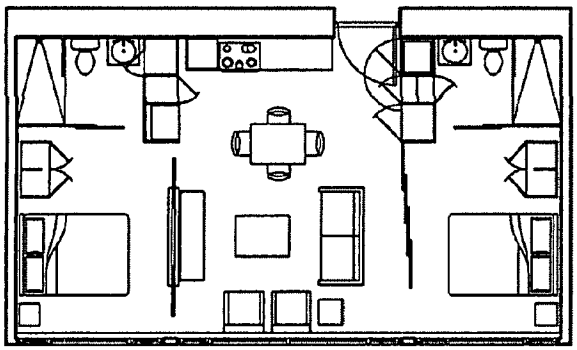
Figure 6B:
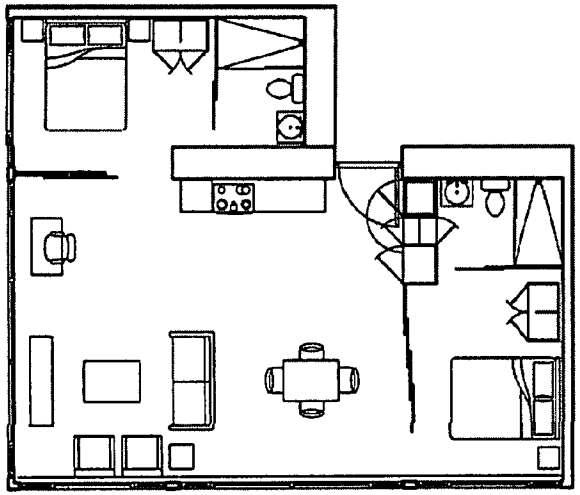

FIGS. 6A-B illustrate exemplary floor plans 300A-H and 300J of the different types of units and layout variations to be implemented into any floor level 210, 220, 230, 240, 250 of a multi-story building 100. An efficiency plan 300A is illustrated in the first exemplary unit type. A studio plan 300B is illustrated in the second exemplary unit type. A one-bedroom plan 300C, as possible corner units, is illustrated in the third exemplary unit type. A two-bedroom efficiency plan 300D, as possible units, is illustrated in the fourth exemplary unit type. A two-bedroom plan 300E, as possible end units, is illustrated in the fifth exemplary unit type. In 300F, a two-bedroom with two bathrooms is illustrated in the sixth exemplary unit type. A three-bedroom with three beds and two bathrooms 300G, as possible end units, is illustrated in the seventh exemplary unit type. A two-bedroom with two bathrooms plan 300H on a corner is illustrated in the eighth exemplary unit type. A three-bedroom with two bathrooms plan 300J on a corner is illustrated in the ninth exemplary unit type. It should be noted that this figure is not meant to limit the types and arrangements of possible unit layouts in the present invention.

Figure 7:
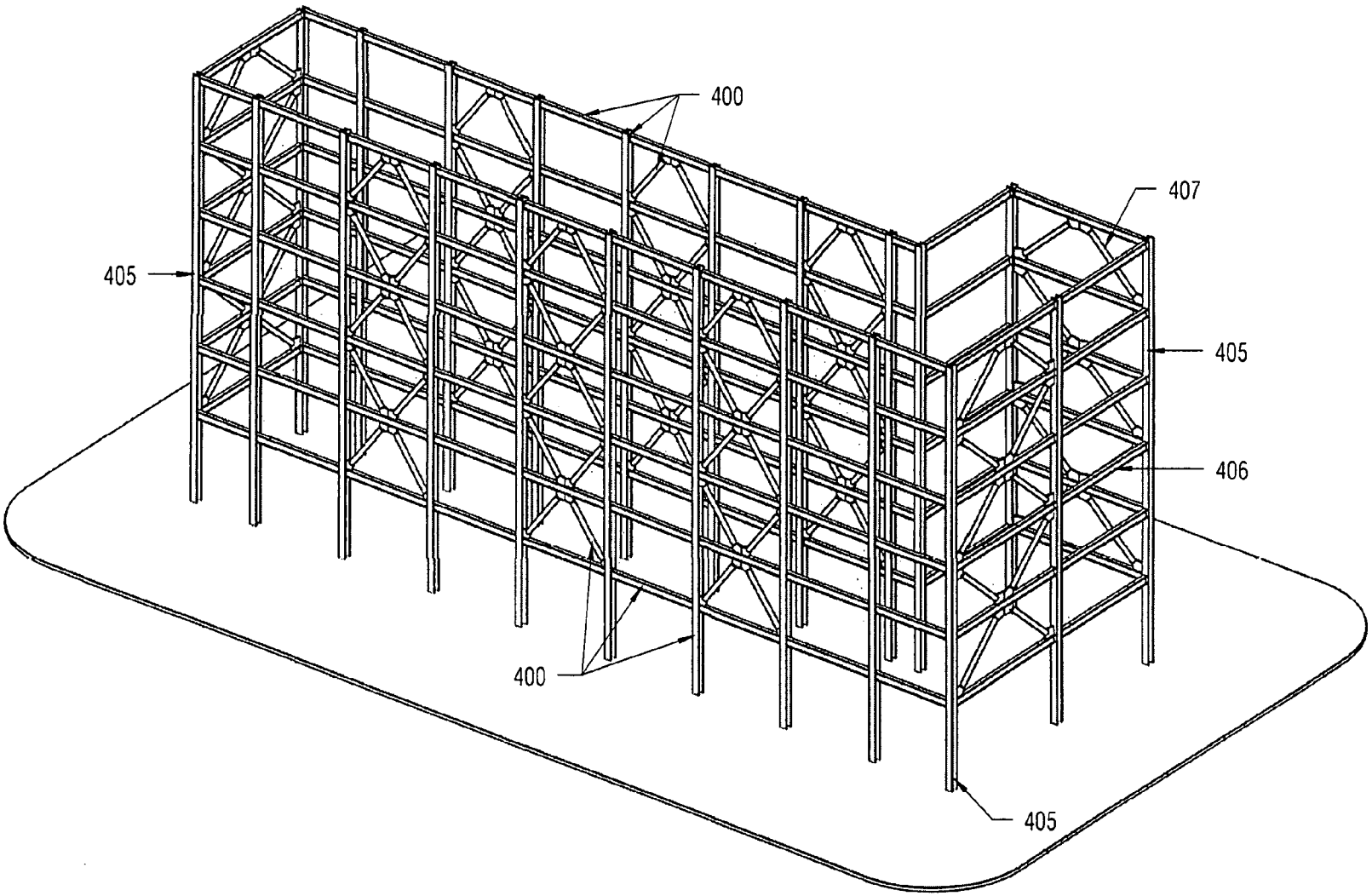
FIG. 7 illustrates the structural framing of the multi-story building of FIG. 1.

The lift-slab construction of the multi-story building 100 is described in detail for the load bearing assembly of the structural frame 400 and floor slabs 450. More specifically, FIG. 7 illustrates the structural frame 400 of the exemplary multi-story building 100 of FIG. 1. The structural frame 400 material is preferably steel even though other materials with similar strength and durability may be used for constructing the building 100. Therefore, utilizing steel for the structural frame 400 is not meant to be limiting. The structural frame 400 can also be made out of cast-in-place concrete, concrete masonry unit, precast concrete or similar materials. Vertical columns 405, horizontal beams 406, and diagonal brace frame members 407 are used for this load bearing assembly of the structural frame 400. Structural steel framing occurs only at the perimeter of the building's slabs. All primary steel framing members are positioned exterior to the building for providing support. The steel framing 400 is delivered to the site in as-complete-of-an-assembly as possible, only limited in size by shipping or trucking restrictions. Vertical columns 405, horizontal beams 406 and diagonal brace frames 407 may be hoisted by crane and braced and bolted into place. The perimeter steel framing 400 for the building 100 may be placed prior to or after the building's slabs 450A-F are poured in place (shown in FIG. 8). Strand jacks are strategically located atop the support columns and/or beams. The number of strand jacks used is dependent on the length and shape of the floor slabs to be hoisted. Cables are lowered to reach the first slab and securely attached to the slab at predetermined attachment locations. The slab is then hoisted to the upper most level and secured to the steel framing 400.

For preconstruction and excavation prior to building the structural frame 400, conventional methods of surveying, excavation and shoring may be utilized that are appropriate for the existing soil/ground conditions and preferred depth required for excavation. For example, deeper excavations may require shoring and possible below-grade waterproofing. Shoring may be constructed using concrete or wood, or other suitable material, depending on the best option for the area. Locating, trenching and extending the existing utilities to the new structure may utilize conventional methods of construction and may occur in conjunction with excavation and construction of the foundation.

For foundation construction, including basements if applicable, footings are first applied, spread and matted evenly. Any forming, reinforcing, and casting of footings and foundation walls may utilize conventional methods of concrete construction. For basements, formwork and reinforcing of below-grade walls may utilize conventional slip-form concrete construction. Slip-form construction refers to a method by which large towers or bridges are built from concrete by pouring concrete into a form and moving the hardened concrete. Typically, slip-form construction minimizes the materials used in formwork and labor, reduces the amount of concrete waste produced, and also allows for the foundation walls to be erected with the rapid speed. Unlike other concrete methods, slip-form construction does not produce over-shot concrete structures and requires very little cleanup or hauling away of waste concrete product. All site utilities may be extended to the building's service points while staged and protected for future connections. Similarly for elevator and stair foundation, excavation and forming of the foundation for the elevator and stair systems may be carried out in conjunction with the rest of the building's excavation and forming. Formwork may be properly placed, reinforcement added, and the foundation concrete may be placed and finished.

For concrete slab-on-grade construction, conventional construction practices may be utilized. A slab-on-grade may occur either at the basement level or at grade level if no basement is built. Utilities may be extended so that they are about 6 to 8 feet above the top of the slab either at the basement level or at grade level. Once this step is finished, the steps of placing the backfill, providing compaction, installing gravel, positioning vapor barrier, if required for local geotechnical review, and securing the slab reinforcement may be followed by placing and finishing the concrete slab. If a particular design incorporates below grade parking, the step of constructing a ramp may be implemented. Alternatively, the step of constructing a ramp may occur after the slab-on-grade is positioned into place. Typically, the ramp's formwork may be placed and followed by the step of securing and installing of the slab reinforcement. After these steps, the ramp's concrete slab may be placed and finished.

Assuming that only one level of parking is constructed below grade, the steps of positioning the shoring and forming the slab-on-grade level may be carried out after the basement slab and ramp are placed. Afterwards, the steps of securing slab reinforcement, any block-outs or sleeves required for the building's mechanical, plumbing, electrical, communications, site planter drainage, irrigation, parking control systems and electrical connections for security and lighting may be implemented. The steps of pouring, finishing and sealing concrete may then be implemented. If a commercial or retail level is being considered for the at grade level, then the concrete slab at the second story may be placed by conventional shoring and forming methods.

For constructing a plaza 110 for retail at the street level with an exterior courtyard, a residential terrace may be constructed at the level immediately above the retail level as shown in FIGS. 1, 3 and 4. Conventional methods, including cast-in-place concrete construction, may be used for all construction up to and including the terrace level slab. Cast-in-place concrete construction may be used for foundations, slabs-on-grade, structural support such as walls, beams, columns, floors, roofs, large portions of bridges, pavements, and other infrastructures by transporting concrete in its unhardened state to the site for placement in forms. The step of placing slab reinforcement, any block-outs or sleeves required for the building's mechanical, plumbing, and electrical and communications systems as well as any walkway drains, and electrical connections for security and lighting may be implemented. Once reinforcement and block-outs are placed, concrete may be poured, finished and sealed. Columns for the plaza at the street/retail level 110 may utilize cast-in-place concrete construction. The reinforcement for the columns is placed first. Thereafter, the column formwork is placed before pouring the concrete for forming the columns. These steps may be carried out prior to erecting any shoring for the terrace slab 205 as shown in FIG. 4. Shoring may then be placed to support any decking made of wood or other similar materials and other formwork for the terrace slab 205 at the second story level above the plaza/retail level 110. This step may be followed by the step of placing the slab reinforcement, any block-outs or sleeves required for the building's mechanical, plumbing, electrical and communications systems as well as for any courtyard drains, irrigation supply lines and electrical connections for security and lighting. Once the reinforcement and block-outs are placed, the terrace slab 205 of concrete may be poured, finished and sealed.

Figure 8:
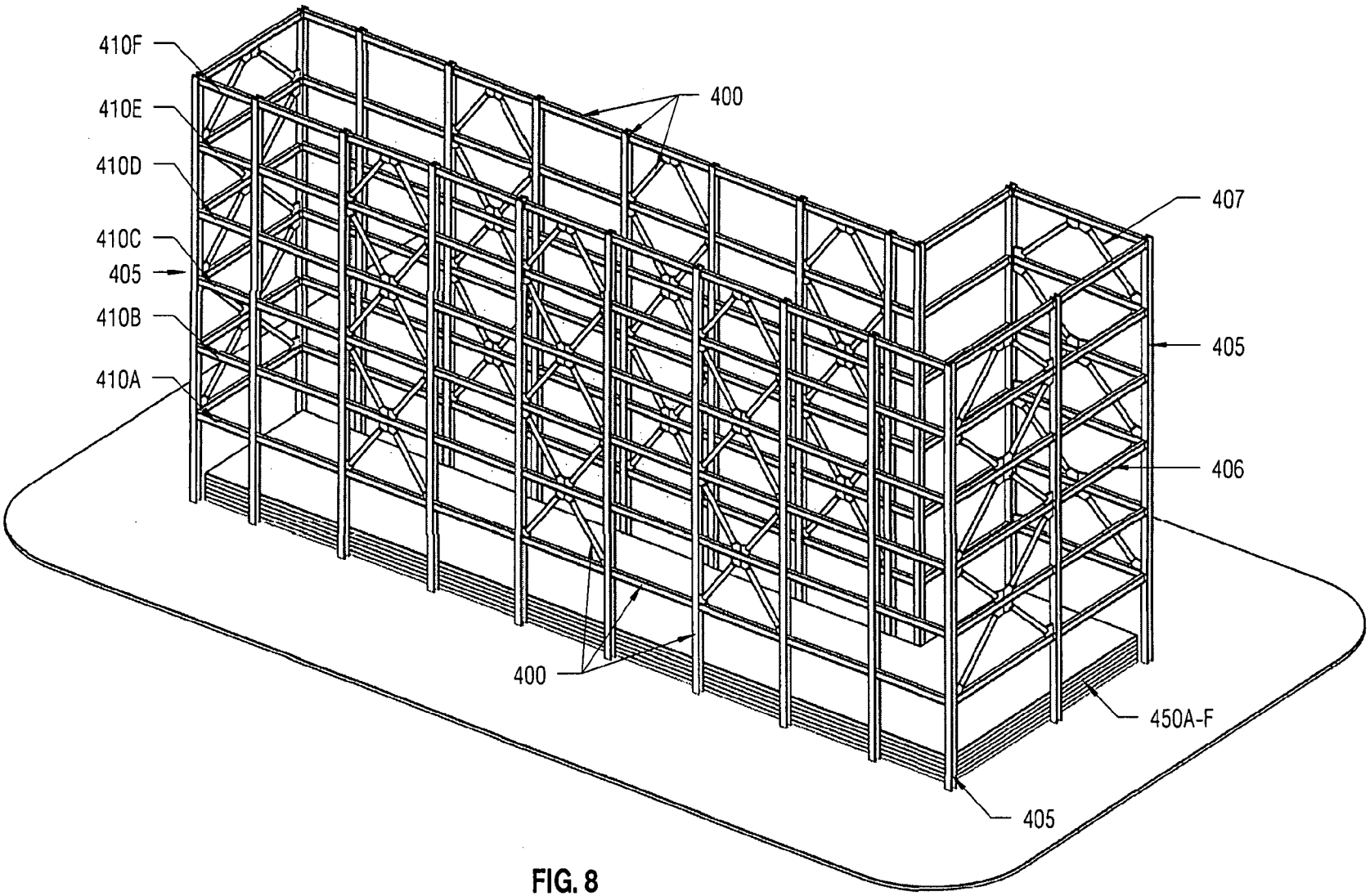
FIG. 8 illustrates the structural framing of the multi-story building of FIG. 1 for the floor and roof assembly before the floor slabs and roof slab are assembled into place.
Figure 9:
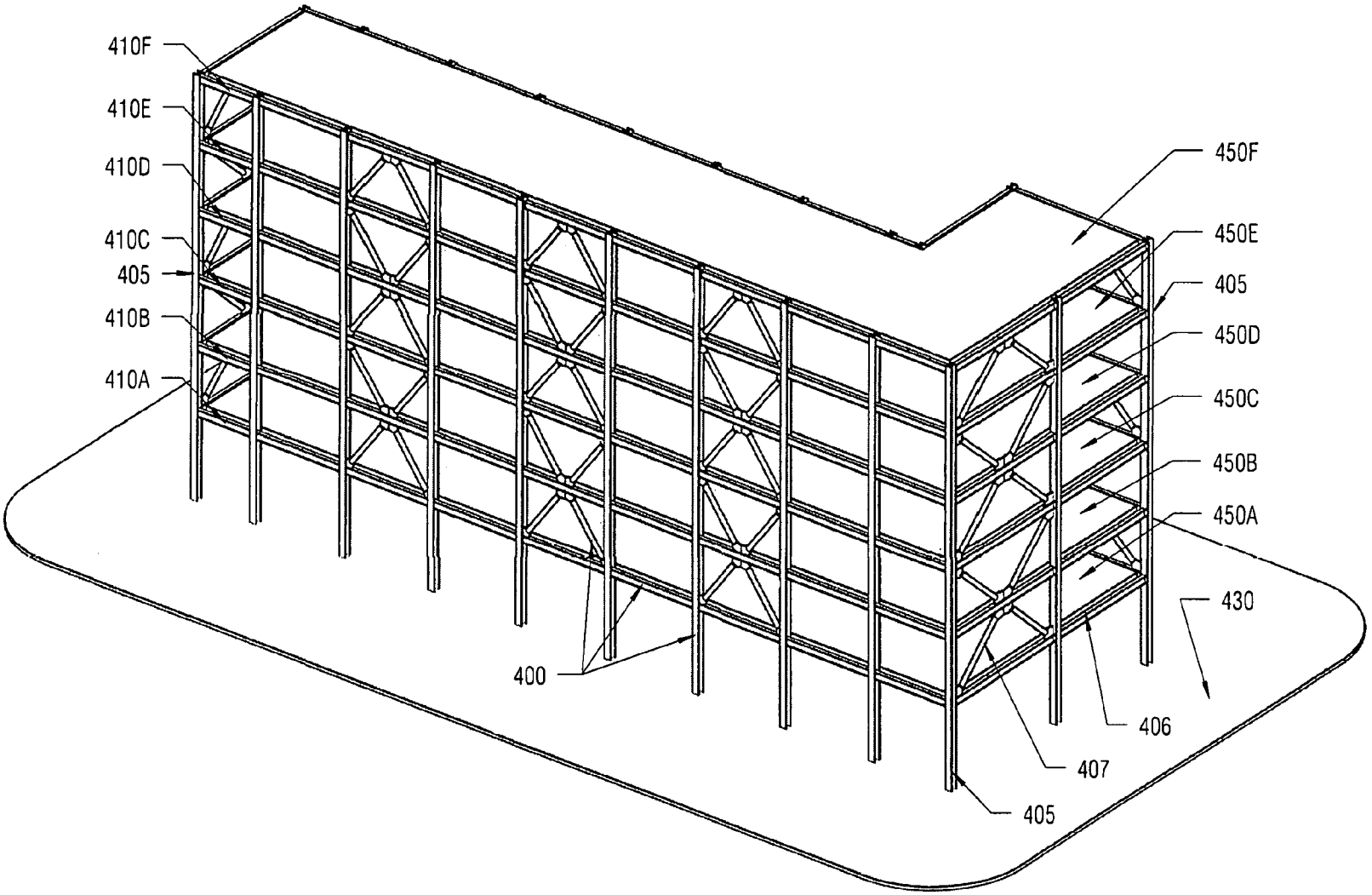
FIG. 9 illustrates the structural framing of the multi-story building of FIG. 1 for the floor and roof assembly after the floor slabs and roof slab are assembled into place.

FIGS. 8-9 illustrate the steps of forming the floor and roof slabs 450A-F and placing the floor slabs and roof slab 450A-F at each level by lifting up the slabs 450A-F and securing the slabs 450A-F at their appropriate elevation level. The floor slabs and roof slab 450A-F above the plaza/retail level 110 utilize a method of construction wherein slab formwork may be reused. Determining whether the slabs are poured one-on-top-of-the-other and hoisted to their appropriate elevation or the roof slab is placed first and then the formwork is lowered after the placement of each slab, depends on a general contractor's decision based on the local conditions and logistics of each site. The preferred method is pouring the slabs 450A-F one-on-top-of-the-other which are then hoisted to their appropriate elevation level. In the preferred method, a bond breaking solution is applied to the surface of the lower slab between each pour of the successive slab to ensure adequate separation between the slabs 450A-F.

As noted earlier, the forming and pouring of the floor slabs and roof slab 450A-F may occur prior to or after the building's structural frame 400 is erected. If using the plaza/retail level 110 slab as a base, the building's typical floor slabs and the roof slab 450A-F are poured one on-top-of the other, using the slab 450A below as the formwork for the slab 450B above. All of the slabs 450A-F will remain stacked on the plaza/retail level 110 surface until the slabs 450A-F have cured and reached the desired design strength. Upon curing, the slabs 450A-F are ready to be hoisted or lifted up to their finished elevation via a series of strand jacks strategically located atop the support columns and/or beams. The number of strand jacks used is dependent on the length and shape of the floor slabs to be hoisted. Upon the forming, pouring and curing of all of the slabs 450A-F, each of the floor slabs and roof slab 450A-F will then be loaded with a plurality of non-weight bearing walls, a plurality of exterior window walls, a plurality of interior components, and a plurality of exterior components, followed by lifting or hoisting up to the appropriate elevation level so that every slab 450A-F is securely positioned and attached at every building level so that non-weight bearing walls, exterior window walls, interior components, and exterior components may be installed at every level in-between floor slabs and roof slab 450A-F. Each hoisted floor slab contains numerous concrete embedded steel plates that will align with steel plates securely attached to the structural beams and/or columns 405, 406 as the slabs are hoisted into position. Upon reaching the appropriate position and the plates become aligned, a bolted or pinned connection may be used to securely attach the slabs 450A-F to the structural frame 400. The exterior walkways, exterior beams 410A-F and/or the use of man lifts may be used as a means of accessing the connections points, thereby eliminating any unnecessary hazards of having workers located under the unsecured slabs to access the connection points.

An alternate method may include installing exterior roof components on the cured top or roof slab 450F and lifting the top or roof slab 450F all the way to the top of the building via a series of strand jacks strategically located atop the support columns and/or beams. The number of strand jacks used is dependent on the length and shape of the floor slabs to be hoisted. Immediately after securing the top slab 450F, a plurality of non-weight bearing walls, exterior window walls, and some of the interior components, including the shower pan, kitchen and bathroom components are installed on a second slab 450E beneath the first slab 450F that is not yet lifted. Upon installation of the non-weight bearing walls and some of the interior components, and upon loading of the exterior window walls and rest of the interior components on the second slab 450E below, the second slab 450E with non-weight bearing walls, exterior window walls, and interior components, is lifted or hoisted up under the first slab at the top 450F and securely attached to the load bearing structural frame 400 to make the top floor or level. Each hoisted floor slab contains numerous concrete embedded steel plates that will align with steel plates securely attached to the structural beams and/or columns 405, 406 as the slabs are hoisted into position. Upon reaching the appropriate position and the plates become aligned, a bolted or pinned connection may be used to securely attach the slabs 450A-F to the structural frame 400. The exterior walkways, exterior beams 410A-F and/or the use of man lifts may be used as a means of accessing the connections points, thereby eliminating any unnecessary hazards of having workers located under the unsecured slabs to access the connection points.

The next sequence of steps involves installation of elevators and stairs. The pre-fabricated, pre-bundled stairs with preassembled sections is delivered to the site. Lower sections of the stairs are set and anchored into place simultaneously with the placement of the street level slab or at grade slab 430. Installation of the stairs will track closely with the installation of the building's structural frame 400. Installation of the structural framing for the elevator enclosure will track in conjunction with installation of the rest of the building's vertical columns 405.

Upon securely attaching the second slab 450E to the load bearing structural columns and beams 405, 410E, the loaded exterior window walls and the rest of the interior components including the entry doors and interior partitions are installed to the second slab 450E to complete the building's top level. Non-weight bearing walls, the exterior window walls, kitchen and bathroom components are next installed on a third floor slab 450D beneath second slab 450E. Similar to the previously described process for constructing the top level, the exterior window walls and the rest of the interior components are loaded on the third slab 450D below, and the third slab 450D with the non-weight bearing walls and the interior components, whether installed or loaded, is lifted up or hoisted under the second slab 450E and securely attached to the load-bearing structural columns and beams 405, 410E to make a level beneath the top level. This process of loading and installing the non-weight bearing walls, the exterior windows, and the interior components is repeated until all the building levels are completed.

Upon suspending the slabs 450A-F at their appropriate elevation levels, each slab 450A-F is bolted or pinned to the vertical columns 405 and horizontal beams 410A-F which make up the load bearing steel framing 400. For example, the roof slab 450F is securely attached to the vertical columns 405 and the top horizontal beam 410F. The top floor slab 450E is securely attached to the vertical column 405 and the fifth horizontal beam 410E. The fourth floor slab 450D is securely attached to the vertical columns 405 at the fourth horizontal beam 410D. The third floor slab 450C is securely attached to the vertical columns 405 at the third support beam 410C. The second floor slab 450B is securely attached to the vertical columns 405 at the second support beam 410B. The first floor slab 450A is securely attached to the vertical columns 405 at the first support beam 410A. The present invention limits or eliminates the time consuming and costly process of field welding, however the use of field welding is not prohibited in the present invention.

Conventional steel reinforcing bars and post tensioned cables may be used in the slabs 450A-F. The span of the slab 450A-F is set at a distance that can be supported within the depth and width of the slab 450A-F. Upon placing the slabs 450A-F at appropriate elevation levels, they will fully support their spans without the use of supplemental beams or columns. Electric radiant heat coils may be incorporated into the concrete floor slabs 450A-F to heat each unit. The structural floor slabs 450A-F may act as the finished floor slab for the unit above or the finished ceiling for the unit below. Acoustical and impact isolation at the slab 450A-F is required and may either be accomplished by coverage on the floor and/or by including optional pre-fabricated ceiling panels which may also include acoustical paneling.

Figure 10A:
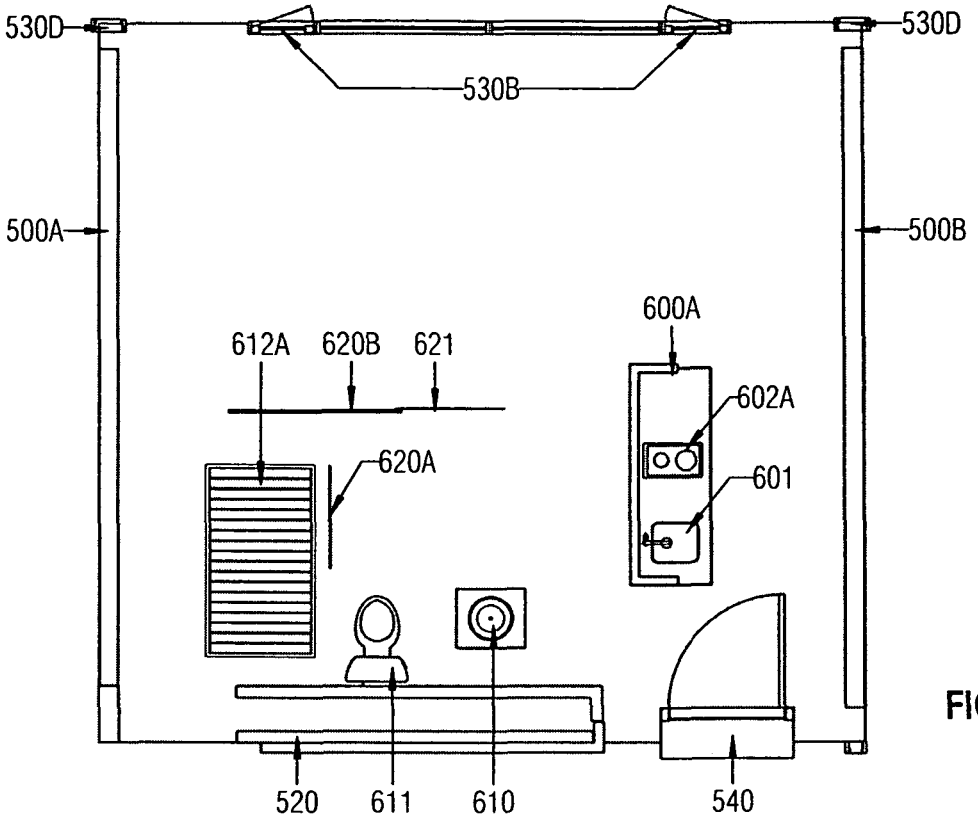
FIGS. 10A-B illustrate a components plan of an exemplary efficiency studio unit for various walls and components before and after assembly.
Figure 10B:
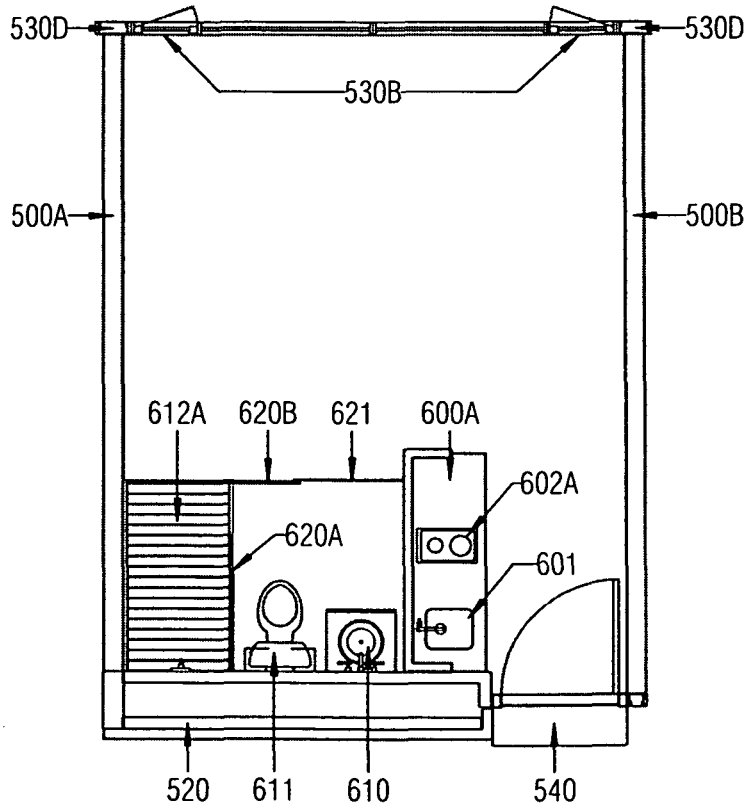

FIGS. 10A-B illustrate a components plan of an exemplary efficiency studio unit 300A from FIG. 6A for various walls and components before and after assembly. As shown in FIGS. 10A-B of the exemplary efficiency studio unit 300A, the efficiency studio unit 300A is enclosed by the exterior window walls 530B, exterior window wall panels 530D, demising walls 500A-B, and utility wall 520. The efficiency studio unit 300A further includes interior components kitchen unit 600A, bathroom vanity 610, toilet 611, shower pan 612A and shower partitions 620A-B. The exterior window wall panels 530D are part of the exterior window wall system and positioned in-between the exterior window walls of each unit. On the opposing side of the exterior window walls 530D in a parallel direction, the utility wall 520 is installed for connecting the bathroom and kitchen components. The entry door 540 is positioned between the utility walls 520 and demising wall 500B for easy entry into the efficiency studio unit 300A.

Each of the demising walls 500A-B are positioned directly opposite of each other in a parallel direction to enclose the studio unit 300A. The shower 612A (later shown in FIGS. 33A-B) is partitioned off by the first and second shower partitions 620A-B. The bathroom is partitioned off by the sliding bathroom door 621 attached to the second shower partition 620B and kitchen unit 600A. The kitchen unit 600A is installed in a perpendicular direction against the utility wall 520 and has a kitchen sink 601, cooktop 602A, and cabinets (not shown in FIG. 10). Other internal furniture such as a bed, desks, chairs, dresser, coffee table, and couches may be placed anywhere.

Figure 11A:
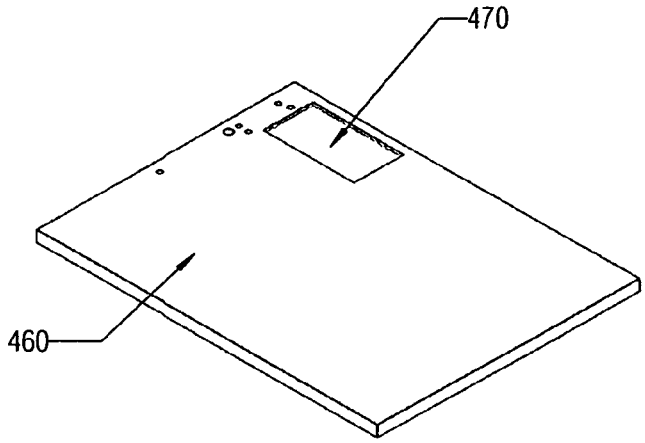
FIGS. 11A-F illustrate a perspective view of different phases of assembling an exemplary efficiency studio unit.
Figure 11B:
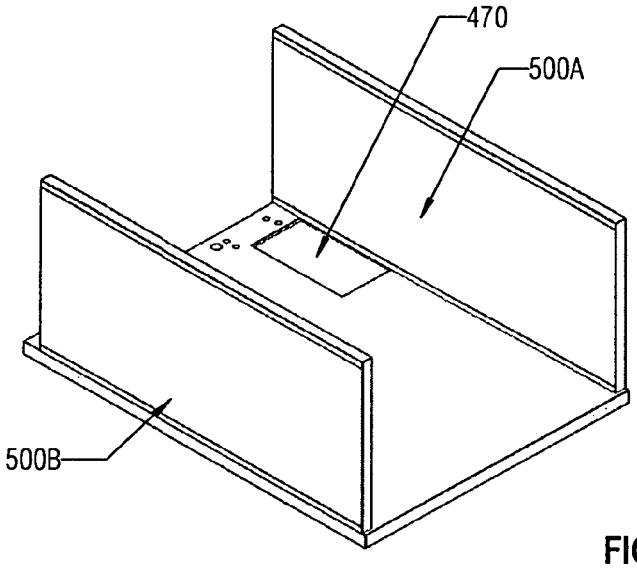

FIGS. 11A-F illustrate a perspective view of different phases of assembling an exemplary efficiency studio unit and its interior components. FIG. 11A illustrates an exemplary efficiency studio unit floor 460 of the slab with a recess 470 for a possible recessed shower pan. After the slabs 460 are in place, the demising walls 500A-B are delivered to the site. Each of the demising walls 500A-B can be installed in place in the studio unit. In this particular embodiment, the demising walls 500A-B are single components. However, depending on the overall plan, the dimensions of the demising walls 500A-B are easily changeable and not limited to these dimensions. The demising walls 500A-B shown in FIG. 11B are delivered to the site as preassembled, prewired and prefinished components. The demising walls 500A-B and all other components can either be installed after the slabs are hoisted or installed in their final position prior to the slabs 460 being lifted.

Figure 11C:
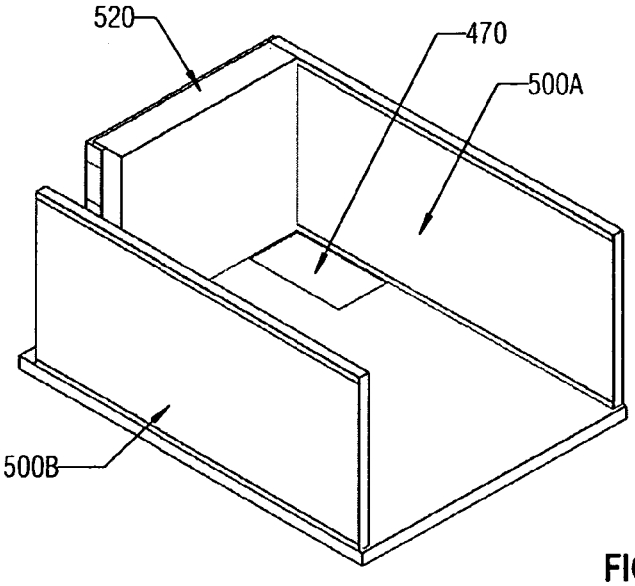
Figure 11D:
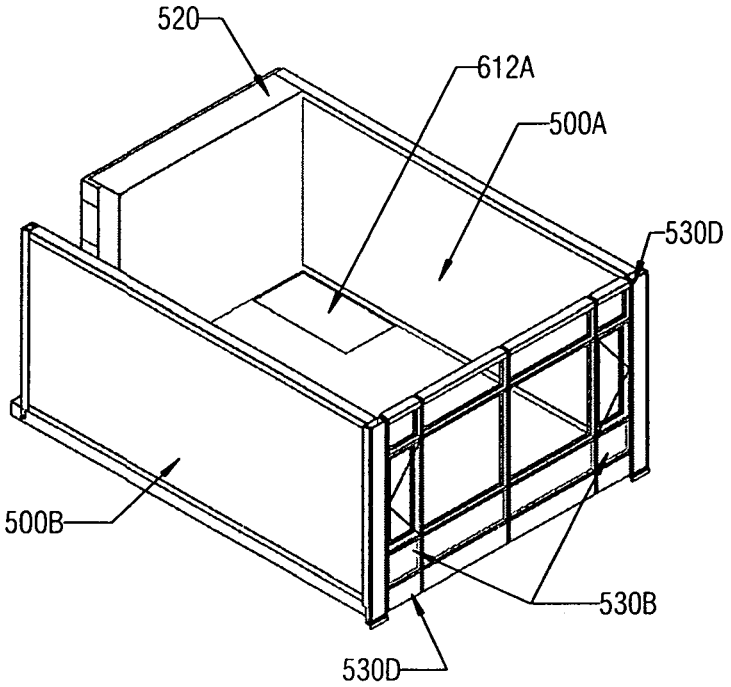
Figure 11E:
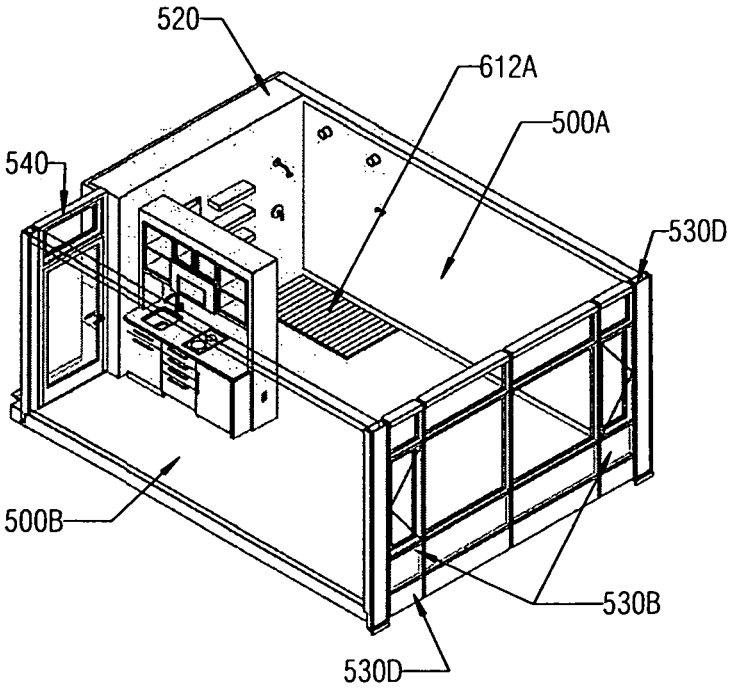
Figure 11F:
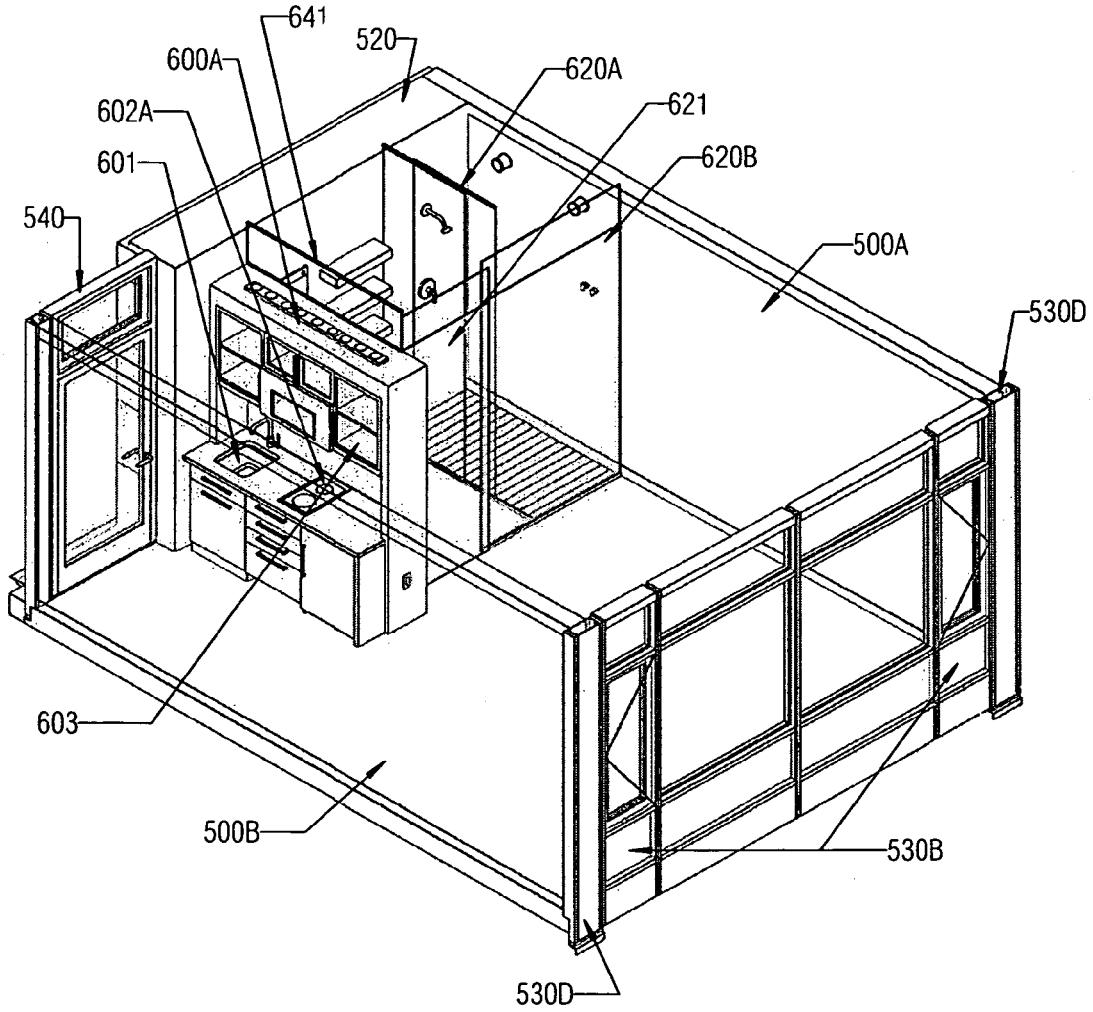

As shown in FIG. 11C, a utility wall 520 is installed so that a bathroom vanity 610 (not shown) and toilet 611 (not shown) can be installed against the utility wall 520. As shown in FIG. 11D, window walls 530B, 530D are installed to further enclose the studio unit. In the next step as shown in FIG. 11E, the entry door 540 may be installed either after or before installation of the bathroom and kitchen components. The shower pan 612A is fitted into the slab recess 470, if a recess is provided, before installing the bathroom and kitchen components. As shown in FIG. 11F, immediately adjacent to the bathroom is a kitchen unit 600A with a kitchen sink 601 and a countertop, cooktop 602A, and cabinets 603. The shower partition 620A-B separates the shower and bathroom from the living space area with a sliding door 621. An upper glass partition 641 is installed above the kitchen unit 600A to further separate the bathroom from the kitchen area. The details of attachment of the demising walls 500A-B, window walls 530B, 530D, utility wall 520, entry door 540, and interior components of the exemplary efficiency studio unit to the slab 460 are described further in detail in FIGS. 19-37.

Figure 12A:
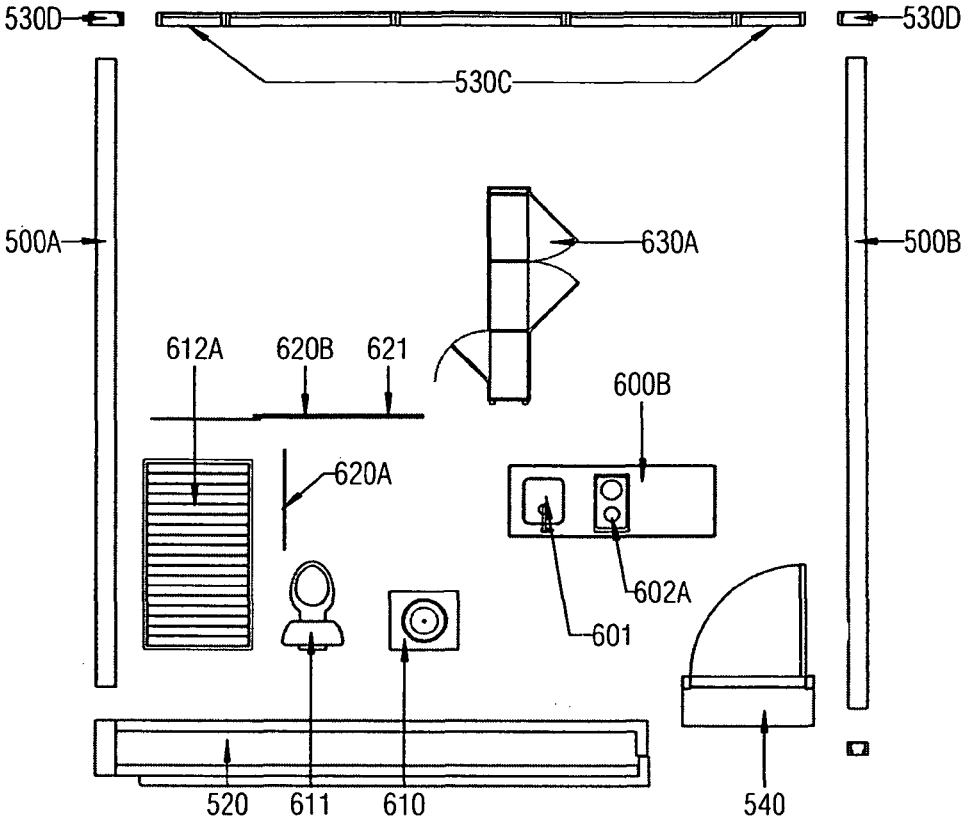
FIGS. 12A-B illustrate a components plan of an exemplary standard studio unit for various walls and components before and after assembly.
Figure 12B:
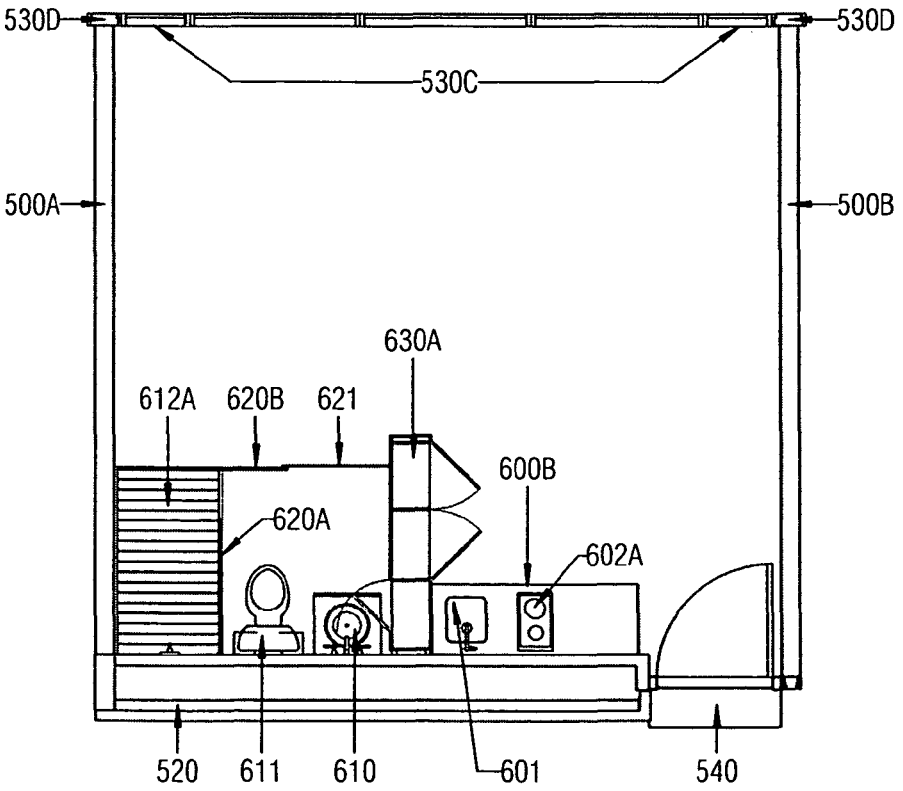

FIGS. 12A-B illustrate a components plan of an exemplary standard studio unit 300B from FIG. 6A for various walls and components before and after assembly. As shown in FIGS. 12A-B of the exemplary standard studio unit 300B, the standard studio unit 300B is enclosed by the exterior window walls 530C, exterior window wall panels 530D, demising walls 500A-B, and utility wall 520. The standard studio unit 300B further includes interior components kitchen unit 600B, bathroom vanity 610, toilet 611, shower pan 612A and shower partitions 620A-B. The exterior window wall panels 530D are part of the exterior window wall system and positioned in-between the exterior window walls of each unit. On the opposing side of the exterior window walls 530C in a parallel direction, the utility wall 520 is installed for connecting the bathroom and kitchen components. The entry door 540 is positioned between the utility wall 520 and demising wall 500B for easy entry into the efficiency studio unit 300B.

Each of the demising walls 500A-B are positioned directly opposite of each other in a parallel direction to enclose the studio unit 300B. The shower 612A (later shown in FIGS. 33A-B) is partitioned off by the first and second shower partitions 620A-B. The bathroom is partitioned off by the sliding bathroom door 621 attached to the second shower partition 620B and the storage cabinet 630A. The kitchen unit 600B is installed against the utility wall 520 that has a kitchen sink 601, cooktop 602A, and cabinets (not shown in FIG. 12). Other internal furniture such as a bed, desks, chairs, dresser, coffee table, and couches may be placed anywhere.

Figure 13A:
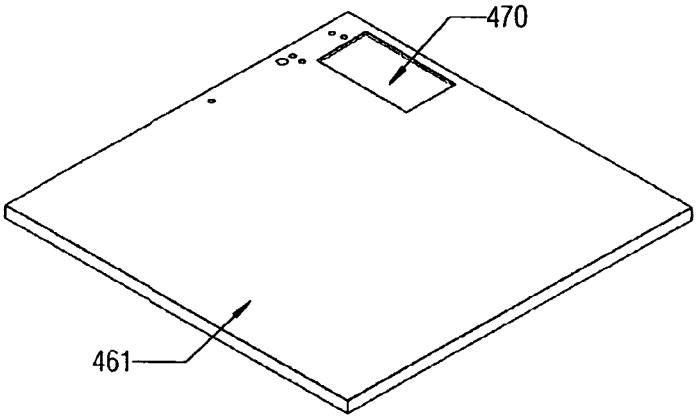
FIGS. 13A-F illustrate a perspective view of different phases of assembling an exemplary standard studio unit.
Figure 13B:
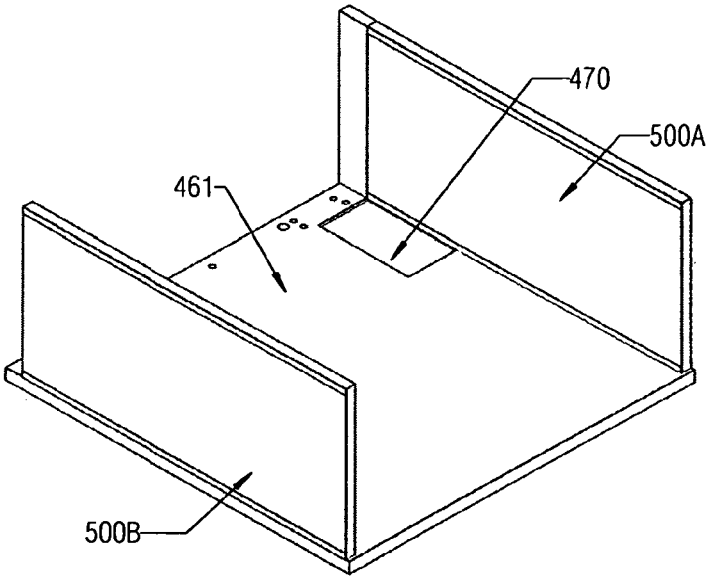

FIGS. 13A-F illustrate a perspective view of different phases of assembling an exemplary standard studio unit and its interior components. FIG. 13A illustrates an exemplary standard studio unit floor 461 of the slab with a recess 470 for a possible recessed shower pan. After the slabs 461 are in place, the demising walls 500A-B are delivered to the site. Each of the demising walls 500A-B can be installed in place in the studio unit. In this particular embodiment, the demising walls 500A-B are single components. However, depending on the overall plan, the dimensions of the demising walls 500A-B are easily changeable and not limited to these dimensions. As shown in FIG. 13B, the demising walls 500A-B are delivered to the site as a preassembled, pre-wired and prefinished components. The demising walls 500A-B and all other components can either be installed after the slabs are hoisted or installed in their final position prior to the slabs 461 being lifted.

Figure 13C:
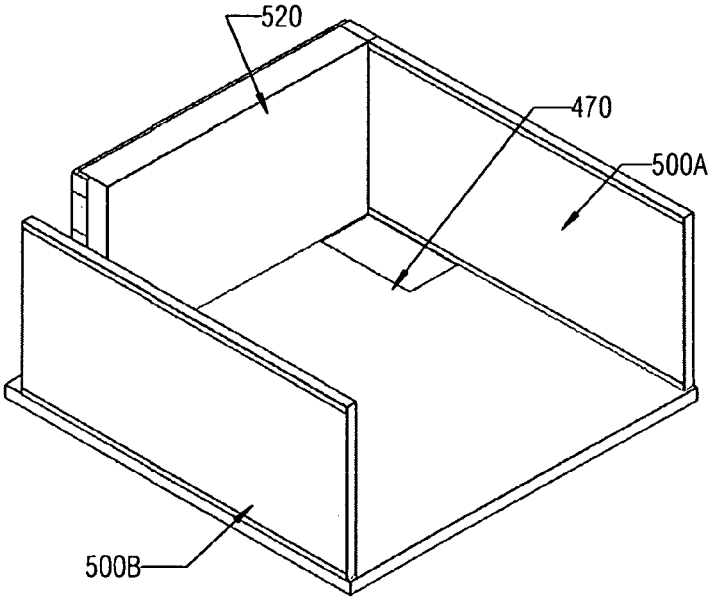
Figure 13D:
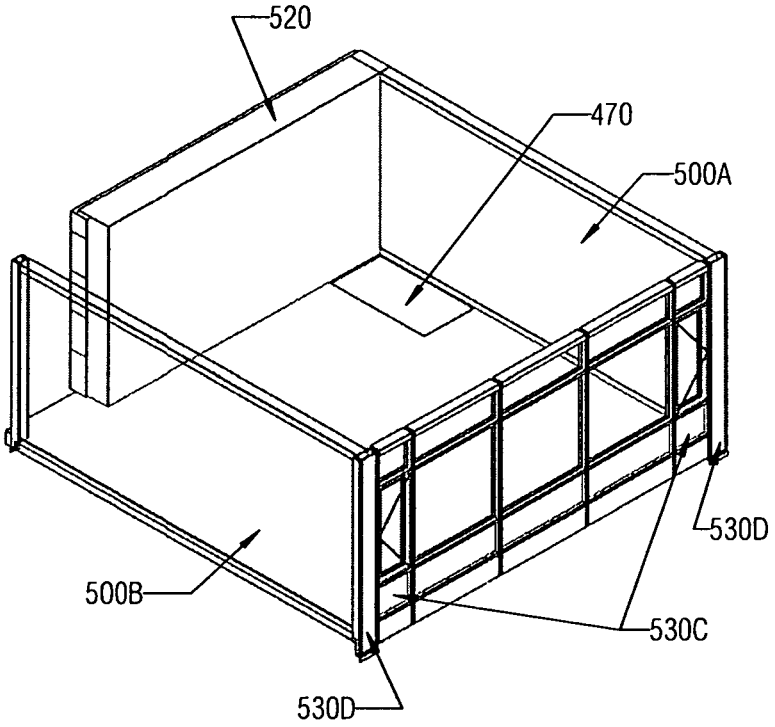
Figure 13E:
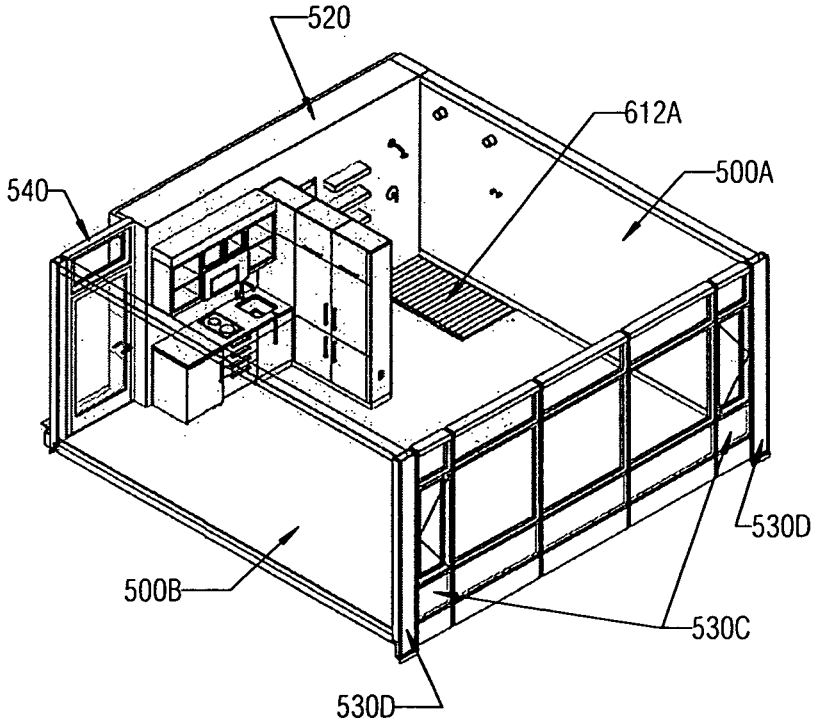
Figure 13F:
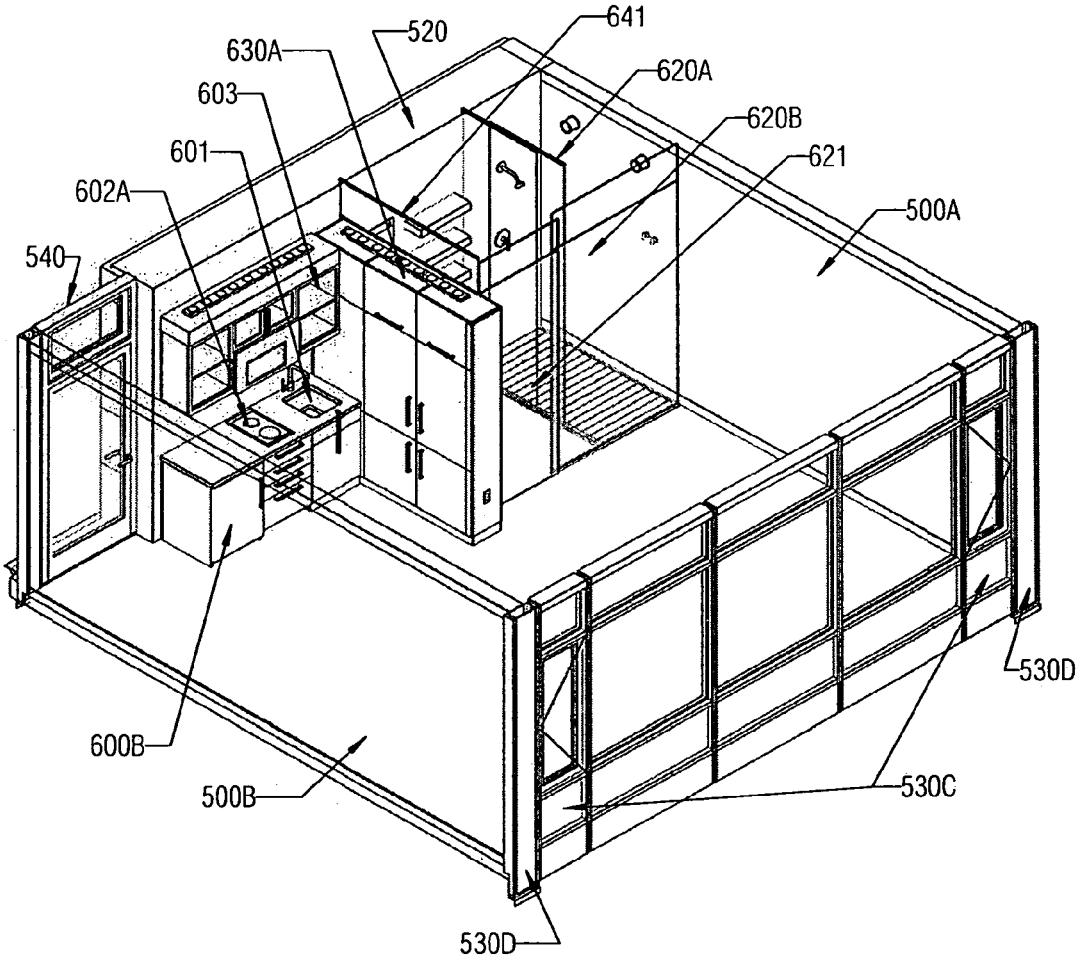

As shown in FIG. 13C, a utility wall 520 is installed so that a bathroom vanity 610 (not shown) and toilet 611 (not shown) can be installed against the utility wall 520. As shown in FIG. 13D, window walls 530C, 530D are installed to further enclose the studio unit. In the next step as shown in FIG. 13E, the entry door 540 may be installed either after or before installation of the bathroom and kitchen components. The shower pan 612A is fitted into the slab recess 470, if a recess is provided, before installing the bathroom and kitchen components. As shown in FIG. 13F, immediately adjacent to the bathroom is a kitchen unit 600B with a kitchen sink 601 and a countertop, cooktop 602A, and cabinets 603. The shower partition 620A-B separates the shower and bathroom from the living space area with a sliding door 621. An upper glass partition 641 is installed above the storage cabinet 630A to further separate the bathroom from the kitchen area. The details of attachment of the demising walls 500A-B, window walls 530C, 530D, utility wall 520, entry door 540, and interior components of the exemplary standard studio unit to the slab 461 are described further in detail in FIGS. 19-37.

Figure 14A:
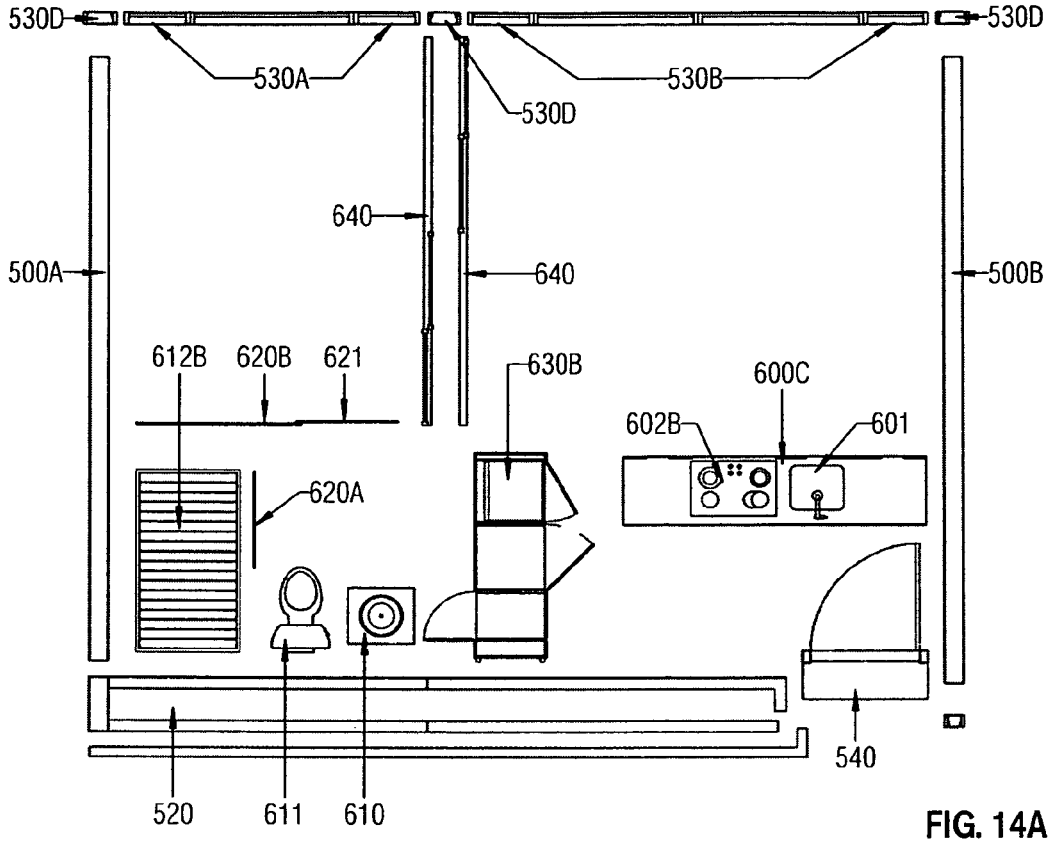
FIGS. 14A-B illustrate a components plan of an exemplary one bedroom unit for various walls and components before and after assembly.
Figure 14B:
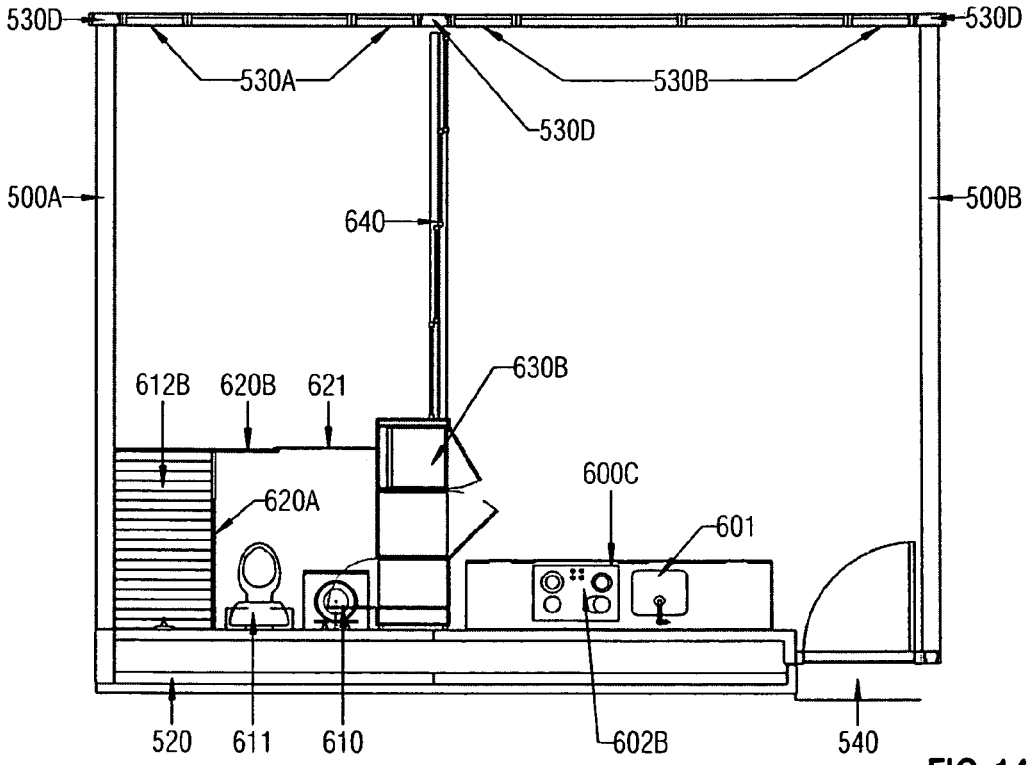

FIGS. 14A-B illustrate a components plan of an exemplary one bedroom unit 300C from FIG. 6A for various walls and components before and after assembly. As shown in FIGS. 14A-B of the exemplary one bedroom unit 300C, the one bedroom unit 300C is enclosed by the exterior window walls 530A-B, exterior window wall panels 530D, demising walls 500A-B, and utility wall 520. The one bedroom unit 300C further includes interior components kitchen unit 600C, bathroom vanity 610, toilet 611, shower pan 612B, shower partitions 620A-B, and a sliding bedroom glass partition 640 that separates the bedroom from the living room. The exterior window wall panels 530D are part of the exterior window wall system and positioned in-between the exterior window walls of each unit or room. On the opposing side of the exterior window walls 530A-B in a parallel direction, the utility wall 520 is installed for connecting the bathroom and kitchen components. The entry door 540 is positioned between the utility wall 520 and demising wall 500B for easy entry into the one bedroom unit 300C.

Each of the demising walls 500A-B are positioned directly opposite of each other in a parallel direction to enclose the one bedroom unit 300C. The shower 612B (later shown in FIGS. 33A-B) is partitioned off by the first and second shower partitions 620A-B. The bathroom is partitioned off by the sliding bathroom door 621 attached to the second shower partition 620B and the storage cabinet 630B. The kitchen unit 600C is installed against the utility wall 520 that has a kitchen sink 601, cooktop 602B, and cabinets (not shown in FIG. 14). Other internal furniture such as a bed, desks, chairs, dresser, coffee table, and couches may be placed anywhere.

Figure 15A:
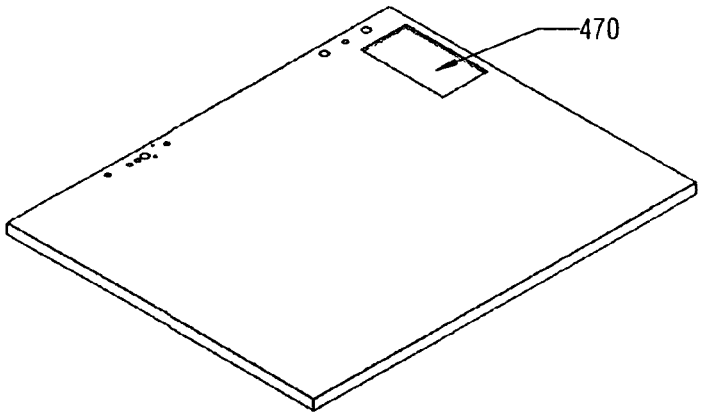
FIGS. 15A-F illustrate a perspective view of different phases of assembling an exemplary one bedroom unit.
Figure 15B:
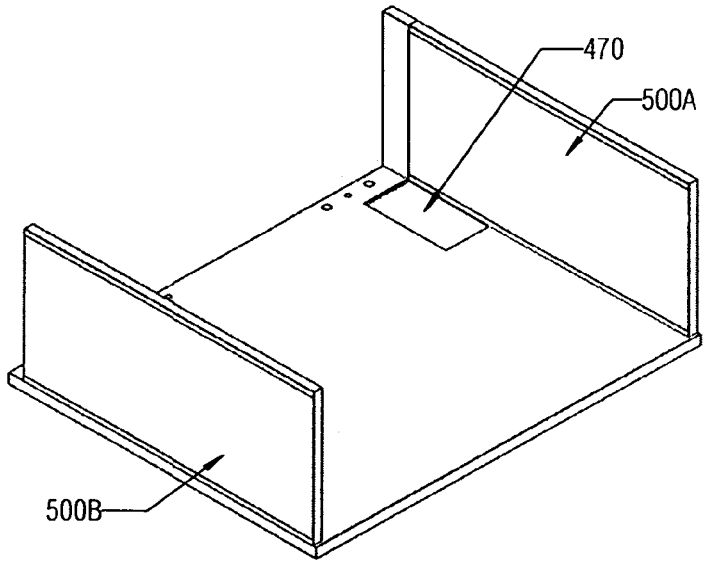
Figure 15C:
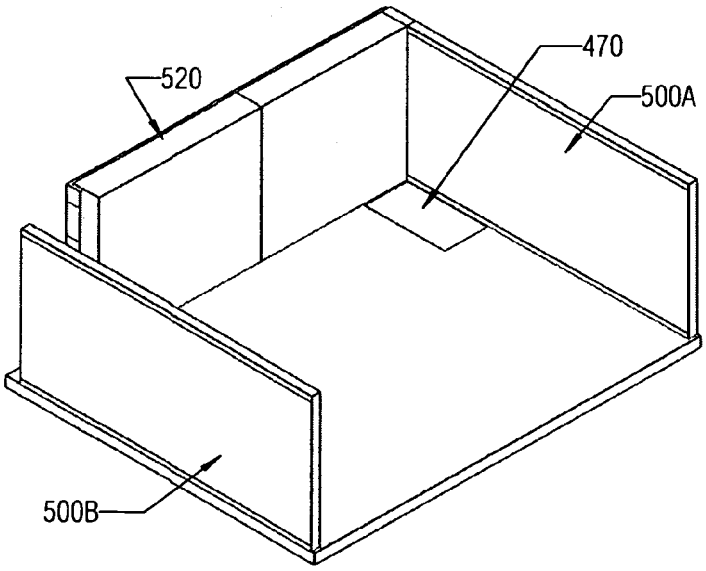
Figure 15D:
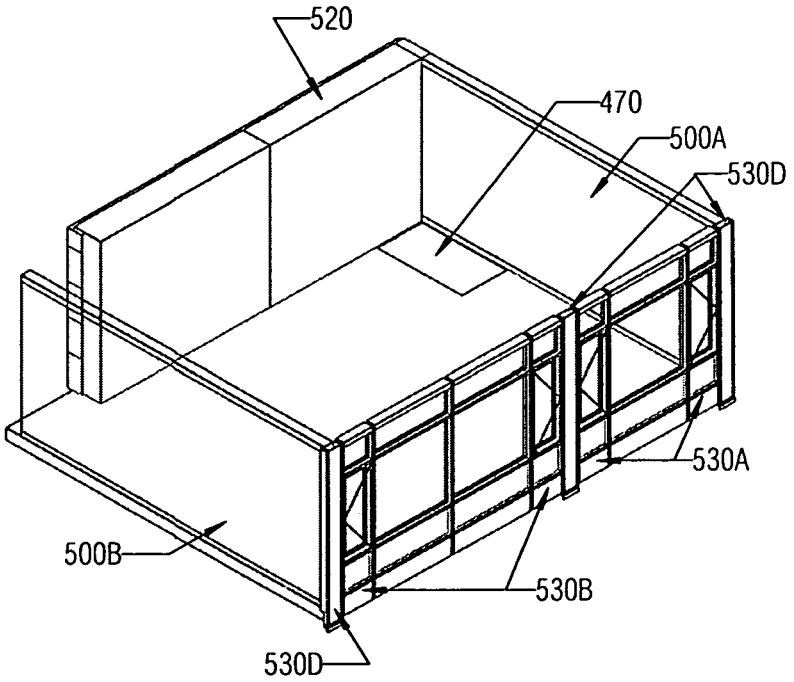
Figure 15E:
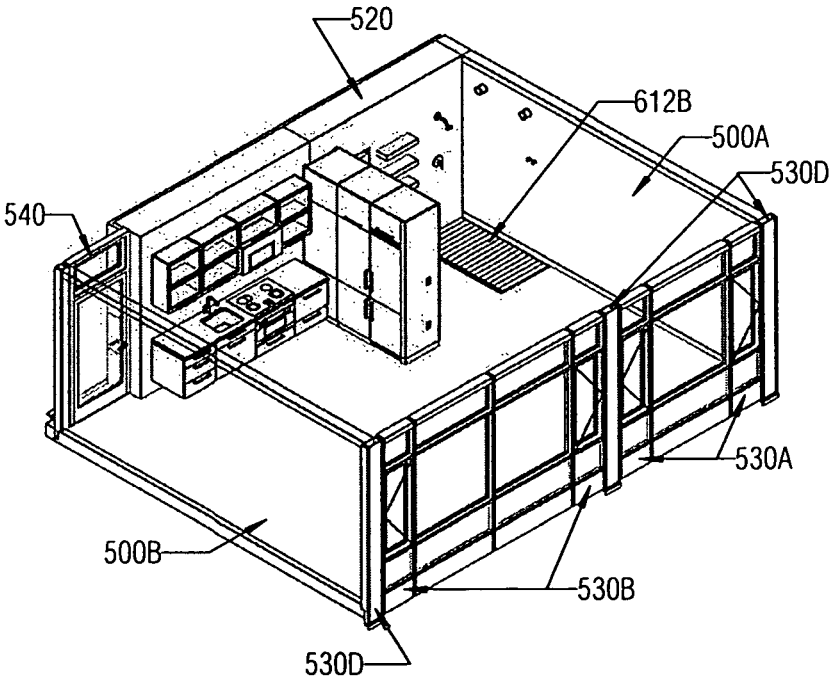
Figure 15F:
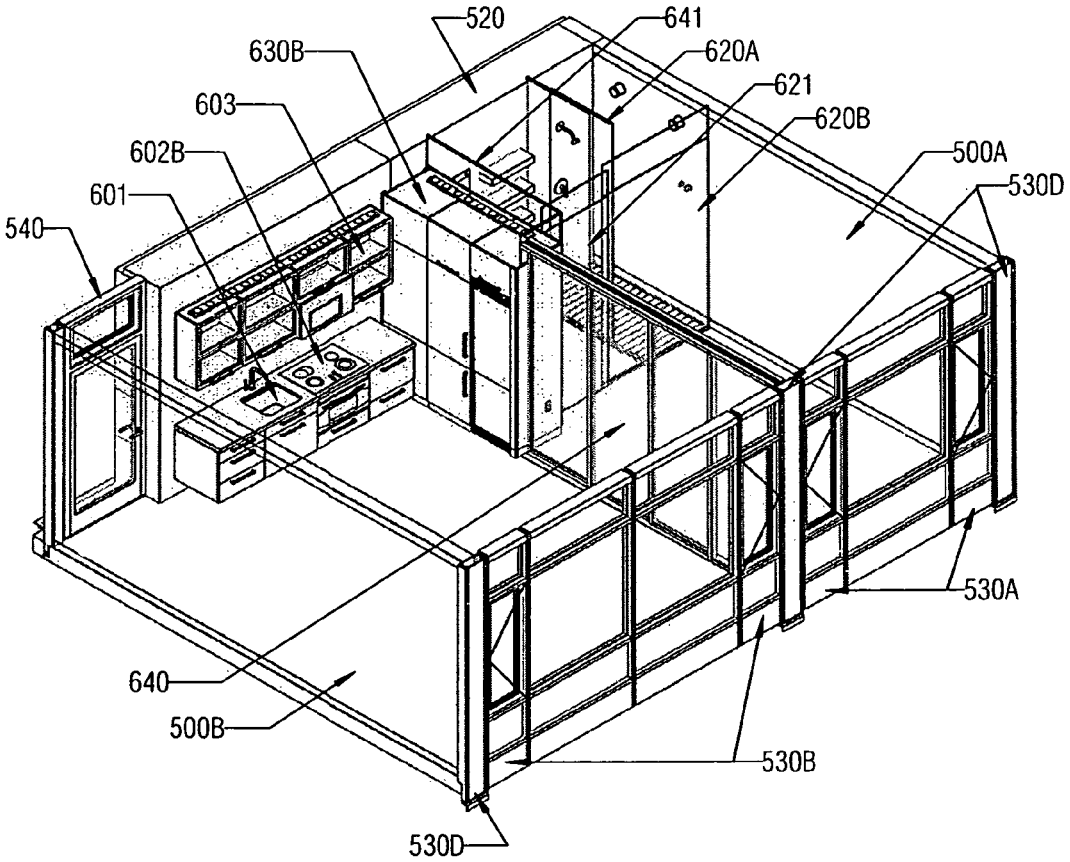

FIGS. 15A-F illustrate a perspective view of different phases of assembling an exemplary one bedroom unit and its interior components. Similar to assembling the standard studio unit as shown in FIGS. 13A-F, the demising walls 500A-B are delivered to the site as preassembled, pre-wired and prefinished components and installed prior to installation of the exterior window walls 530A-B. The utility wall 520 is similarly installed next to continue to enclose the one bedroom unit. All the internal bathroom and kitchen components are similarly installed as described in FIGS. 13A-F. The window walls 530A-B are then tilted into place to partially enclose the one bedroom unit 300C. As illustrated in FIG. 15F, the bedroom is separated from the living area by a sliding bedroom glass partition 640 which terminates at a storage cabinet 630B and window wall panel 530D. The bathroom has a sliding bathroom door 621 that is attached to the shower partition 620B that also separates the bathroom. An upper glass partition 641 is installed above the storage cabinet 630B to further separate the bathroom from the kitchen area. The details of attachment of the demising walls 500A-B, window walls 530A-B, 530D, utility wall 520, entry door 540, and interior components of the exemplary one bedroom unit to the slab are described further in detail in FIGS. 19-37. On the side of the utility wall 520, an entry door 540 is installed to fully enclose the one bedroom unit.

Figure 16A:
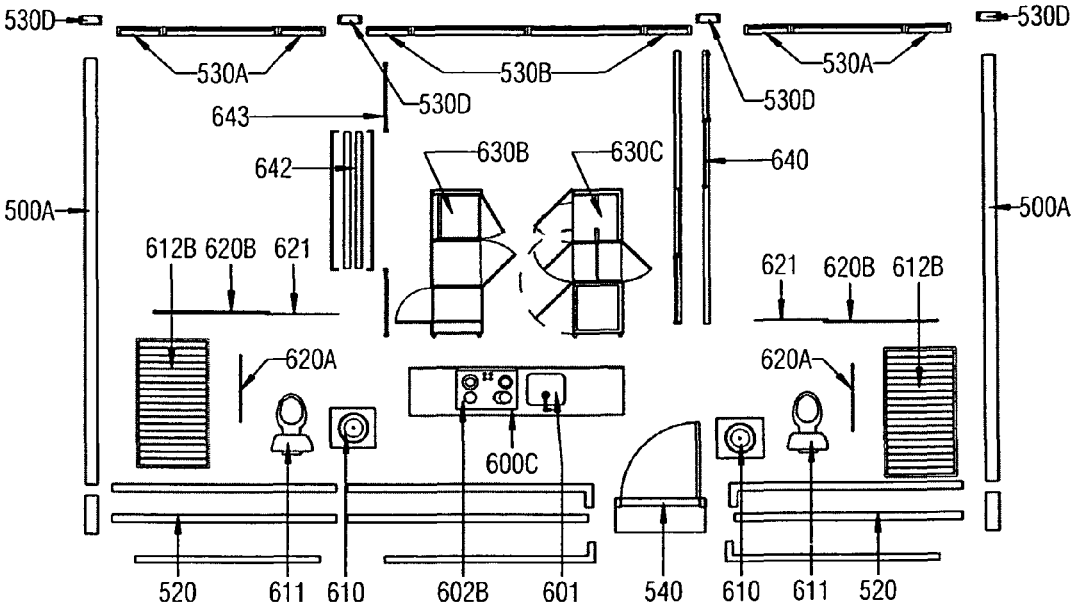
FIGS. 16A-B illustrate a components plan of an exemplary two bedroom unit for various walls and components before and after assembly.
Figure 16B:
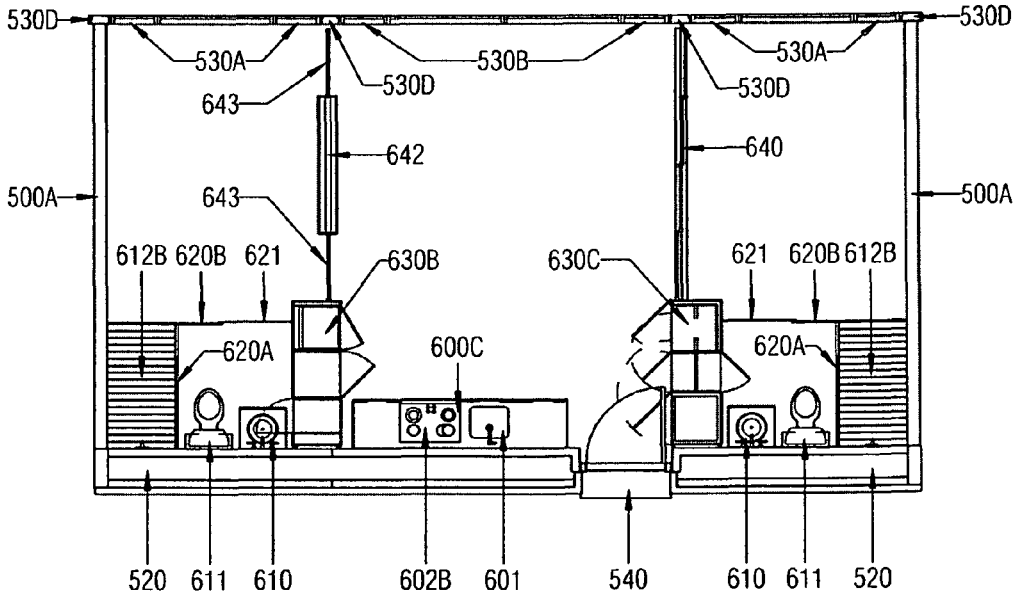
Figure 17A:
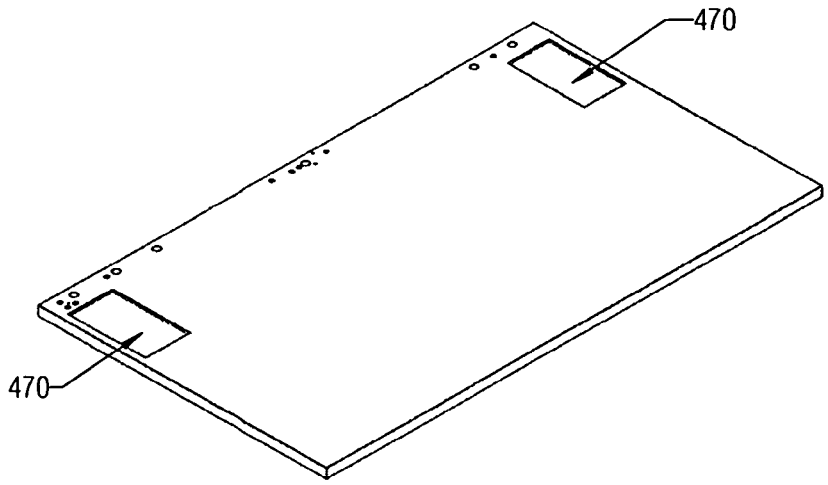
FIGS. 17A-F illustrate a perspective view of different phases of assembling an exemplary two bedroom unit.
Figure 17B:
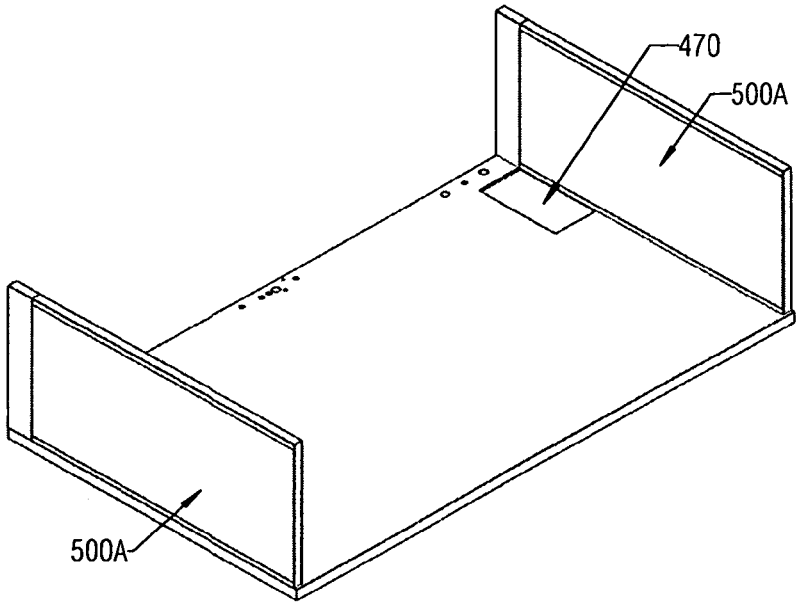
Figure 17C:
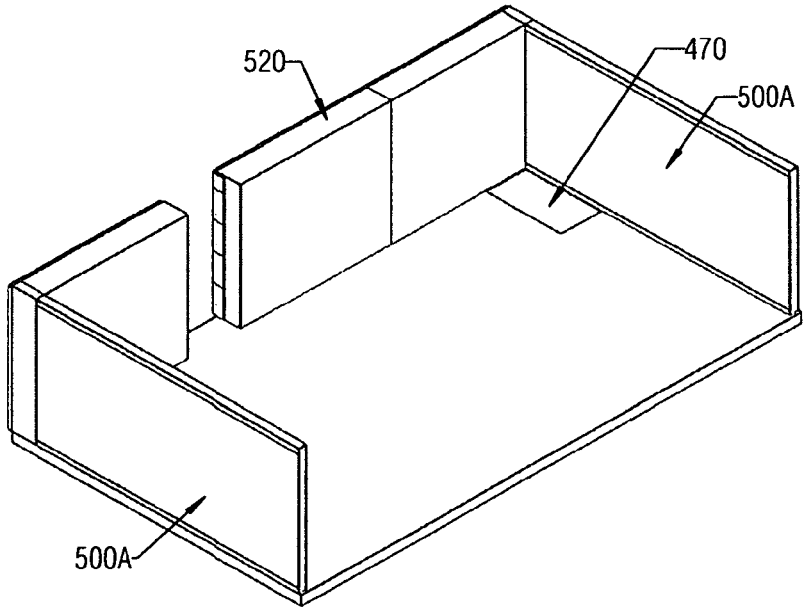
Figure 17D:
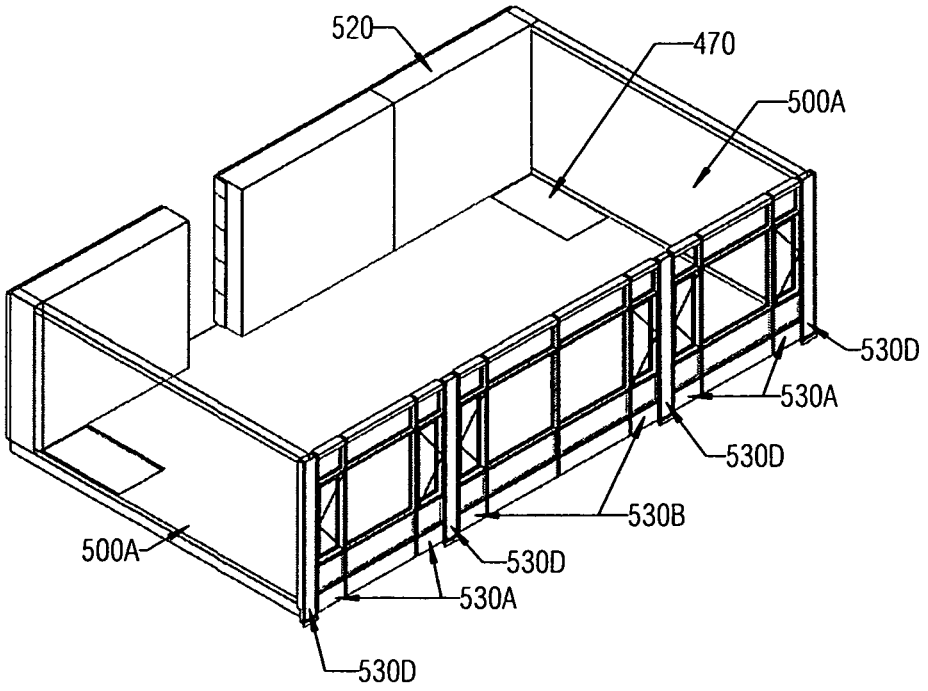
Figure 17E:
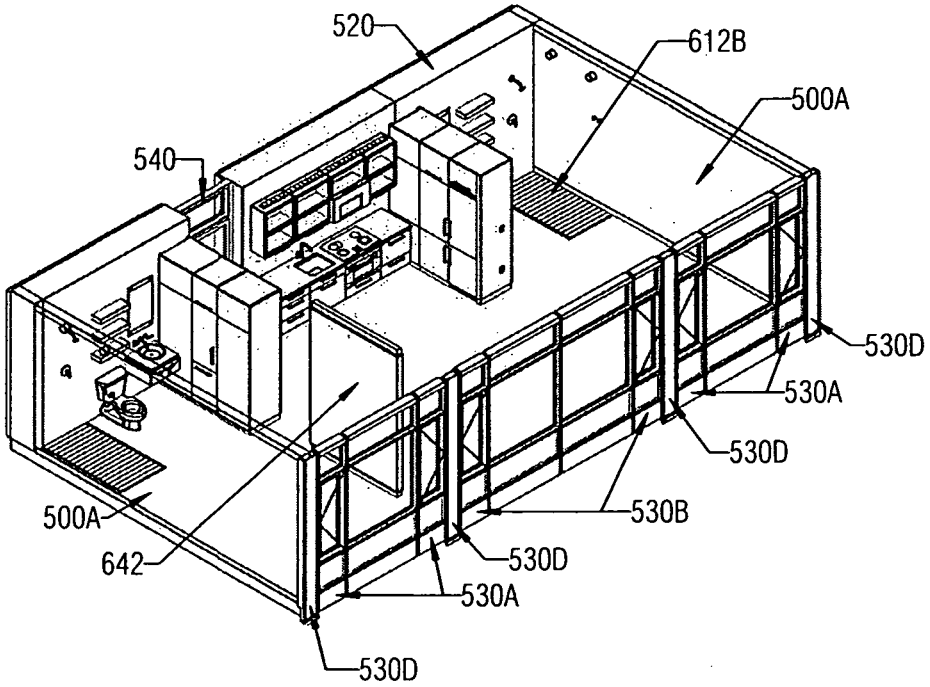
Figure 17F:
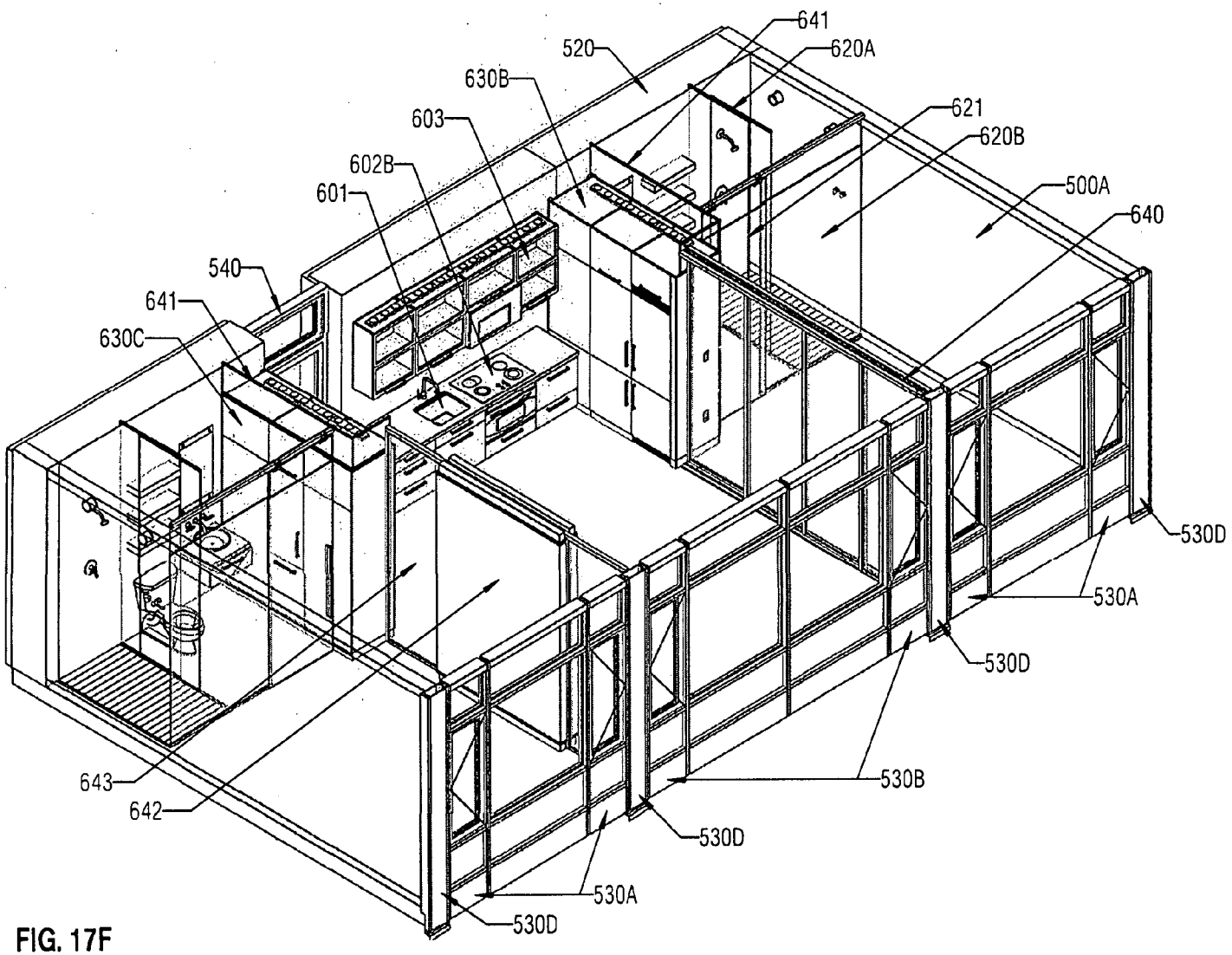
Figure 18B:
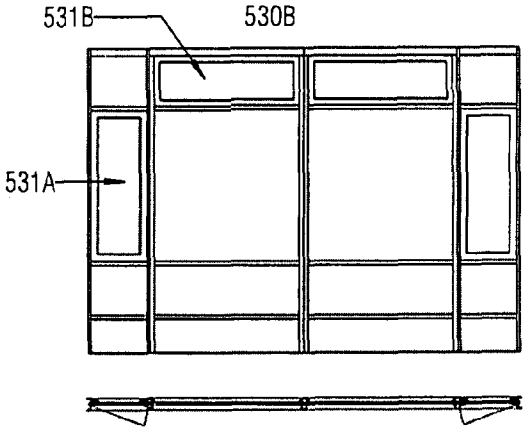
FIGS. 18A-D illustrate side and top views of the exterior window wall assemblies for various units.
Figure 18D:
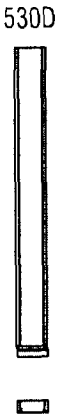
Figure 18A:
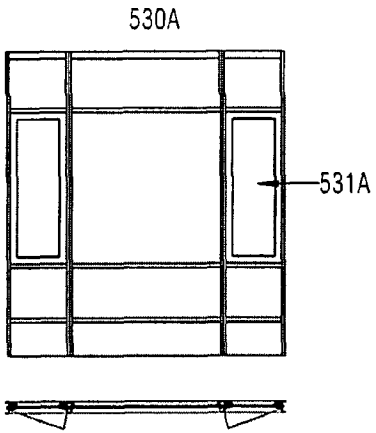
Figure 18C:
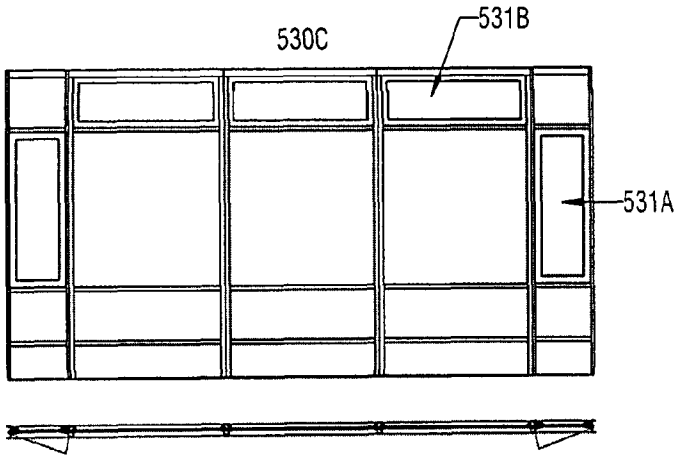

FIGS. 16A-B illustrate a components plan of an exemplary two bedroom unit 300F from FIG. 6B for various walls and components before and after assembly. As shown in FIGS. 16A-B of the exemplary two bedroom unit 300F, the two bedroom unit 300F is enclosed by the exterior window walls 530A-B, exterior window wall panels 530D, demising walls 500A, and utility walls 520. The two bedroom unit 300F further includes interior components kitchen unit 600C with sink 601 and a countertop, cooktop 602B, bathroom vanity 610, toilet 611, shower pan 612B shower partitions 620A-B, sliding bedroom glass partition 640 that separates the first bedroom from the living room. Furthermore, two bedroom unit 300F includes entertainment wall 642 and glass pocket doors 643 that separates the second bedroom from the living room, and storage cabinets 630B-C. The exterior window wall panels 530D are part of the exterior window wall system and positioned in-between the exterior window walls 530A-B. On the opposing side of the exterior window walls 530A-B in a parallel direction, the utility walls 520 are installed for connecting the bathroom and kitchen components. The entry door 540 is positioned between the utility walls 520 for easy entry into the two bedroom unit 300F.

Alternatively, the exemplary two bedroom unit can be configured in a number of various ways. Any of the layouts are flexible and walls as well as components can be changed around. For example, the entry door 540 can be positioned adjacent to storage cabinet 630B and kitchen unit 600C moved adjacent to storage cabinet 630C; storage cabinets 630B-C can be interchanged; sliding bedroom door 640 and entertainment wall 642 are completely interchangeable with each other.

FIGS. 17A-F illustrate a perspective view of different phases of assembling an exemplary two bedroom unit. The process for assembling exemplary two bedroom unit 300F shown in FIG. 6B is similar in nature to assembling exemplary one bedroom unit 300C shown in FIG. 6A as described above in FIGS. 15A-F. In addition, exemplary two bedroom unit 300F contains an additional storage cabinet 630C, entertainment wall 642 with glass pocket doors 643, and could contain an additional bathroom and all of its components. Sequence and installation of these additional components for exemplary two bedroom unit 300F are constructed along the same timeline as the similar components as exemplary one bedroom unit 300C.

FIGS. 18A-D illustrate side and top views of various configurations of the exterior window walls 530A-D for various units. The exterior window walls have operable windows 531A-B for easily opening the windows for outside access. The operable windows open by swinging, sliding or by any other mechanisms used to open windows. The quantity, location, and spacing of the operable windows can vary from unit to unit and from building to building. The exterior window walls 530A-D may contain clear glass, spandrel glazing with backup insulation or metal panel with backup insulation. Any of these exterior window walls 530A-D may be installed to accommodate different layouts of units. All of the exterior window walls 530A-D are delivered to the site pre-glazed for rapid installation.

In an effort to keep the construction as efficient as possible for on-site staging, storage of materials, walls and components are minimal. All of the building's fundamental elements are delivered to the site as pre-fabricated and prefinished components. These pre-fabricated and prefinished components include all exterior walls, demising walls, interior partitions, all kitchen and bathroom units, and other components. Walls are typically delivered in a minimum of ten foot lengths and may be as large as 20 foot lengths or more unless noted otherwise, and may be hoisted directly from the truck or other transport means to their final location for immediate installation.

Figure 19A:
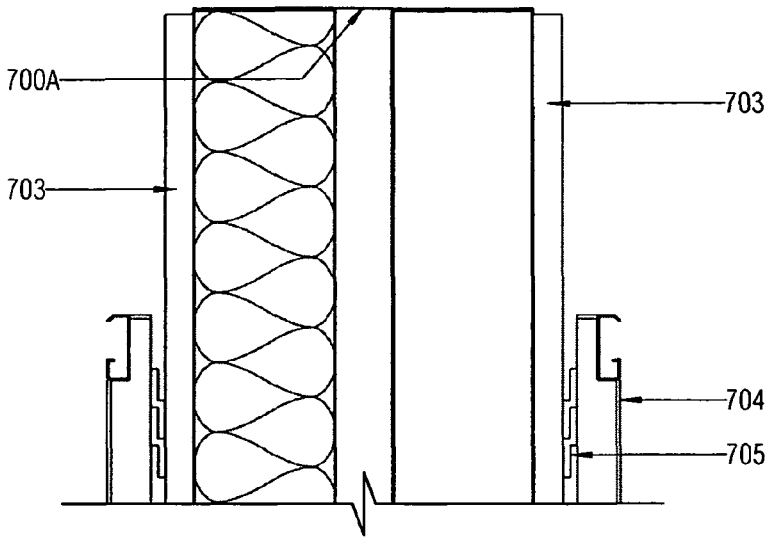
FIGS. 19A-C illustrate sectional base and head details of structural members before attaching the demising wall to the slab.
Figure 19B:
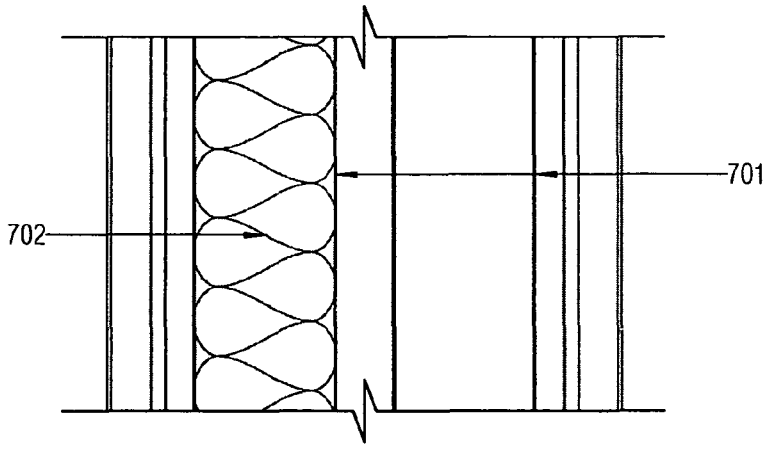
Figure 19C:
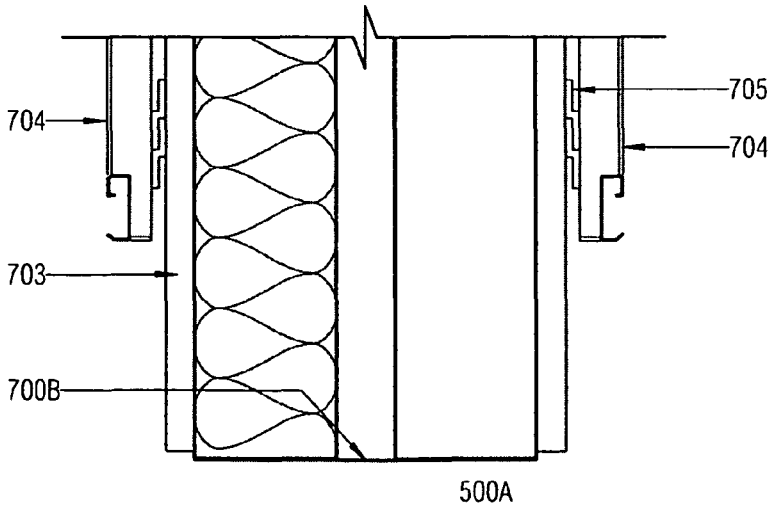

The floor slabs and roof slab 450A-F are either lifted and secured to the load bearing structural frame 400 or the floor slabs and roof slab 450A-F are loaded, lifted and secured to the load bearing structural frame 400. The step of constructing a building for the present invention may involve placing or installing the demising walls 500A-B as shown in FIGS. 19-22 in their final position either prior to or after the slabs are lifted and secured in place. The exemplary demising wall 500A has a head track 700A and a base track 700B as shown in FIGS. 19A-C. The demising wall 500A is composed of staggered metal stud framing 701 with acoustical blanket insulation layer 702, electrical connections, sprinklers, and communications components. The acoustical insulation layer 702 is preferably about 2" to 3" thick, weaved through the studs and contributes to a sound transmission class (STC) rating for the entire assembly of about 50 or higher. The electrical wiring is pre-installed at the factory and connected at the site while installing the demising walls 500A to the other components. Both sides of the demising wall 500A receive a layer of fire-rated wall sheathing 703. The preferred method for finishing the demising wall 500A is to attach a finish panel 704 over both sides of the demising wall 500A at the site using wood or metal cleats 705 installed on the wall sheathing 703. Several options are available for the exemplary finish panel 704, including but not limited to, stain, paint, magnesium-oxide board, wood veneer, wood paneling, plaster, metal, wallpaper, and cork. A preferred application for the sheathing material 703 is a 12 mm magnesium oxide board, however, other similar fire-rated panels or materials may be used. Alternately, the finish panel 704 and cleats 705 may be omitted and the wall sheathing finished in a more conventional manner. More specifically, the wall sheathing may be taped and painted so as long as it achieves the required fire rating per local building codes.

Figure 20A:
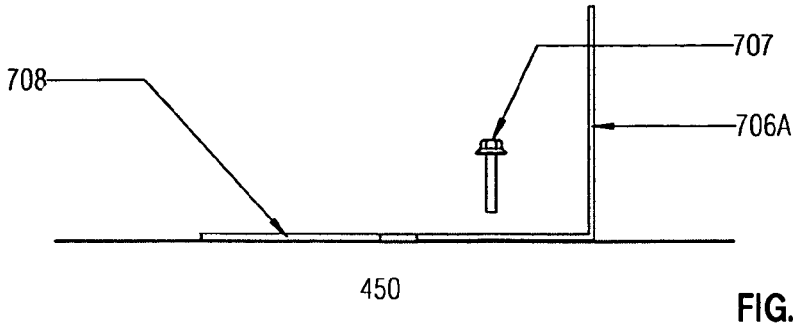
FIGS. 20A-C illustrate sectional details of steps to secure the demising wall base to the slab.
Figure 21A:
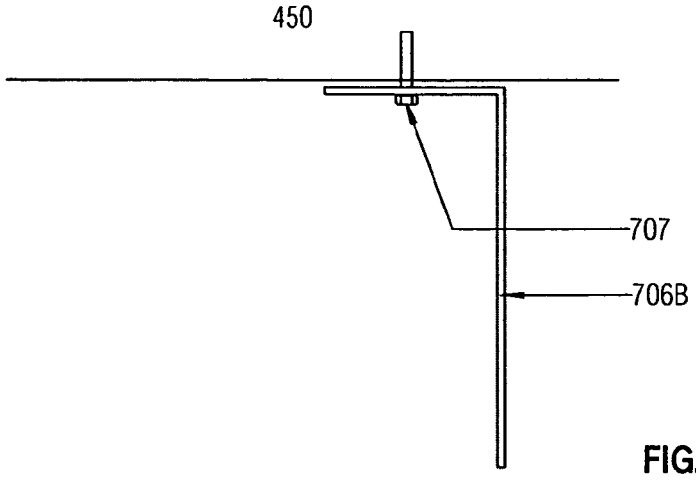
FIGS. 21A-C illustrate sectional details of steps to secure the demising wall head to the slab.

The first step of installing the demising wall 500A utilizes prefinished, acoustically sealed L-shaped support members 706A-B and fasteners 707 which are secured to the top and undersides of the floor slab 450. As shown in FIGS. 20A and 21A, the horizontal section of the L-shaped base and head support member 706A-B has a pre-drilled hole (not shown) to receive the fastener 707 for securely attaching the L-shaped support member 706A-B to the slab 450. Therefore, the support members 706A-B are securely attached to the top portion and underside of the slab 450 by drilling the base fastener 707 through the hole, the neoprene pad 708 at the base and into the slab 450. The pad 708 is positioned immediately beneath the horizontal section of the base support member 706A. Adjacent to the pad 708, fire-sealant tape 709 is placed on each side of the pad 708 before drilling the base fastener 707 into the slab 450.

Figure 20B:
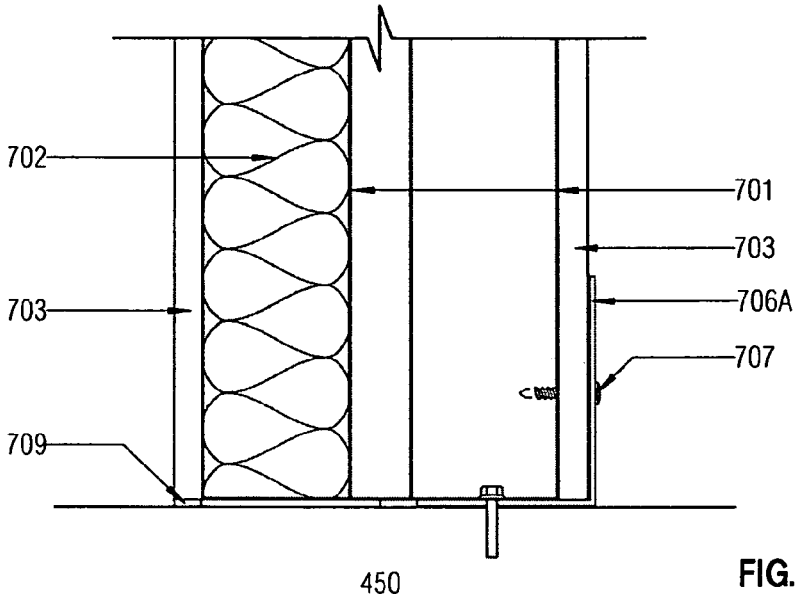
Figure 20C:
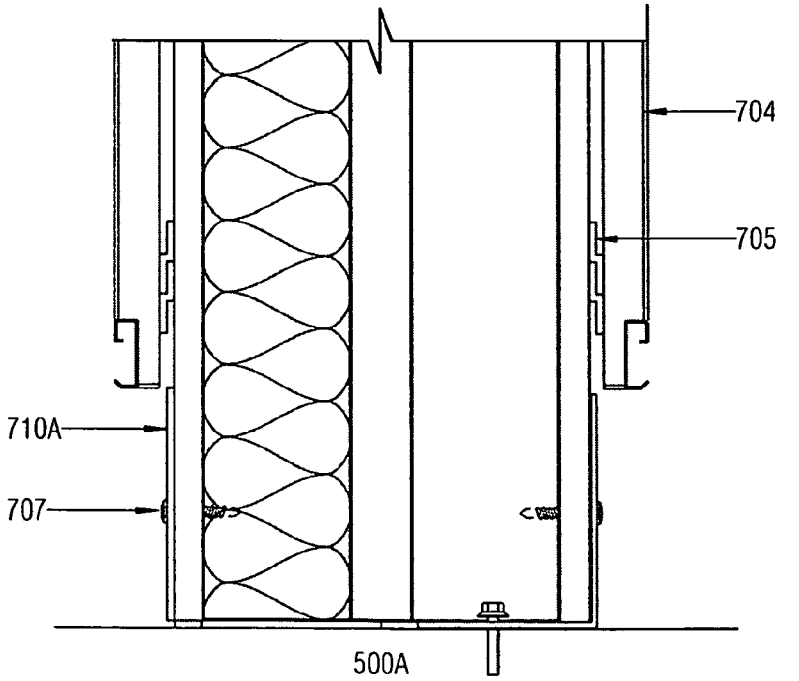
Figure 21B:
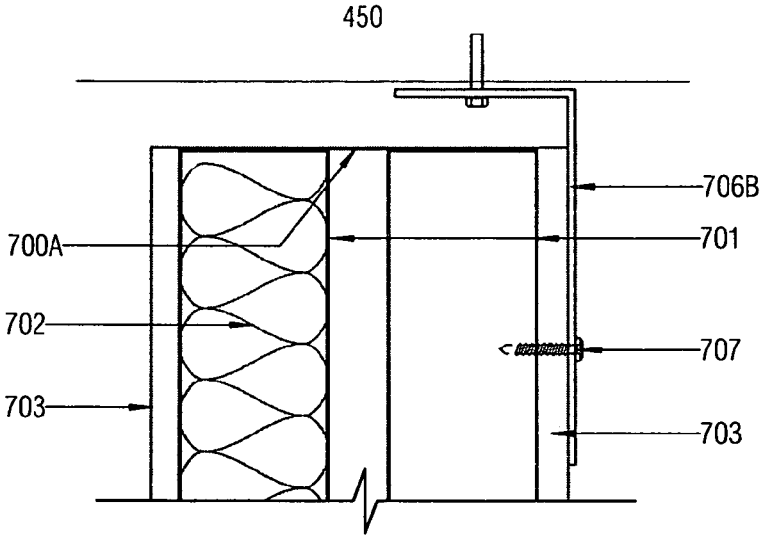

As shown in FIGS. 20B and 21B, upon securely attaching the support members 706A-B to the top and undersides of the slab 450, the entire demising wall 500A is set onto the base support member 706A and secured into place. Simultaneously, the head section of the demising wall 500A is placed adjacent to and inside the L-shaped head support member 706B and securely positioned into place. The next step is to insert a support fastener 707 horizontally from the vertical side of the base and head support member 706A-B through the demising wall 500A as shown in FIGS. 20B and 21B. The head support member 706B has pre-drilled holes (not shown) to allow vertical movement from slab 450 after support fastener 707 has been attached between the vertical side of the base and head support member 706A-B. The next step as illustrated in FIG. 20C is to cover the inner side of the demising wall 500A by attaching the base trim 710A, preferably made of metal or other similar materials. More specifically, the base trim 710A is preferably made of similar material as the L-shaped base support member 706A. Base trim 710A is attached with fastener 707.

Figure 21C:
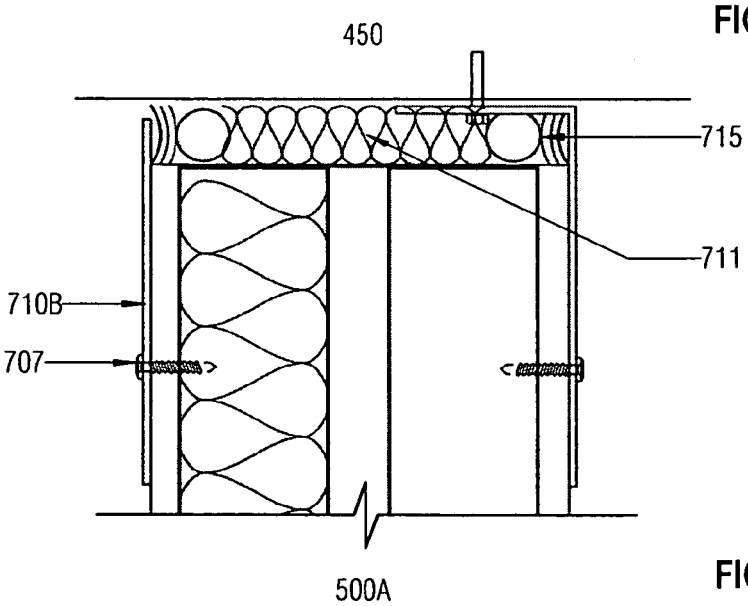
Figure 22:
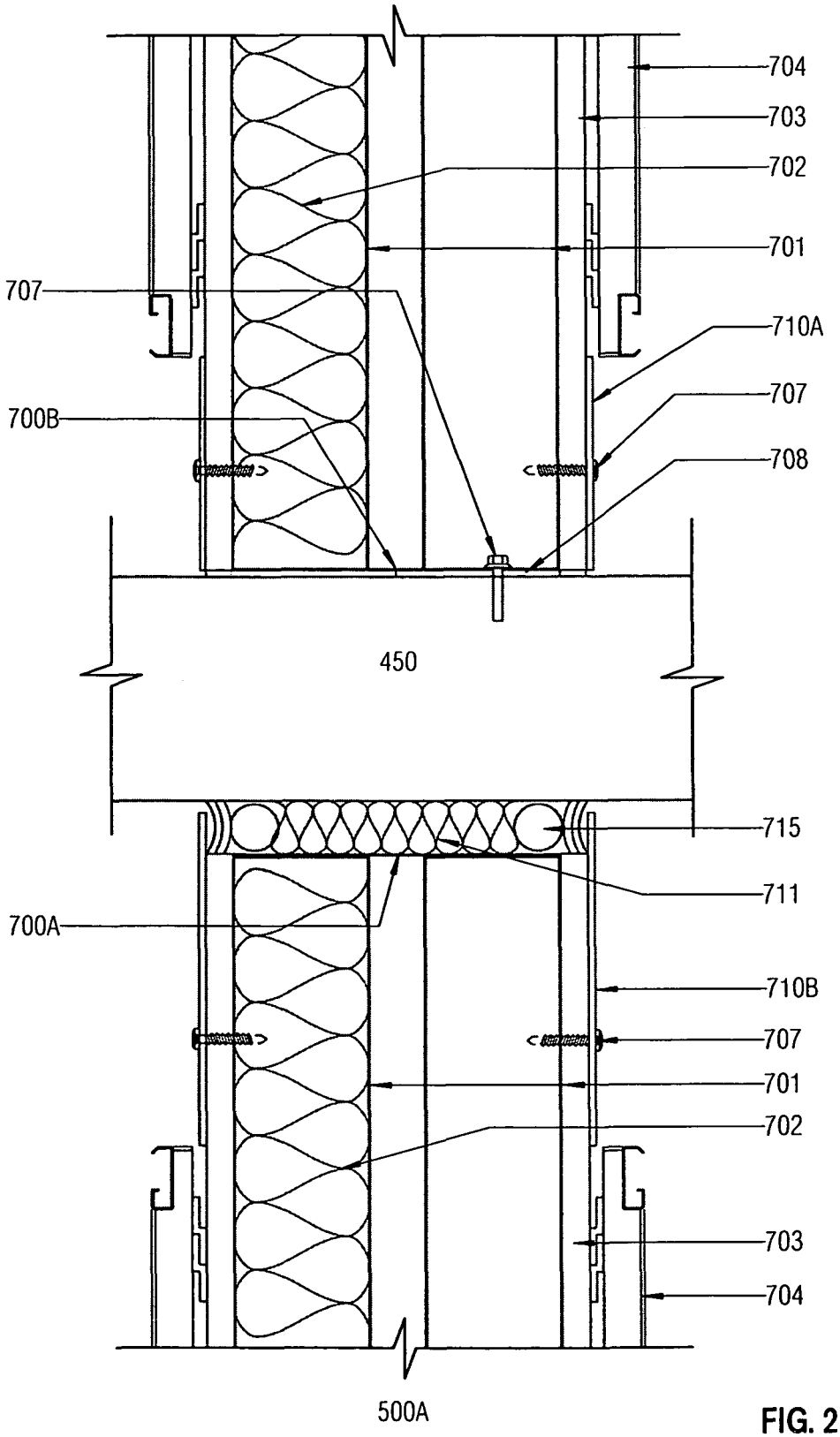
FIG. 22 illustrates cross sectional head and base details of the demising wall attached to the slab.

As shown in FIG. 21C, the next step in securing the demising wall is filling the horizontal gap created between the underside of the slab 450 and the head portion of the demising wall 500A with fire-safe materials 711. After installing the fire-safe material 711, the next step is sealing any open spaces between the slab 450 and the head portion of the demising wall 500A with caulk, preferably fire-resistant caulk, to prevent any fire from getting through the space. Caulk or similar fire-resistant material is also used to seal the space between the horizontal portion of the head support member 700A and the underside of the floor slab 450 whereby the fire-safe materials 711, backer rod and sealant 715 are inserted. This horizontal gap whereby the fire-safe materials 711 are filled also allows vertical movement of the slab 450 due to deflection. Upon sealing the open spaces between the demising walls 500A and the slab 450, the head trim 710B is attached, preferably made of metal or other similar materials. More specifically, the head trim 710B is preferably made of similar material as the L-shaped head support member 706B. Head trim 710B is attached on the inner side of the demising wall 500A with fastener 707. FIG. 22 illustrates a completely installed demising wall 500A to floor slab 450.

The next step of constructing a building using the present invention may be installing end walls 510, particularly when a unit is not located in the middle of a building. A living unit that is located in the middle of a building is enclosed between two demising walls 500A-B that are parallel to one another. In this case, both demising walls 500A-B are placed one after the other. However, for a living unit that is located at the end of a building, the end unit requires installation of an end wall 510 in lieu of a second demising wall 520B or an exterior window wall 530A-C. The preferred sequence is to install the end wall 510 with its structural members immediately following installation of the demising walls 500A-B as described in previous figures. This sequence helps to enclose the construction as soon as possible.

Figure 23:
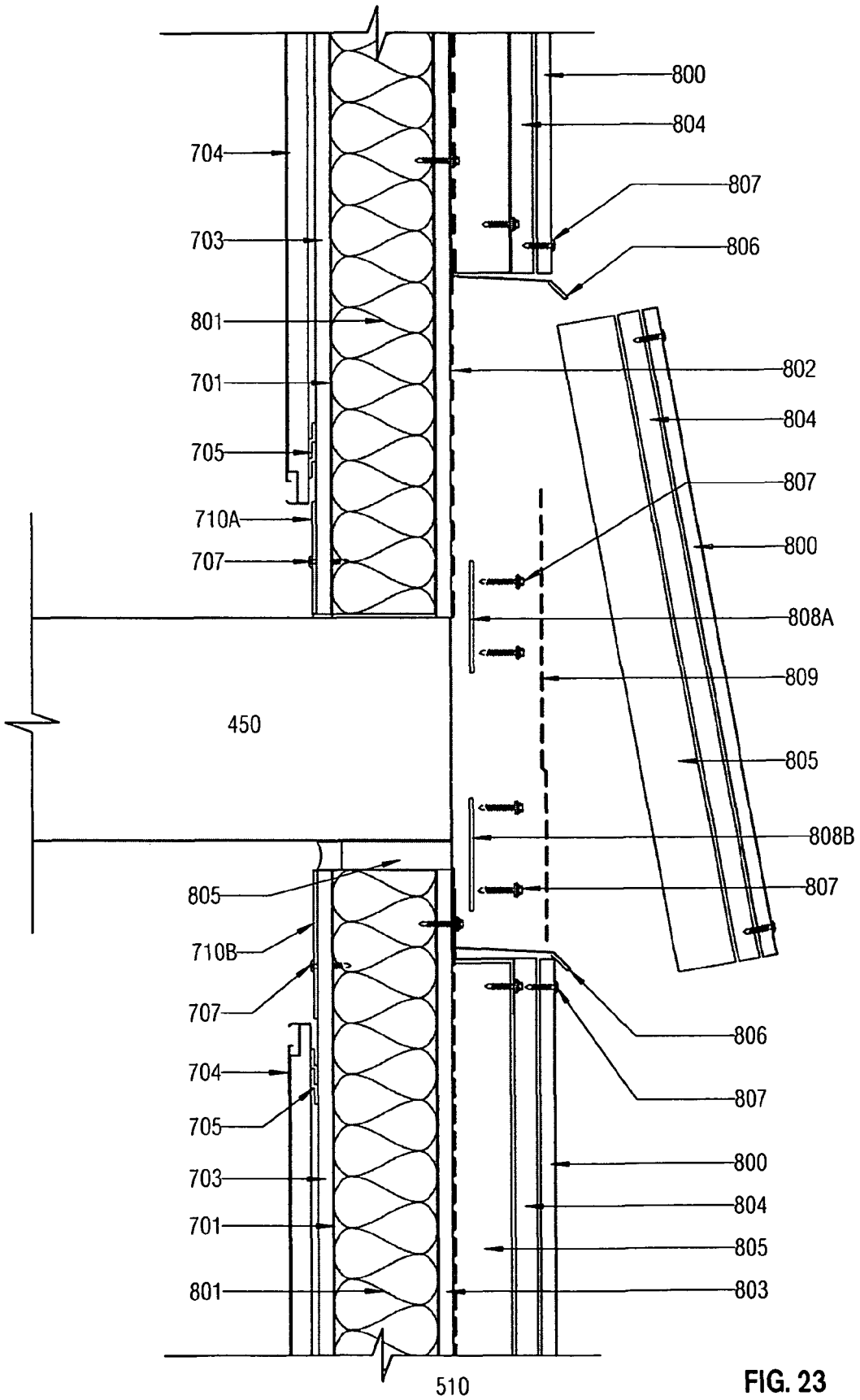
FIG. 23 illustrates sectional details for attaching the exterior or end wall to the slab.
Figure 24A:
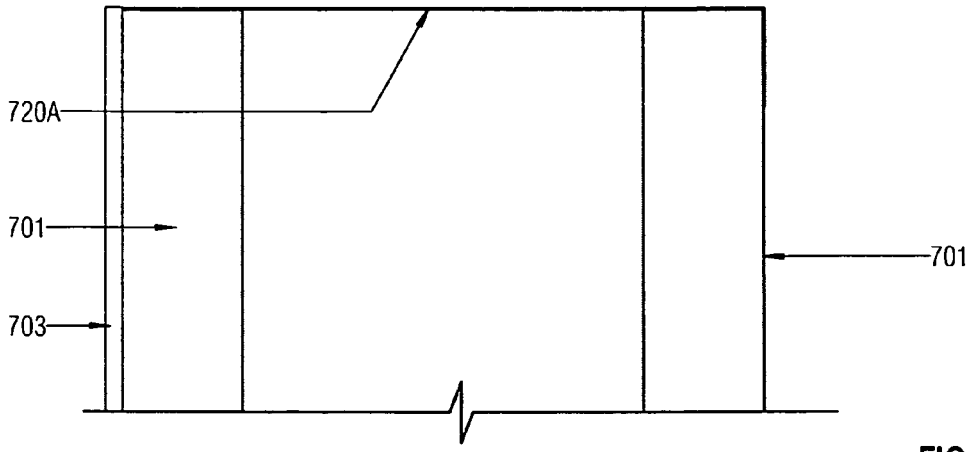
FIGS. 24A-C illustrate sectional head details of structural members before attaching the utility wall to the slab.
Figure 24B:
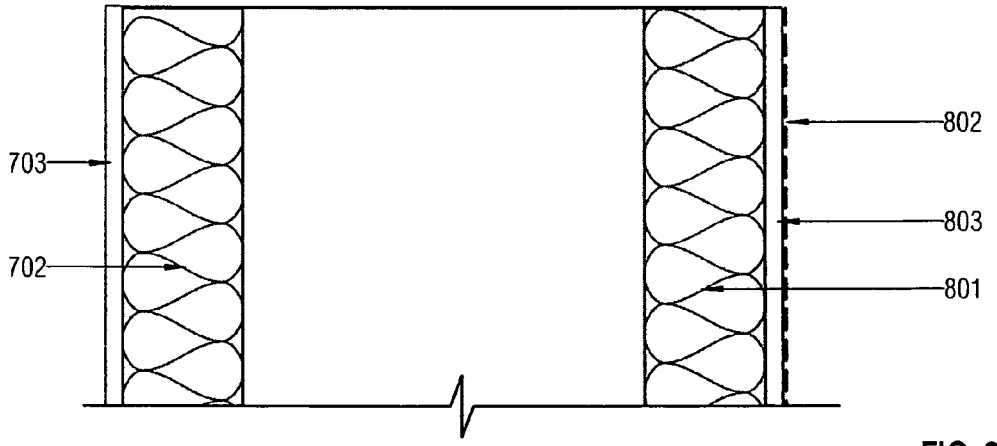
Figure 24C:
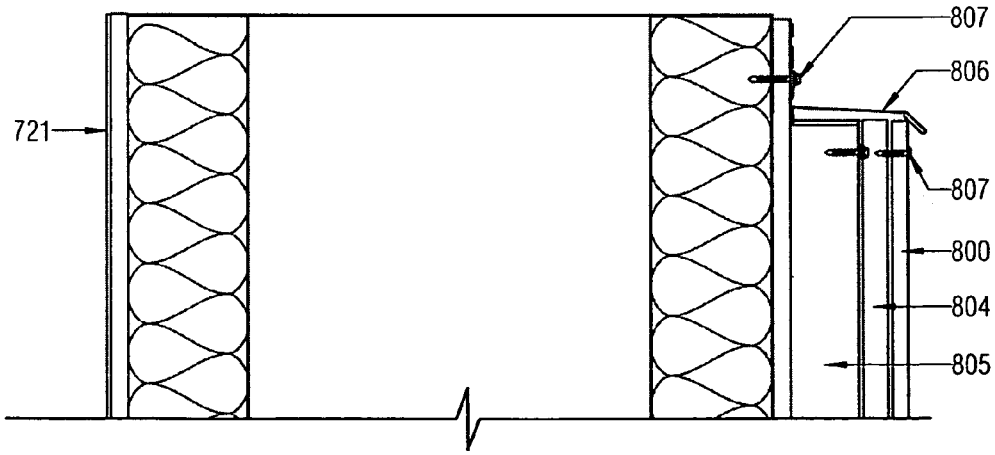
Figure 25A:
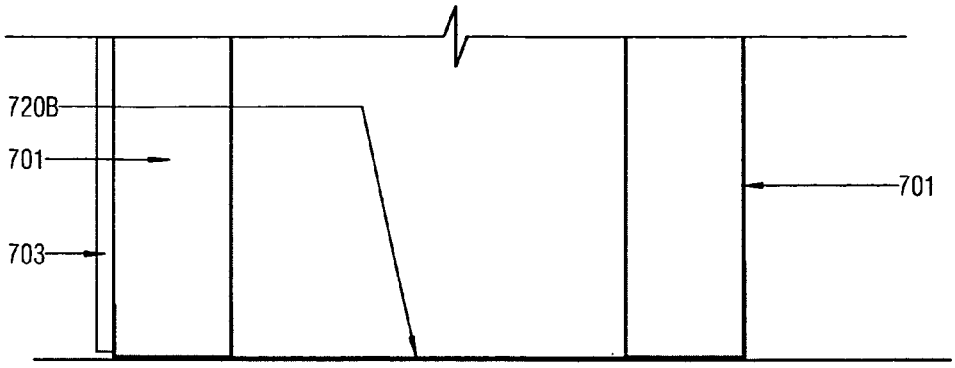
FIGS. 25A-C illustrate sectional base details of structural members before attaching the utility wall to the slab.
Figure 25B:
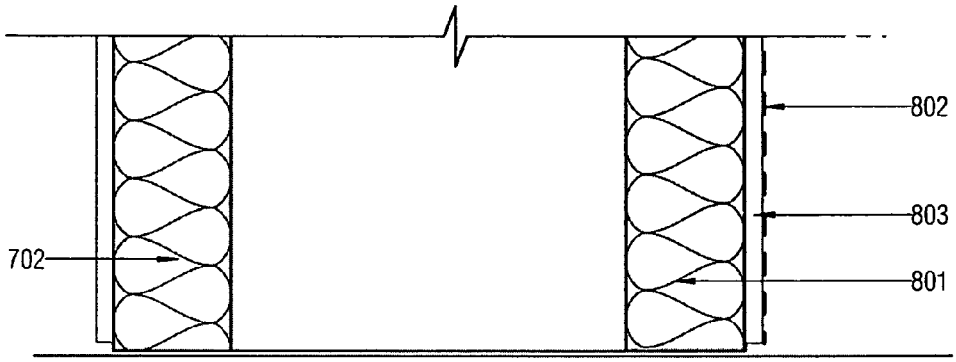
Figure 25C:
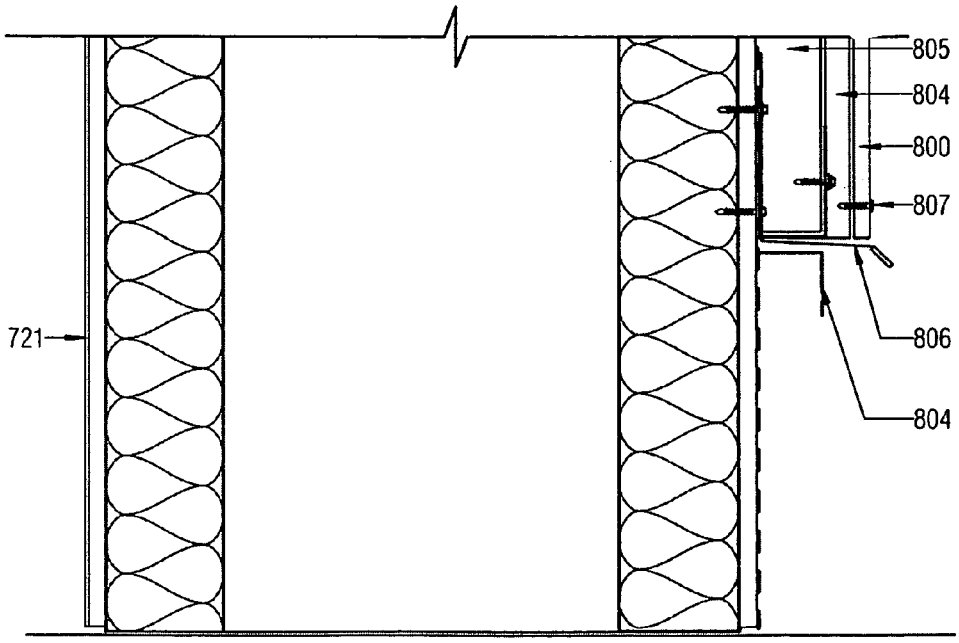

FIG. 23 illustrates cross-sectional details of end wall 510. An exemplary end wall 510 is composed of metal stud framing 701 with thermal batt insulation 801, sprinkler plumbing, electrical, and communications components. The wiring and plumbing are pre-installed at a factory and connected at the site. The interior side of the end wall 510 receives a layer of fire-rated sheathing 703, with a finished panel 704. The inner wall sheathing 703 is preferably a 12 mm magnesium oxide board, however, other types of fire-rated wall panels with safety mechanisms may be used. The preferred method for finishing the end wall 510 is to attach a finish panel 704 over the end wall 510 at the site using wood or metal cleats 705 installed on the wall sheathing 703. Several options are available for the exemplary finish panel 704, including but not limited to, stain, paint, magnesium-oxide board, wood veneer, wood paneling, plaster, metal, wallpaper, and cork. Alternately, the finish panel 704 and cleats 705 may be omitted and the wall sheathing finished in a more conventional manner. More specifically, the wall sheathing may be taped and painted so as long as it achieves the required fire rating per local building codes. A final interior trim piece 710A-B is installed with fastener 707 in a similar manner to the demising wall 500A as described above following the secure placement of end wall 510.

The exterior side of the end wall 510 receives exterior sheathing 803, a weather resistive barrier 802, furring channels 804, preferably metal or similar material, rigid insulation 805, associated flashing pieces 806, exterior fasteners 807 and an exterior cladding material 800. A section of exterior cladding 800, metal furring channels 804, rigid insulation 805, associated flashing pieces 806, and exterior fasteners 807 is temporarily left off the end wall 510 at the slab edge 450 as a means of providing the connection of the end wall 510 to the floor slab 450 as described below.

The steps to attach the end wall 510 to the floor slab 450 are illustrated in FIG. 23 and described as follows: base and head plates 808A-B are attached at the face of the slab 450 with fasteners 807 that are drilled at the base and head conditions of the floor slab 450 prior to the end wall 510 being moved into place from the interior side of the building. The end wall 510 utilizes thermally insulated anchors 807 that are securely attached to the slab 450 prior to installing the end wall 510. The portion of the plate 808A-B that is attached to the exterior sheathing 803 has pre-punched slots (not shown in the figures) through which the fastener 807 is screwed horizontally to accommodate vertical movement of the end wall 510 due to movement of the slab 450. Consequently, a horizontal gap allows slight, vertical deflection of the slab 450. This gap may be filled with rigid insulation 805 or fire-safe materials 711 prior to attaching the final exterior cladding panel.

Upon attachment of the plates 808A-B to the slab 450 with fasteners 807, the end wall 510 is moved into place with the exterior wall sheathing 803 abutting the base and head plates 808A-B. Fasteners 807 are installed in the horizontal direction along the end wall 510 through the weather resistive barrier 802 and into the exterior sheathing 803 to securely attach the end wall 510 to the floor slab 450. The next step is to attach a "peel and stick" weather resistive barrier 809 over the base and head plates 808A-B at the base and head of the wall and the floor slab 450 of the end wall 510. The final step involves attaching the final exterior cladding 800, metal furring channels 804, rigid insulation 805, and associated flashing pieces 806 with fasteners 807 that was temporarily left off allowing access to attachment points of the end wall 510 to floor slab 450. The installation of this final panel 800 completes the installation of the end walls 510 creating a weather-tight and watertight system.

Figure 41:
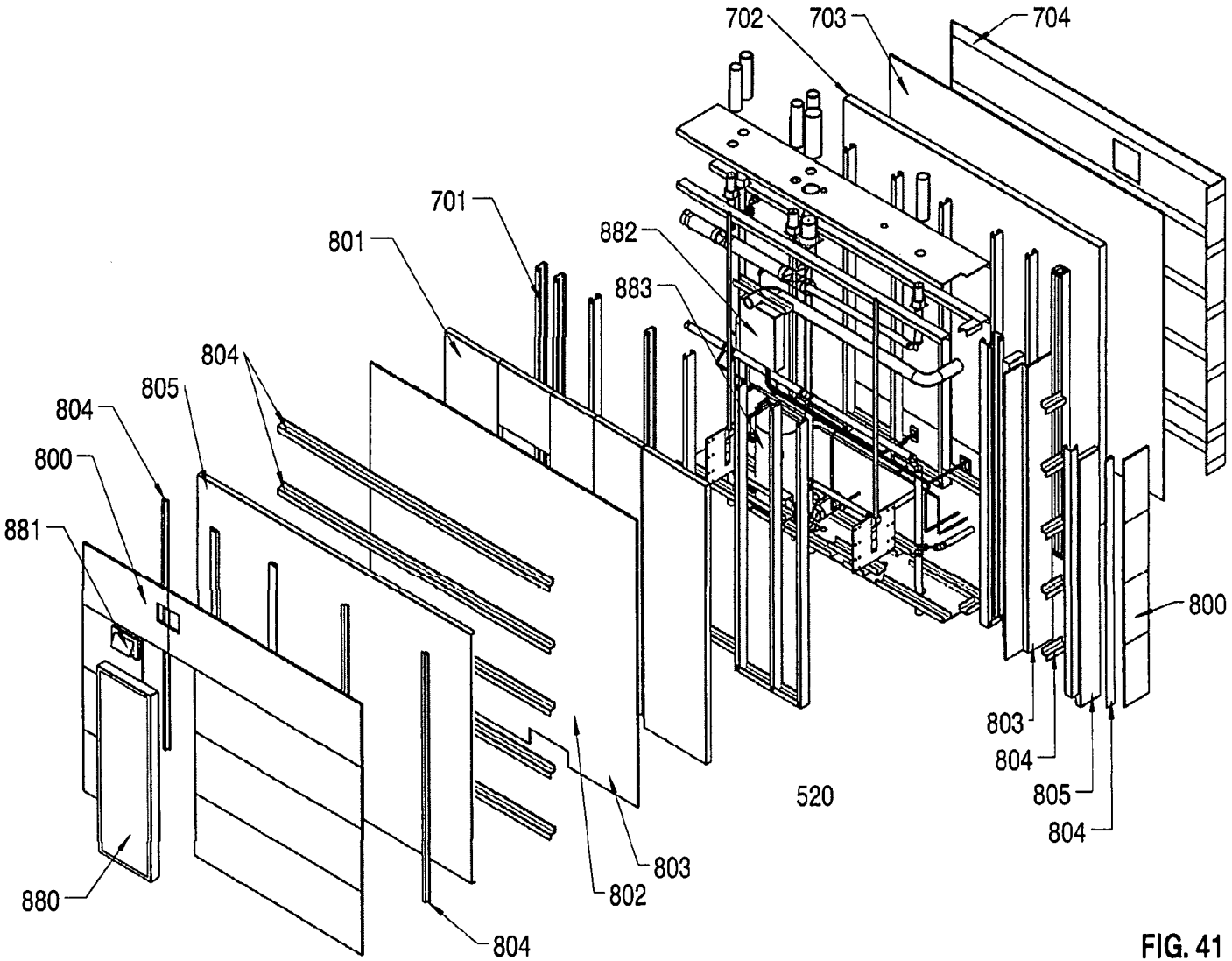
FIG. 41 illustrates in a cut away view the components that make up the completed utility wall.
Figure 42:
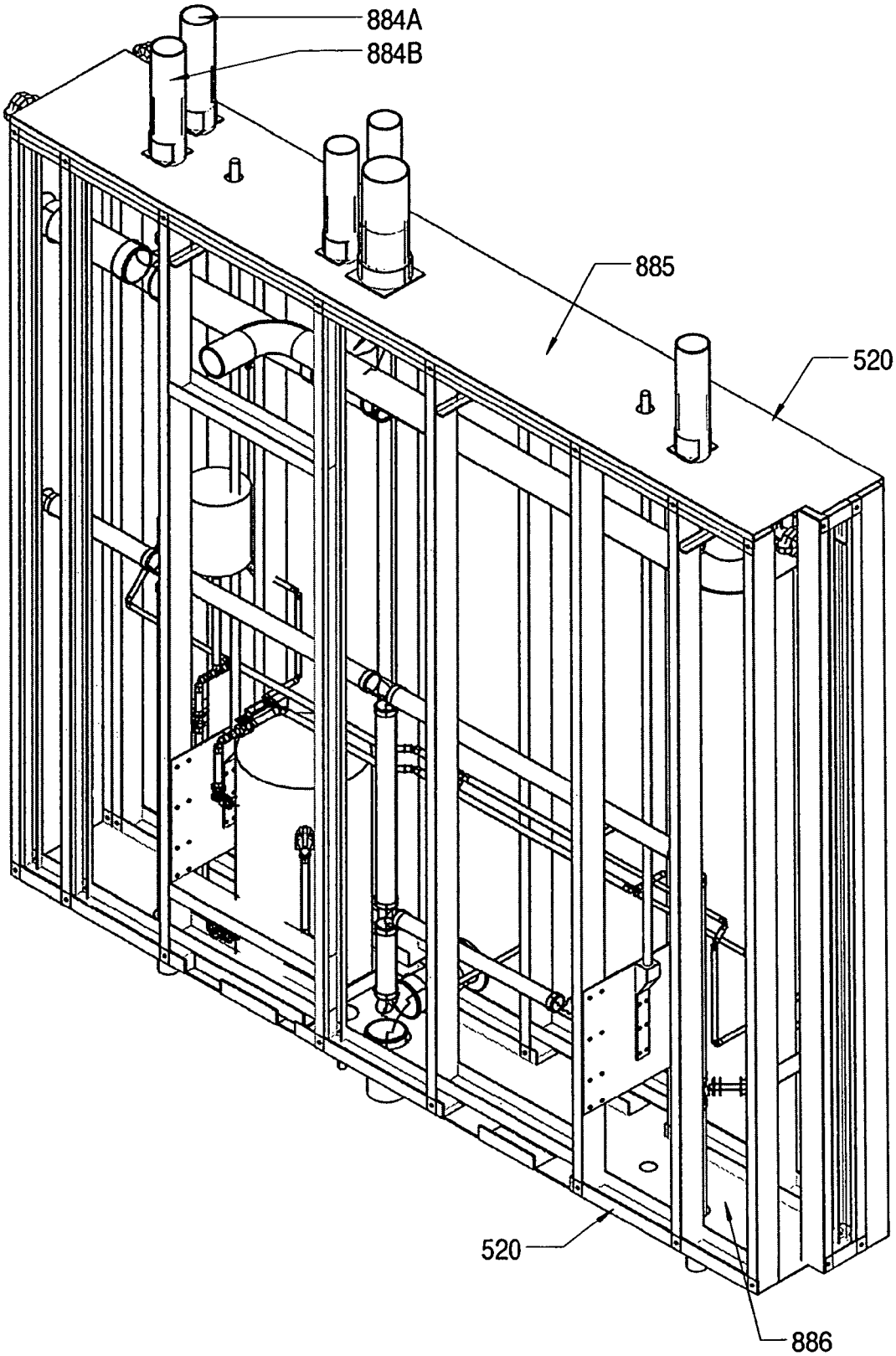
FIG. 42 illustrates the component parts of the utility wall, including the supply and waste piping and vent ducting to pre-designated locations, and installation of the water heater within the wall cavity.

After the demising walls and end walls are secured in place, the next step involved in constructing the building using the present invention may be to attach utility wall 520 as to further enclose the unit. Each unit 300A-H and 300J as shown in FIGS. 6A-B has a utility wall 520 at the end of every kitchen and bathroom. The utility wall 520 houses common mechanical, plumbing and electrical risers that serve the units 300A-H and 300J. All of the utilities to and from the units are accessed at the utility wall 520. These utility walls 520 are delivered to the site as preassembled, pre-plumbed, pre-wired and prefinished components. The utility walls 520 arrive on-site with all the wall plumbing associated with the kitchen sink, toilet, and shower already in place. The utility walls 520 also include all plumbing supply, vent and drain lines, fire protection, shower valves, shower head, and associated trim. The utility wall 520 further contains the unit's electrical panel and associated wiring. Refer to FIGS. 41-42 for the various components related to the utility wall 520.

FIGS. 24A-C and FIG. 25A-C illustrate the exemplary components that compose the utility wall 520. The exemplary utility wall 520 has a head track 720A and a base track 720B that encompass all framing members of the utility wall 520. It is further composed of an interior side metal stud frame wall 701 with acoustical blanket insulation layer 702, wall sheathing 703 and an interior finish material 721. The utility wall 520 is further composed of an exterior side metal stud frame wall 701 with thermal batt insulation 801, exterior sheathing 803, weather resistive barrier 802, furring channels 804, rigid insulation 805, associated flashing pieces 806, exterior fasteners 807 and an exterior cladding material 800. Possible cladding materials may be comprised of various materials allowed by code, such as, but not limited to, composite panels, phenolic resin panels, metal panels, cement board, lightweight precast concrete panels, wood siding, gypsum fiber reinforced cement panels, ceramic tile, and stone panels. A preferred application for both interior and exterior sheathing material 703, 803 is a 12 mm magnesium oxide board, however, other similar fire-rated panels or materials may be used. A section of exterior cladding 800, furring channels 804, exterior sheathing 803, rigid insulation 805, associated flashing pieces 806, and exterior fasteners 807 is temporarily left off the utility wall 520 at the slab edge 450 (not shown) as a means of providing the connection of the utility wall 520 to the floor slab 450 as providing an access point for connection of the utilities within the utility wall 520.

Figure 26:
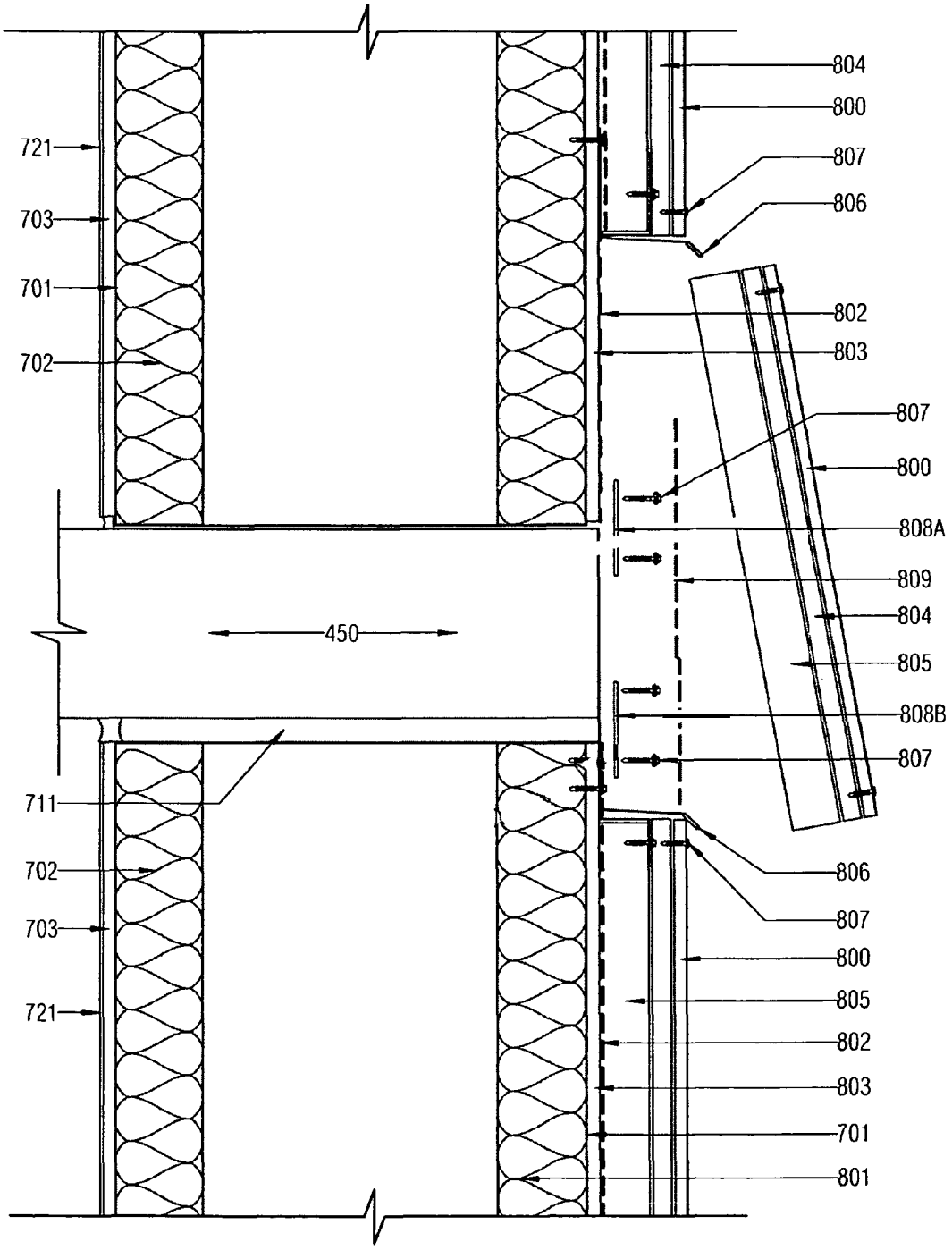
FIG. 26 illustrates sectional details for attaching the utility wall to the slab.

As shown in FIG. 26, the utility wall 520 attaches to the floor slab 450 as follows: base and head plates 808A-B are attached at the face of the slab 450 with fasteners 807 that are drilled at the base and head conditions of the floor slab 450 prior to the utility wall 520 being moved into place from the interior side of the building. The utility wall 520 utilizes thermally insulated anchors 807 that are securely attached to the slab 450 prior to installing the utility wall 520. The portion of the plates 808A-B that are attached to the exterior sheathing 803 has pre-punched slots (not shown in the figures) through which the fastener 807 is screwed horizontally to accommodate vertical movement of the utility wall 520 due to movement of the slab 450. Consequently, a horizontal gap allows slight, vertical deflection of the slab 450. This gap may be filled with rigid insulation 805 or fire-safe materials 711 prior to attaching the final exterior cladding panel 800.

Upon attachment of the plates 808A-B to the slab 450 with fasteners 807, the utility wall 520 is moved into place with the exterior wall sheathing 803 abutting the base and head plates 808A-B. Upon connection of the utilities through the exterior side of the utility wall 520 utilizing the exterior walkway for access, or by other means, the portion of exterior sheathing 803 that was previously left off is attached using fasteners 807. The utility wall 520 is then securely fastened to the head and base plates 808A-B with fasteners 807 installed in the horizontal direction along the utility wall 520 through the weather resistive barrier 802 and into the exterior sheathing 803 to securely attach the utility wall 520 to the floor slab 450. The next step is to attach a "peel and stick" weather resistive barrier 809 over the base and head plates 808A-B at the base and head of the wall and the floor slab 450 of the utility wall 520. The final step involves attaching the final exterior cladding 800, metal furring channels 804, rigid insulation 805, and associated flashing pieces 806 with fasteners 807 that was temporarily left off allowing access to attachment points of the utility wall 520 to floor slab 450 as well as to allow for a connection point of utilities within the utility wall 520. The installation of this final panel 800 completes the installation of the utility wall 520 creating a weather-tight and watertight system.

Figure 27A:
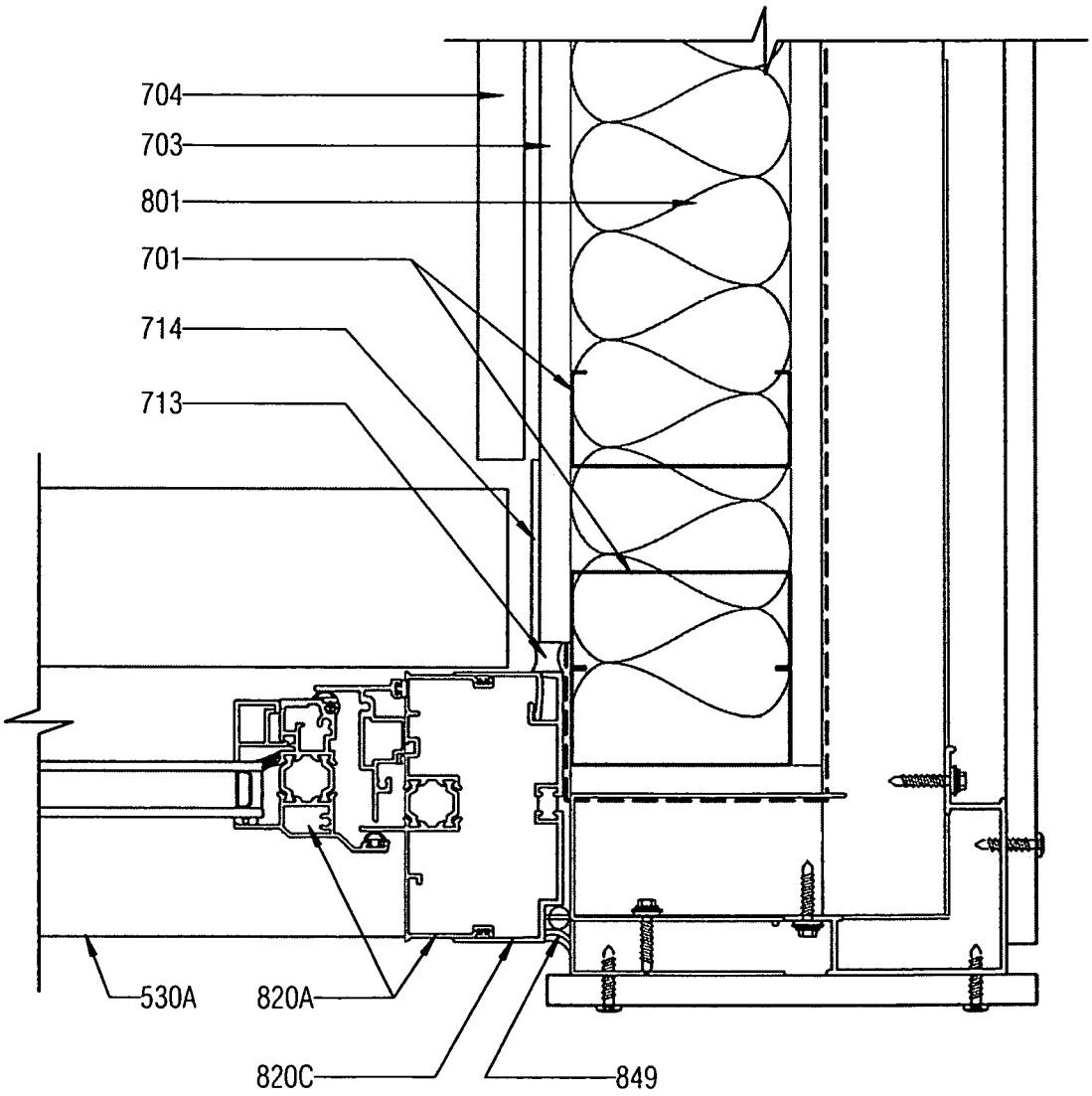
FIGS. 27A-B illustrate plan details of the end wall and demising wall interfacing with the exterior window wall after attaching the exterior window wall to the slab.

After the demising walls 500A-B, end walls 510, and utility wall 520 are secured in place, the next step involved in constructing the building using the present invention may be to attach the exterior window wall 530A-D to substantially enclose the unit. Window wall sections are installed in a linear arrangement starting at the end wall as shown in FIG. 27A. The window wall compensation channel 820C is abutted to the metal stud framing 701 of the exemplary end wall 510 as previously described in FIG. 23. The window wall frame 820A is next securely attached to the compensation channel 820C and the window wall installation progresses in a linear direction across the exemplary unit. Sealant 713 is installed between the edge of the end wall 510 interior sheathing 703 and the window wall compensation channel 820C. Upon installation of the sealant 713, a finish wall trim 714 is attached to the wall sheathing 703. The interior finish panel 704 is further installed as described in FIG. 23 to complete the interior portion of the interface between the exemplary end wall 510 and the window wall 530A. Exterior sealant and backer rod 849 is installed on the exterior directly adjacent to the window wall compensation channel creating a weather-tight and watertight system.

Figure 27B:
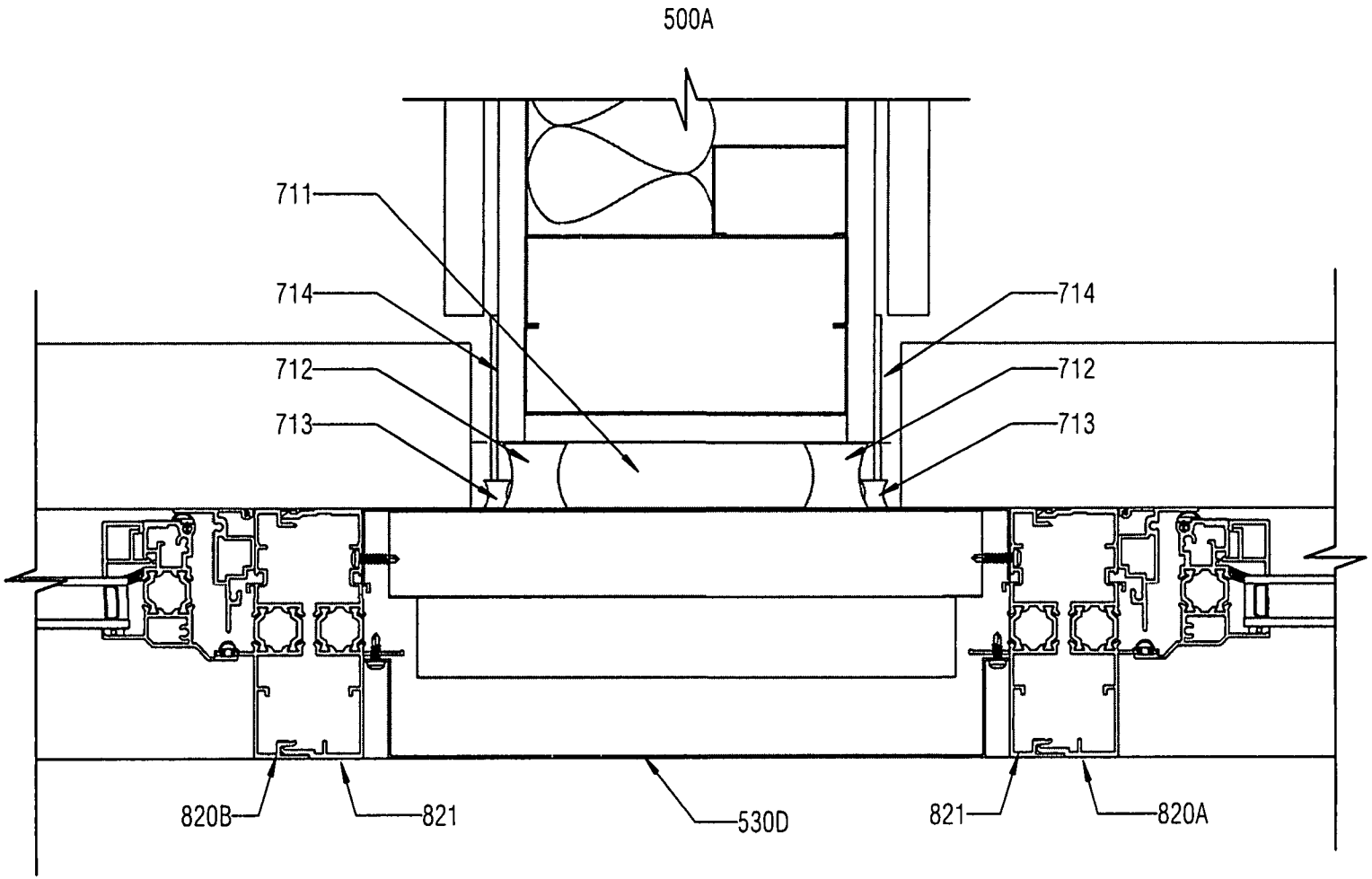

FIG. 27B illustrates a plan view of the interface between a demising wall 500A with exterior window wall panel 530D. Window member 820A is attached to an adjacent window member not shown in the figure. Closure panel 821 is slid into place attaching to the window member 820A and then securely attached to the floor slab 450 (as described in FIG. 28). Window member 820B is next positioned on the slab and is slid into place and securely attached to closure panel 821. This process continues across the slab until the entire window wall system is securely in place. Upon secure attachment of the exterior window walls 530A-D to the floor slab 450 (shown in FIG. 28), the fire-safe material 711, fire caulk 712, sealant 713 and wall trim 714 are provided between the demising wall 500A and the exterior window walls 530A-D.

Figure 28B:
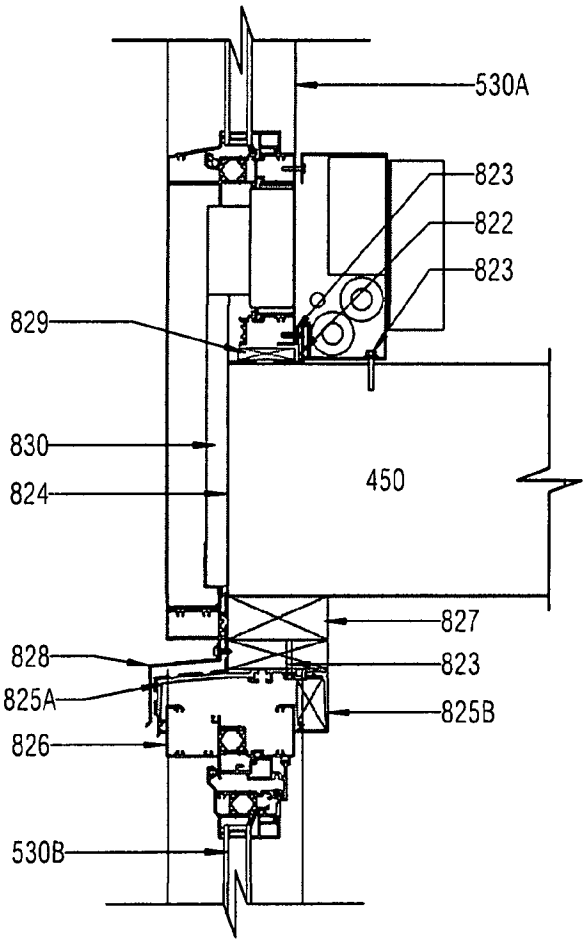
FIGS. 28A-B illustrate sectional details for attaching the exterior window wall to the slab.
Figure 28A:
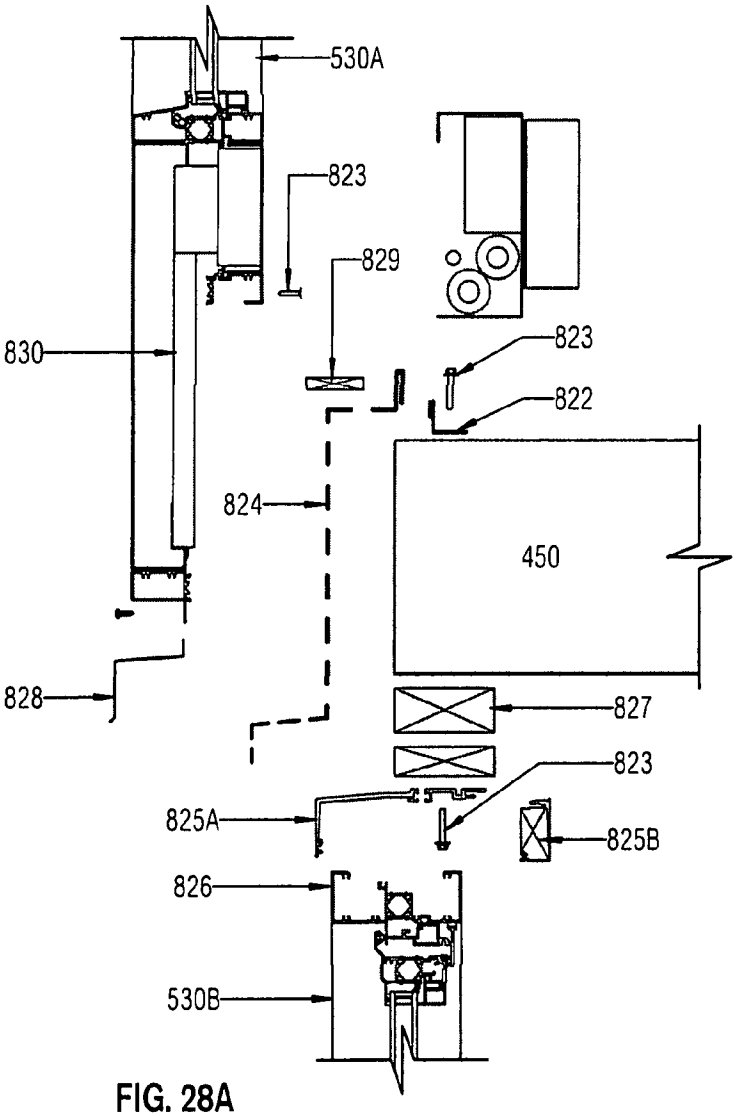

FIGS. 28A-13 illustrate sectional details for attaching exterior window walls 530A-B to the floor slab 450. In order to install exterior window walls 530A-B, an anchor 822 in the shape of an L with outer ledges bent inwardly is first placed and anchored to the slab 450 by vertically inserting a fastener 823 at the middle portion of the bottom side of the anchor 822 into the slab 450. The anchor 822 is positioned on and anchored to the slab 450 to leave room for at least half of a large flexible flashing 824 to fit on the remaining portion of the slab 450 towards the edge. The large flexible flashing 824 is shaped around the adjacent components to make a step-like structure with two upper and lower horizontal portions and two upper and lower vertical portions. The large flexible flashing 824, which is waterproof, is positioned immediately next to the anchor 822 so that the exterior, vertical side of the anchor 822 fits with the upper vertical side of the large flexible flashing 824 and the lower horizontal portion of the large flexible flashing 824 fits snugly on the slab 450. Half of the lower horizontal portion of the large flexible flashing 824 protrudes out at the edge of the slab 450 as shown in FIG. 28B.

A slip member 825A is then anchored firmly to the underside of the slab 450 at the ceiling, or head, portion of the exterior window wall 530B. The slip member 825A is shimmed so that it is perfectly level to receive the bottom exterior window wall 530B with the head support member 826 and rests at its exact elevation. The exterior window walls 530A-B are constructed to allow approximately ⅝" of shim space at the top and bottom for leveling and alignment. A third fastener 823 is used to attach a head blocking 827 to the underside of the slab 450. The small flashing 828 is used to seal the head blocking 827. Upon anchoring the slip member 825A to its proper position under the slab 450, the exterior window wall 530B with the head support member 826 is inserted into the slip member 825A. Upon securing the head portion of the exterior window wall 530B with the slip member 825A, the bottom portion of the exterior window wall 530A is positioned tightly against the anchor 822 and at the bottom side of the exterior window wall 530A. As shown in FIG. 28A, a bottom sill blocking 829 is attached on top of the slab 450 with the large flexible flashing 824 in-between before positioning the exterior window wall 530A against the anchor 822. A final closure piece 825B is attached at the window head. It should be noted that although head blocking 827 is described in the above invention, the blocking 827 may be omitted. The exterior window wall system contains integrated insulating panels 830 which are included during manufacturing. The completely assembled exterior window walls 530A-B are shown in FIG. 28B.

The final step in completely enclosing exemplary units 300A-H and 300J involves the installation of the entry door 540. The entry door 540 is a preassembled, pre-glazed, and prefinished component. FIGS. 29A-D illustrate the exemplary components of the entry door 540. The entry door 540 comes with a door portion 840, inner frame 841 to house the door portion 840, outer frame 842 to support the entry door 540, and an operable transom 843 positioned above the door portion 840 within the outer frame 842. All associated hardware for the door portion 840 and operable transom 843 is pre-installed except for thresholds or covers 844 and the electrical closure chase 845. The entry door 540 may come in a right-hand or a left-hand door configuration to accommodate different unit layouts. Electrical connections to be made between walls such as the demising walls 500A-B and the utility wall 520 are made in an electrical closure chase 845 located adjacent to the transom head 846 and the underside of the floor slab 450.

Figure 29B:
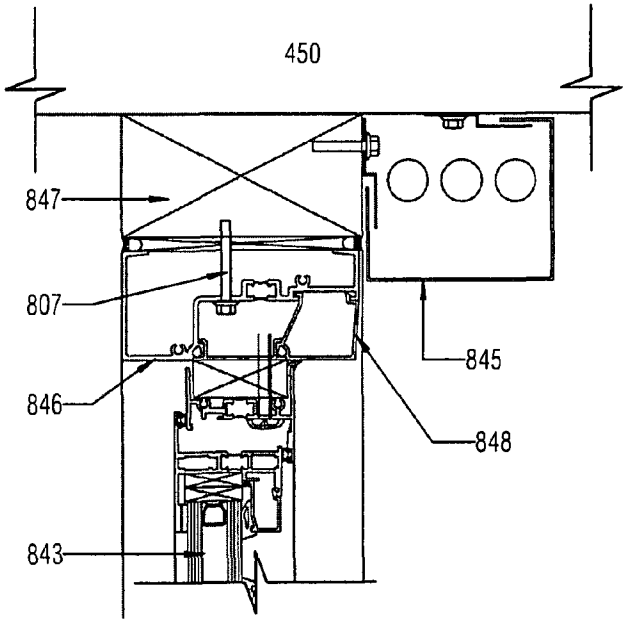
FIGS. 29A-D illustrate a side view of an entry way and attachment to the floor slab.
Figure 29A:
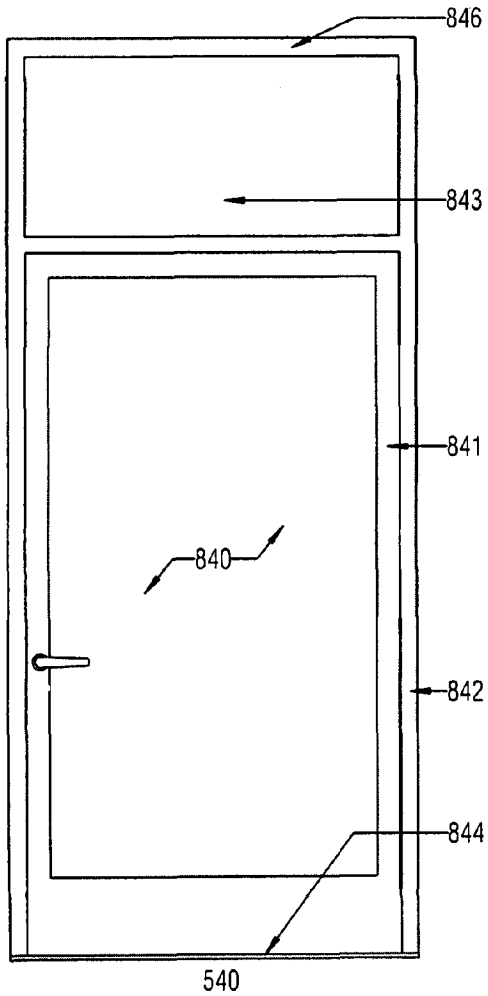
Figure 29D:
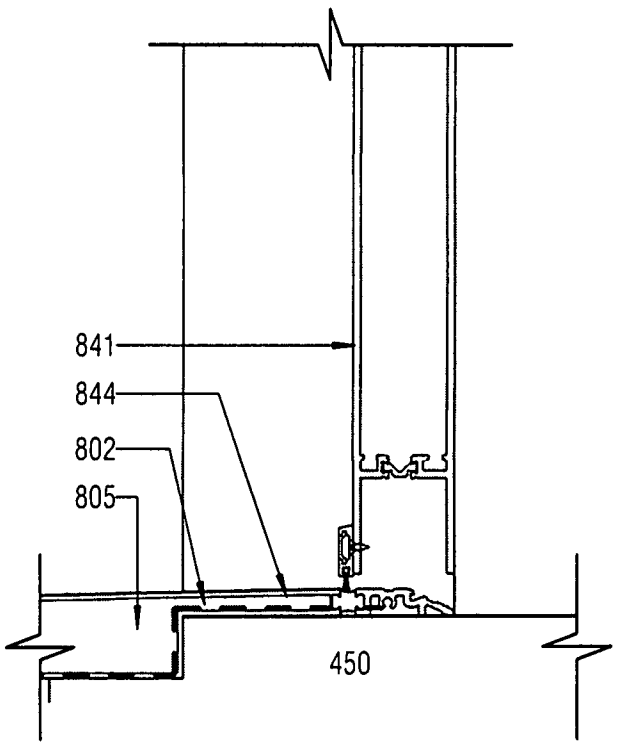
Figure 29C:
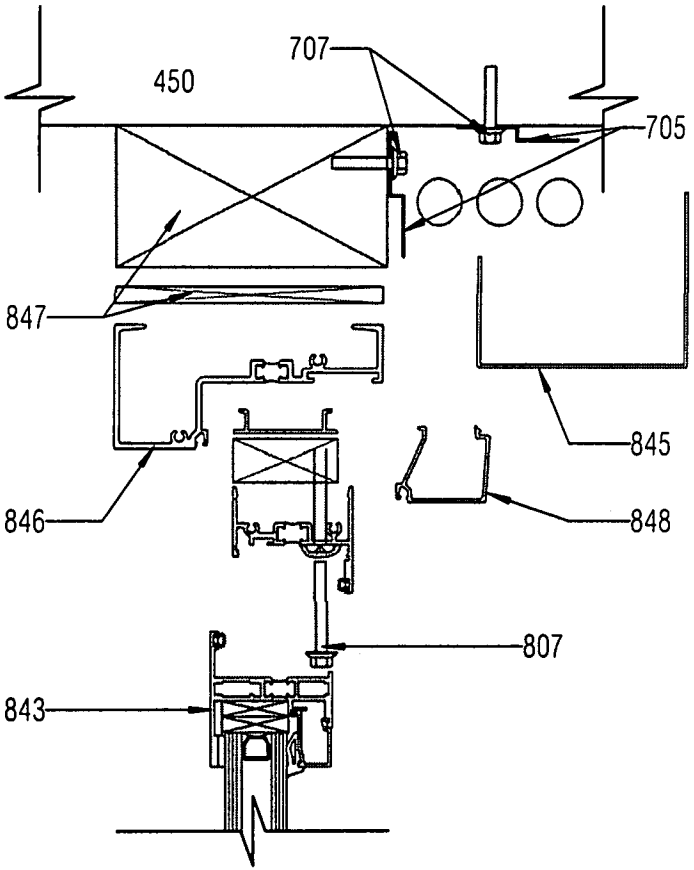

FIGS. 29B-D illustrate the steps for attaching the base and head portions of the entry door 540 to the floor slab 450. As illustrated in FIG. 29B, at the head portion of the entry door 540, blocking and shims 847 are installed against the underside of the floor slab 450. It should be noted that although head blocking 847 is described in the present invention, the blocking 847 may be omitted. The transom head frame 846 is secured against the blocking 847 or the underside of the floor slab 450 with fasteners 807. The head frame 846 is shimmed so that it is perfectly level to receive the transom 843 and rests at its exact elevation. As illustrated in FIG. 29D, at the base of the entry door 540, a weather resistive barrier 802 is placed in the slab depression and integrated into the door threshold 844. A bed of sealant and rigid insulation 805 is installed prior to the door threshold 844 to create a watertight and thermally isolated installation. The entry door 540 is constructed to allow approximately ⅝" of shim space at the top and bottom for leveling and alignment.

Upon anchoring the head frame 846 to its proper position under the slab 450, the transom 843 is inserted into the head frame 846. Upon securing the head portion of the transom 843 with the head frame 846, the bottom portion of the entry door 540 is positioned tightly against the anchor at the bottom side of the entry door 540. A closure trim piece 848 is snapped into place into the transom head 846. An electrical closure chase 845 adjacent to the transom head 846 is snapped into place following the installation of cleats 705 and fasteners 707 on the blocking 847 and the underside of the floor slab 450. The electrical chase 845 is preferably made of aluminum, however, other types of materials can be used to enclose the conduit. The electrical chase 845 is preferably made of the same material as the entry door frame 842.

Figure 30:
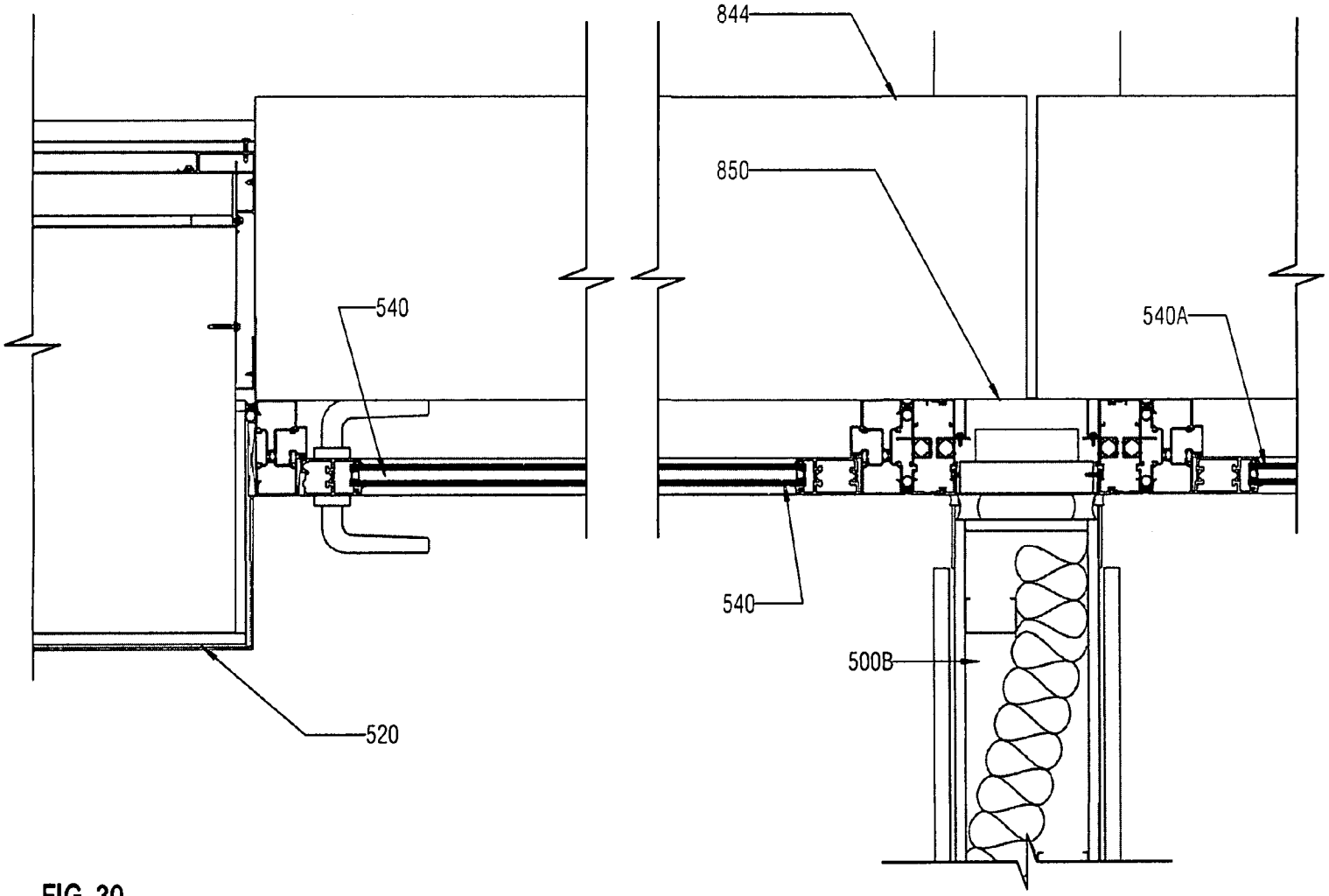
FIG. 30 illustrates a top view of an entry way with utility wall and demising wall installed.

FIG. 30 illustrates the top view of the entry door 540 attached adjacent to the utility wall 520 and perpendicularly attached to the demising wall 500B. The door portions can be made of glass or any other type of material. The door threshold 844 (not shown) extends out and over the gap created by the walkway (described later) and the floor slab. On the opposite side at the demising wall 500B whereby the first entry door 540 is adjacently attached to a second entry door 540A and interfacing perpendicularly with a demising wall 500B, a closure panel 850 is placed in-between the two entry doors 540, 540A so as to provide a watertight installation. This interface as well as the interface of the entry door 540 with the utility wall 520 is further described in FIGS. 31A-B below.

Figure 31A:
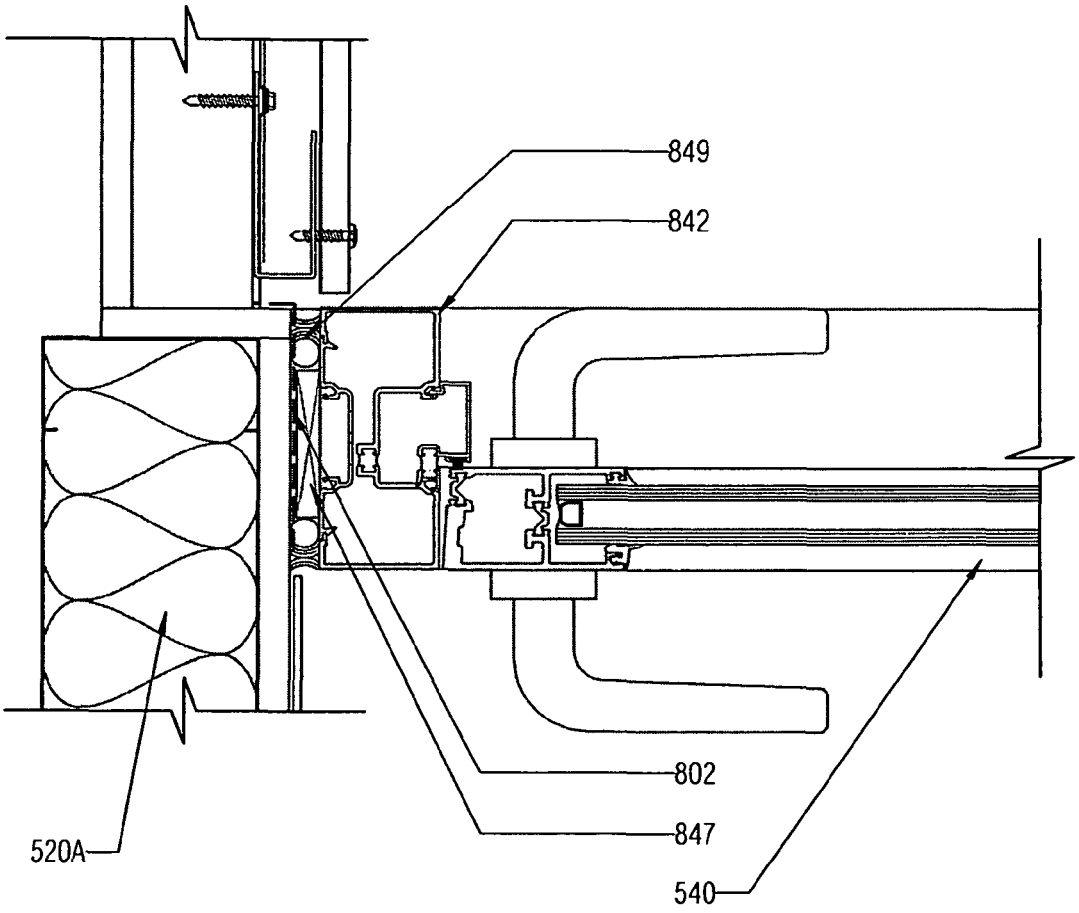
FIGS. 31A-B illustrate a detailed view of an entry way interfacing with the end wall and demising wall with an adjacent entry door.
Figure 31B:
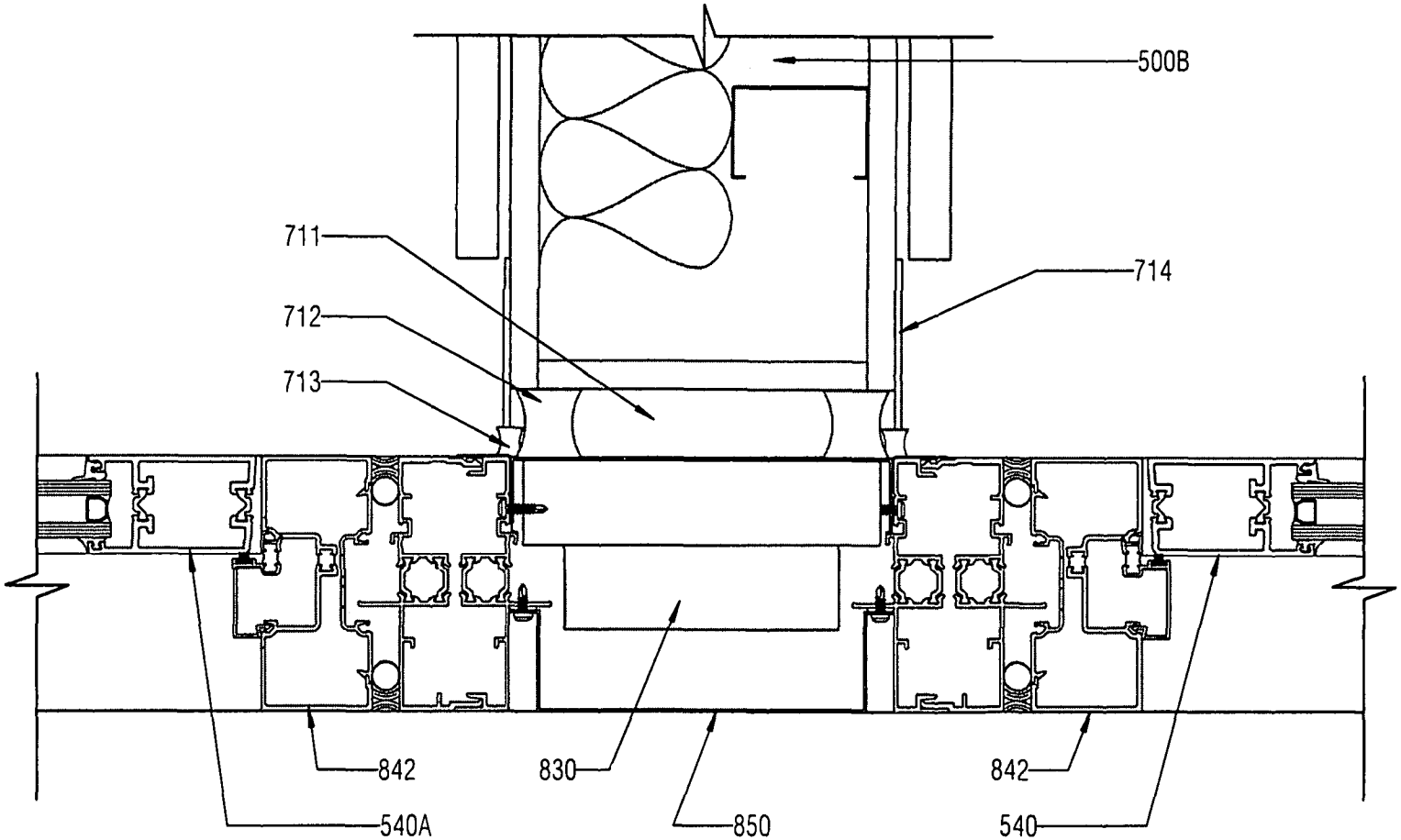

FIG. 31A illustrates a detailed top view of the outer frame 842 connecting adjacent to the utility wall 520A. The weather resistive barrier 802 is wrapped into the entry door frame 842 prior to the frame 842 being installed. Shims 847 are installed to create a plumb installation of the entry door 540. Sealant and backer rod 849 is further installed between the exterior sheathing and the outer frame 842 such as to create a watertight installation. As shown in FIG. 31B, the closure panel 850 is inserted and attached between the two entry doors 540, 540A, more specifically the two outer frames 842 of the two entry doors 540, 540A. The first door member 540 is positioned on the right side of the closure panel 850. Closure panel 850 with integral insulation 830 is slid into place attaching to the entry door frames 842 and then attached at the floor slabs 450 (as similarly described in FIG. 28A-B). The second entry door 540A is placed to the left of the closure panel 850 and secured in the same manner. The entry doors 540, 540A are attached on the door members 842 on each side of the closure panel 850. The entry doors 540, 540A, more specifically, the door portions, are swinging doors and are attached to the door members 842 of the closure panel 850. Similar to the demising wall 500A interface with the window wall 530A as described in FIG. 27B, the void between the demising wall 500B and the closure panel 850 needs to be made watertight. Upon secure attachment of the closure panel 850 to the floor slab 450, the fire-safe material 711, fire caulk 712, sealant 713 and wall trim 714 are provided between the demising wall 500B and the closure panel 850 in a similar process as described in FIG. 27B.

Figure 32A:
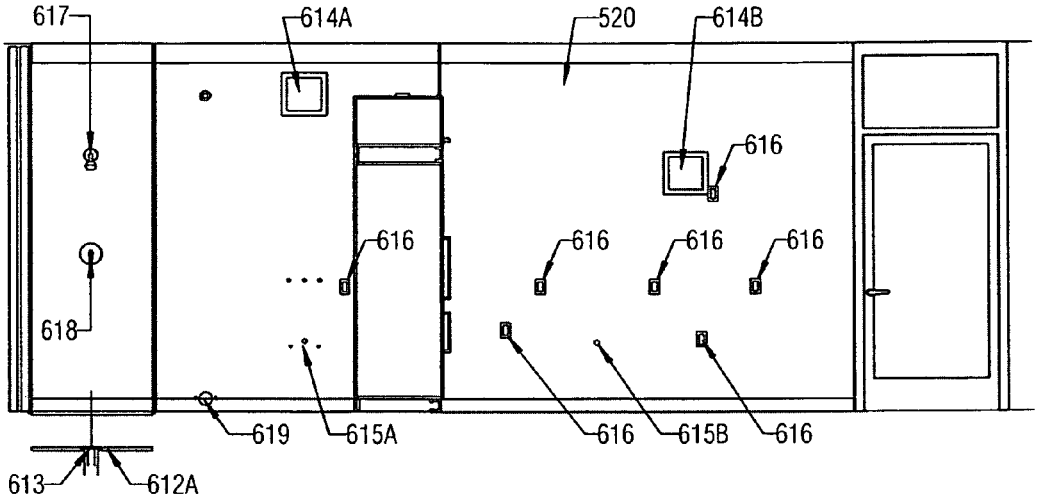
FIGS. 32A-B illustrate an elevation view of the utility wall without bath and kitchen components in place as well as the utility wall with bath and kitchen components in place.

After the exemplary units 300A-H and 300J are fully enclosed utilizing the steps outlined above, the next step of constructing a building is connecting utility components and installing fixtures. All of the unit's utility connections occur at the utility wall 520. The electrical and communications main lines run vertically in the utility wall 520. At each unit, the electrical service feeds directly into the utility wall's 520 breaker panel. Wiring connections to other wall components occur via pre-installed wiring. Electrical and communications connections are carried out at the time of installation of each adjacent utility wall 520. In FIG. 32A, a side view of the utility wall 520 is shown without the bath and kitchen components in place. The shower pan 612A with the integral drain 613 is set in grout after installing the utility wall 520 (described later). The utility wall 520 has exhaust vents 614A-B located respectively in the bathroom and kitchen on upper portions of the utility wall 520. The utility wall 520 also has first and second plumbing 615A-B for supply and waste for connecting a bathroom sink 610, a kitchen sink 601, as well as a toilet outlet 619 for connecting toilet 611. There is a plurality of outlets 616 located in the utility wall 520 for the bathroom and kitchen. The utility wall 520 that arrives on-site also has a pre-integrated shower head 617 and shower valves 618.

Figure 32B:
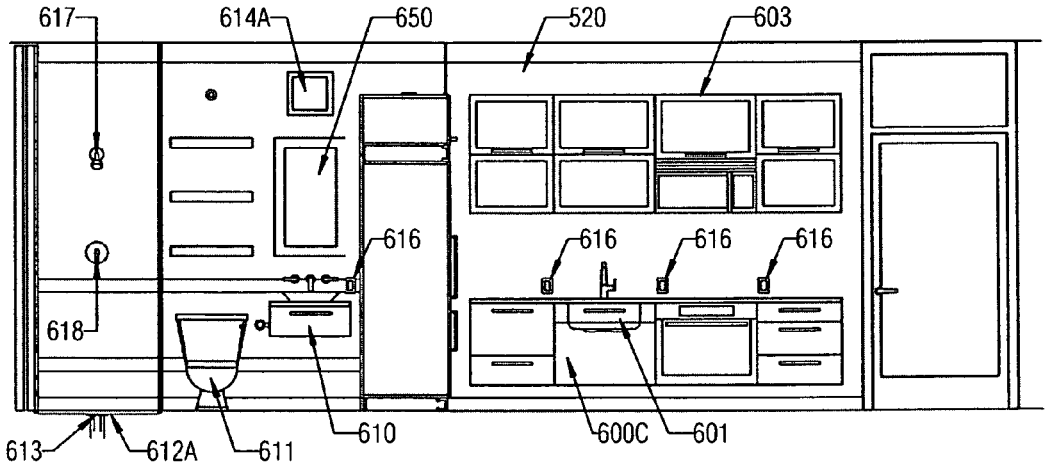

FIG. 32B illustrates the utility wall 520 with bathroom and kitchen components installed on the utility wall 520. Installation of plumbing fixtures may occur immediately after utility connections are made to the utility wall 520. The toilet 611 is installed on the utility wall 520, bathroom vanities 610 arrive on-site preassembled with the sink and associated out-of-wall plumbing pre-installed and ready for immediate connection to the building's systems. Kitchen units 600C are pre-fabricated, prefinished kitchen upper and base cabinets. These kitchen units 600C arrive at the site pre-drilled and trimmed for plumbing, electrical connections and vent ducting. Cabinets 603 have integral exhaust fans and light fixtures to be installed on the utility wall 520. The bathroom mirror/medicine cabinet 650 is installed at the same time as the other bathroom fixtures. All wiring within a given unit feed back to the unit's electrical panel.

Figure 33A:
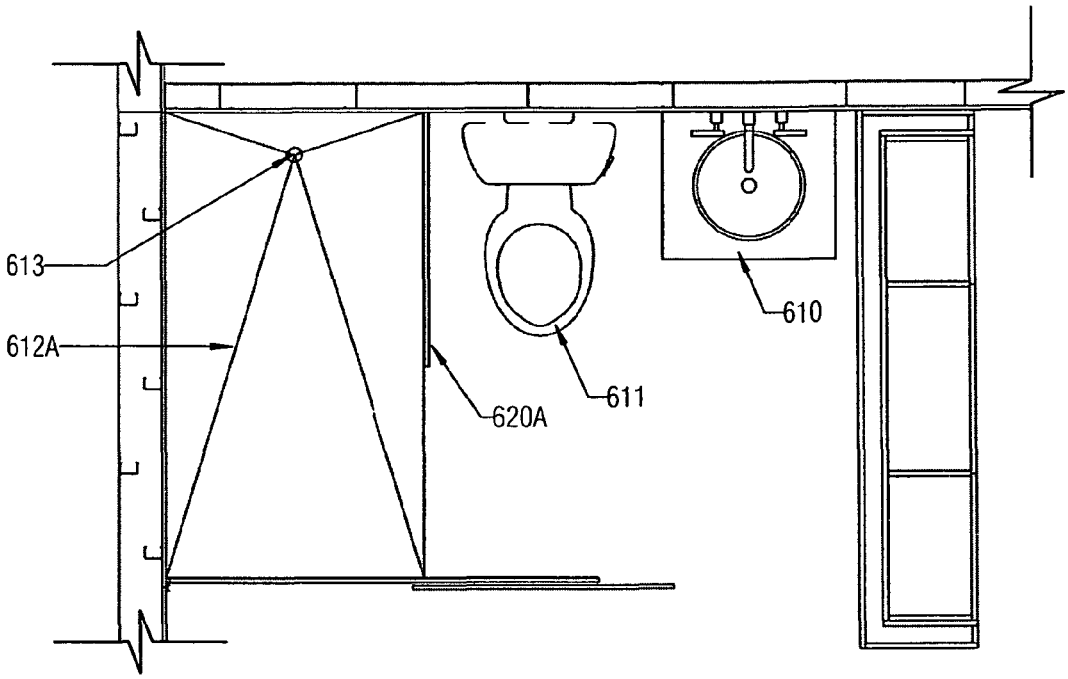
FIGS. 33A-B illustrate top and side views of a bathroom.
Figure 33B:
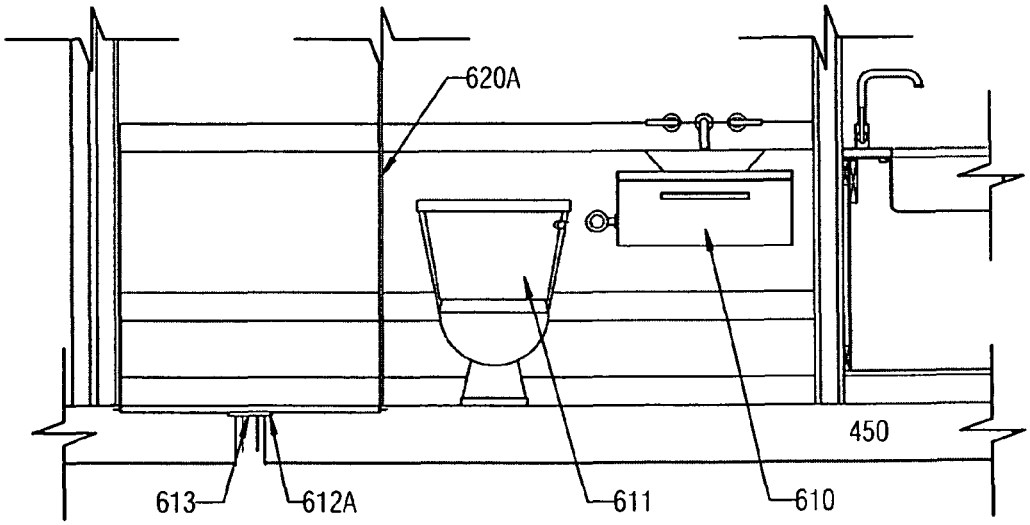
Figure 34A:
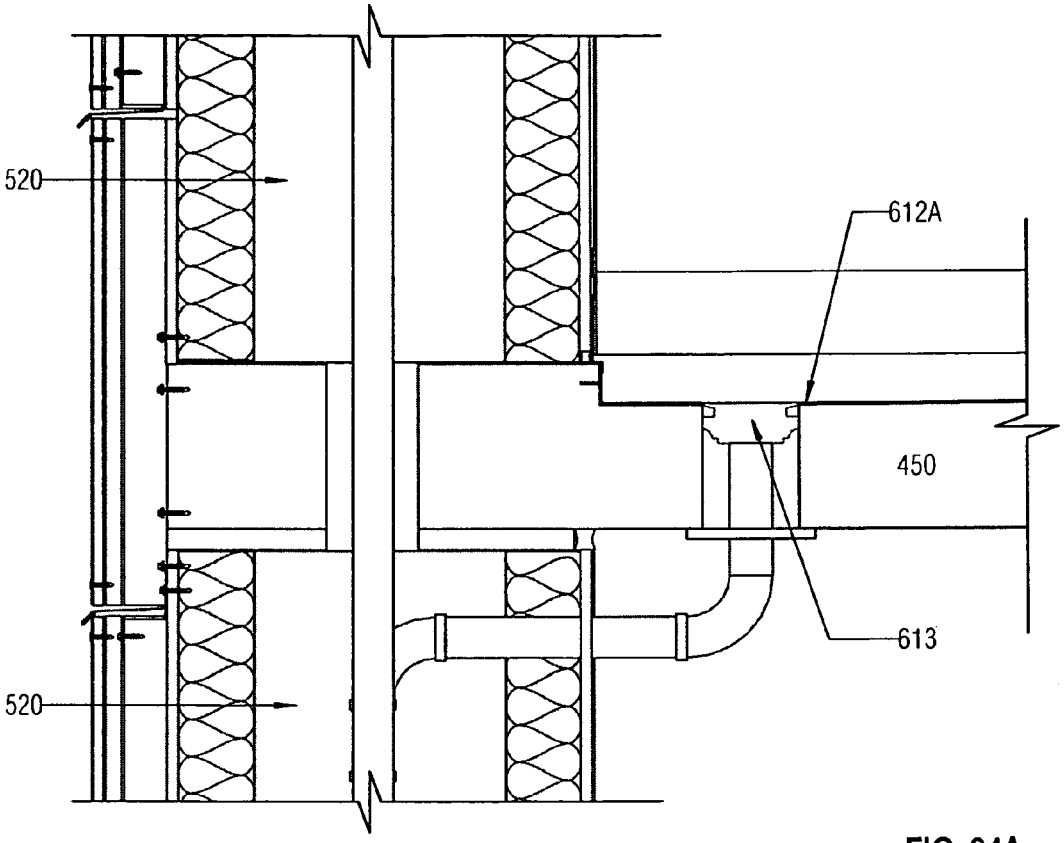
FIGS. 34A-B illustrate various shower pan and drain options.
Figure 34B:
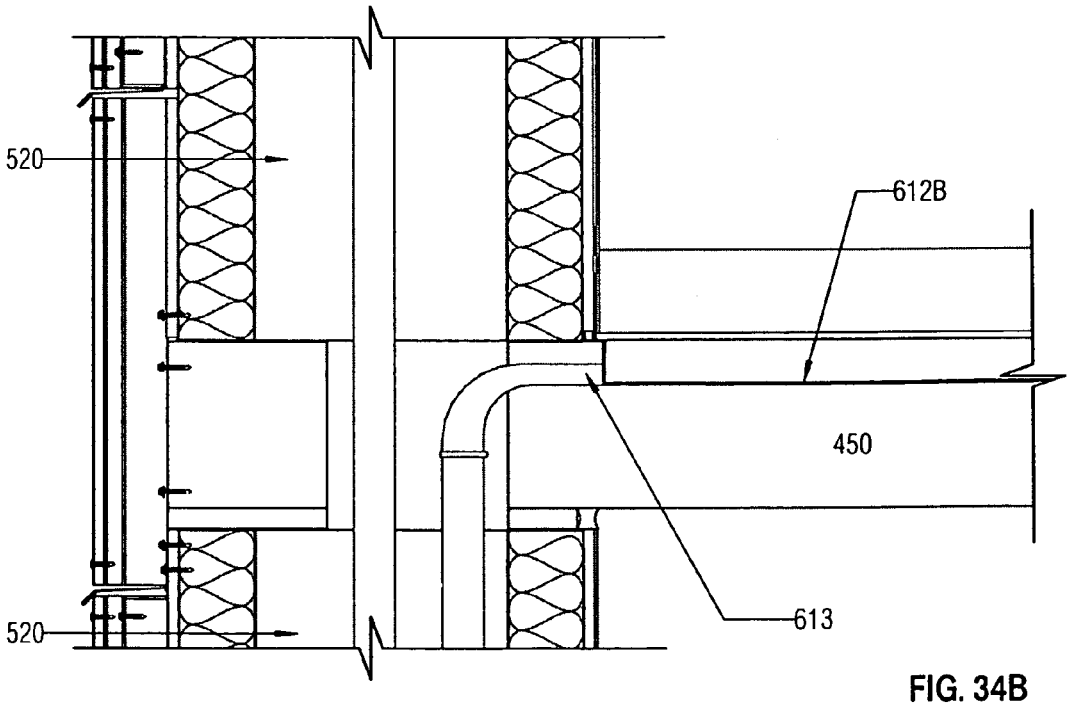

The shower pan 612A and integral drain 613 are set on the slab or into a recess within the floor slab 450. In FIG. 33A, the first shower partition 620A is shown to divide the shower portion from the bathroom portion. The bathroom vanity 610 and toilet 611 are also shown. FIG. 33B illustrates the recess or depression is cast into the slab 450 and shaped to receive the shower pan 612A. The shower pan 612A may be field set in grout after the installation of the utility wall 520. FIGS. 34A-B illustrate the shower pan 612A-B set into the slab 450 recess with the integral drain 613 running vertically through the slab 450, or as shown in FIG. 34B, horizontally through the slab 450 and into the cavity of the utility wall 520. Thus, the recess with the integral drain 613 permits controlled passage of water from slab 450 into the cavity of the utility wall 520. The shower pan as currently described is fiberglass 612A or an integrated stainless steel pan 612B. The present invention does not limit the other possible material choices for the shower pan. In addition, a slab recess may be omitted from the present invention.

Figure 35C:
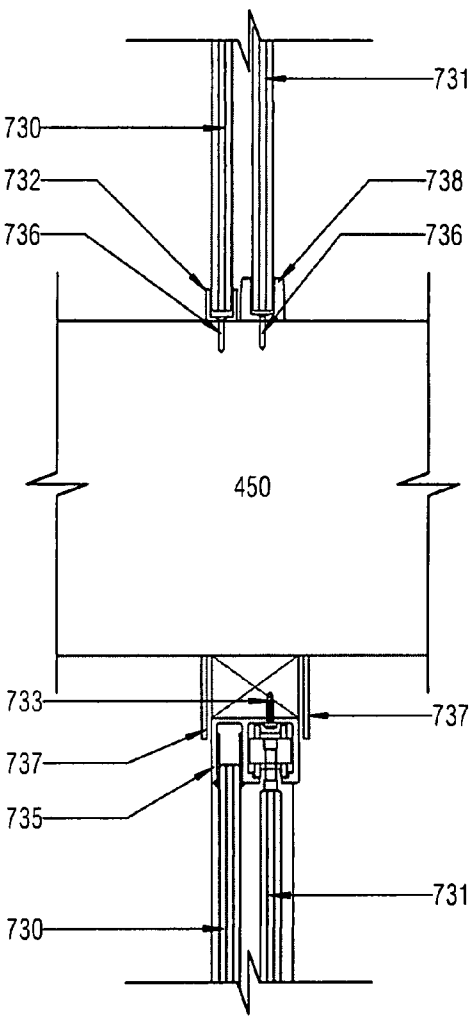
FIGS. 35A-C illustrate cross-sectional details of the interior glass partitions and bathroom doors before and after attachment to the slab.
Figure 35B:
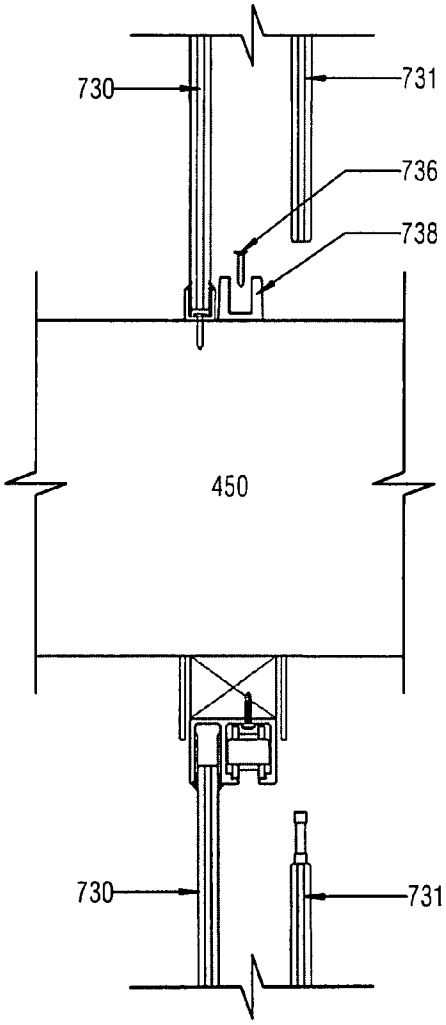
Figure 35A:
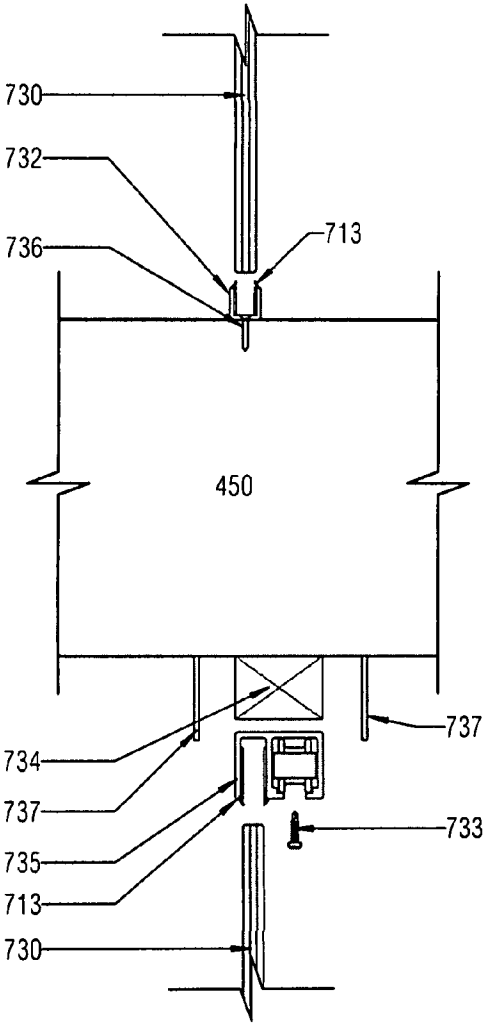

The next step of construction is installing interior bathroom partitions 620A-B, and 621 as shown on FIGS. 10 through 18 for separating the shower area from the bathroom and the bathroom area from the living area. The shower and bathroom partitions preferably, but without limitation, include about a ½" full height frosted or clear tempered glass panel and a full height frosted sliding glass door panel. The head portions of the bathroom partitions 620A-B and 621 as shown in FIGS. 10 through 17 are used to attach to the bottom side of the ceiling slab 450. A rigid C-shaped receptor channel 735 is attached to the underside of the floor slab 450 or to the underside of blocking 734 using a head anchor 733 as illustrated in FIG. 35A. It should be noted that although head blocking 734 is described in the above invention, the blocking 734 may be omitted from the present invention. The receptor channel 735 is preferably approximately 2" deep and 2" wide so that the top portion of the glass partition 730 is inserted at least half way into the receptor channel 735. Sealant will be provided at vertical wall joints where the glazing acts as a shower enclosure.

The bottom portions of the shower and bathroom partitions 620A-B and 621 are used to attach to the floor slab 450. A rigid C-shaped bottom receptor channel 732 is attached to the floor slab 450 by a bottom anchor 736 to insert the glass partition 730 as illustrated in FIG. 35A. The partition 730 is fully positioned within the bottom receptor channel 732 so that it rests securely in the receptor channel. Sealant 713 is applied to both sides of the glass partitions 730 to make for a secure and tight assembly. Furthermore as illustrated in FIG. 35B, at sliding door panel 731, a sliding door guide 738 is adjacently positioned on the floor slab 450 next to the bottom receptor channel 732 and attached to the floor slab 450 by drilling two bottom anchors 736 through the flat portions of the sliding door guide 738 and into the floor slab 450. The door panel 731 is then positioned into the head receptor channel 735 and into the sliding door guide 738 at the floor slab 450. As shown in FIG. 35C, to complete the assembly of the shower and bathroom partitions 620A-B, a trim piece 737, preferably made of aluminum, is sealed against the head blocking 734 and receptor channel 735.

The next step of construction is installing interior bedroom partitions 640, 642 for separating rooms or configuring rooms with different layouts as shown in FIGS. 10 through 18. Interior partitions 640 and 642 are minimal and in most cases, the bedroom partitions 640 and 642 are removable, and the location of the partitions is easily adjustable. The partitions 640, 642 are typically used to help establish privacy between the bedroom and the living area with exemplary unit 300C-H and 300J. The two main exemplary types of partitions include a tempered glass sliding bedroom glass partition 640 and a removable entertainment wall 642 with tempered glass sliding pocket doors. These two types of partitions are completely interchangeable within exemplary unit 300C-J.

Figure 36B:
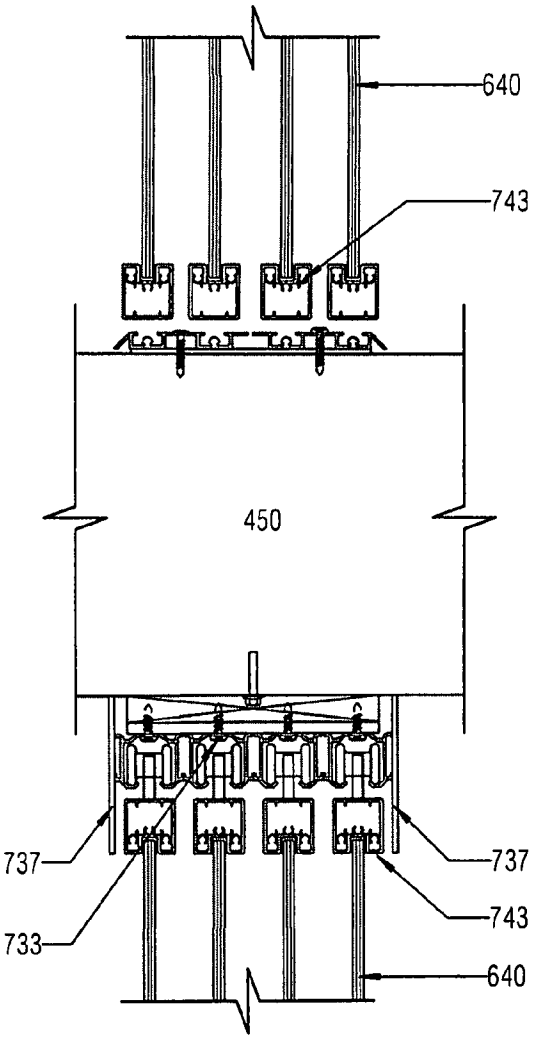
FIGS. 36A-B illustrate cross-sectional details of the bedroom glass partition before and after attachment to the slab.
Figure 36A:
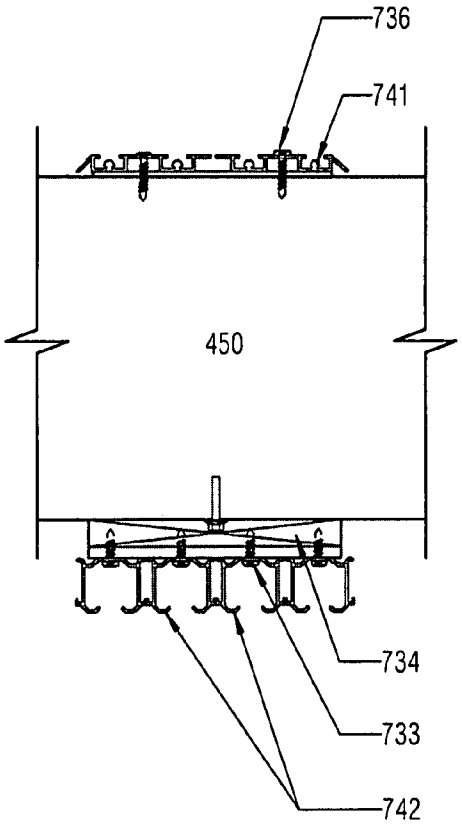

FIGS. 36A-B illustrate an exemplary sliding glass partition 640 as shown in FIGS. 14-17. The sliding bedroom glass partitions 640 are suspended from a sliding door track 742 mounted to the underside of the floor slab 450. The sliding bedroom glass partitions 640 are further sitting over a sliding door guide 741 on the slab 450. Blocking and shims 734 are used to perfectly level the sliding door track 742 at the underside of the slab 450. Head anchors 733 and base anchors 736 attach directly to or drill into the surface of the floor slab 450. A sliding bedroom partition 640, whether made of glass or other materials, is attached to a sliding door guide 742 previously attached to the underside of the floor slab 450 via a head anchor 733. The sliding door guide 736 basically guides the sliding bedroom glass partition 640 so that it can slide open and close easily. The protruding frame 743 from the top portion of the sliding bedroom glass partition 640 extends into the sliding door track 742. Upon completion of the installation as described above, finish trim pieces 737 are attached to conceal the sliding partition track 742 and blocking and/or shims 734.

Figure 37A:
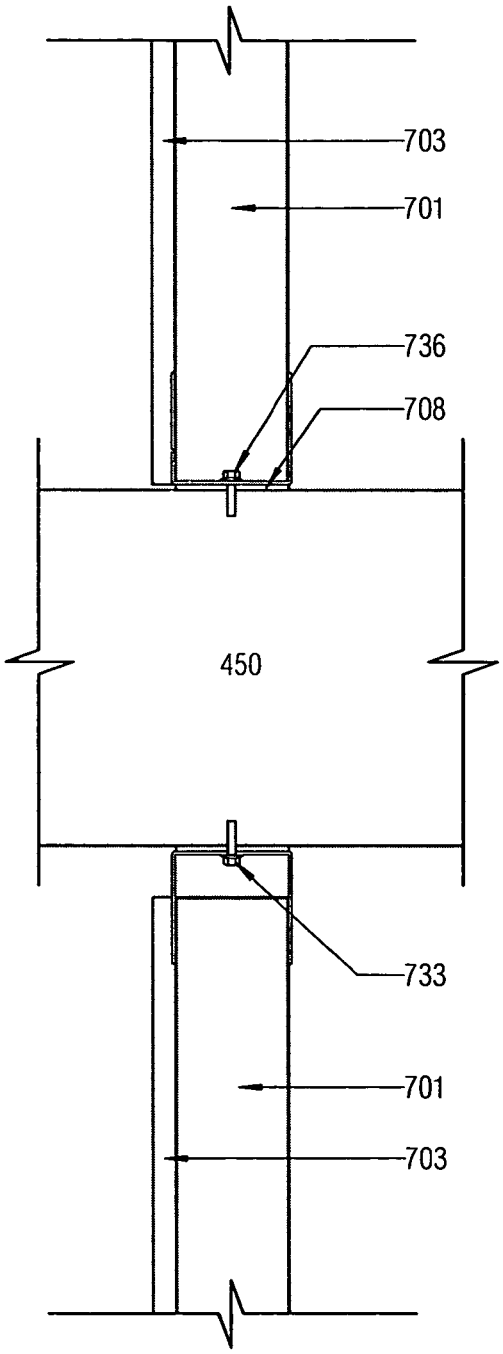
FIGS. 37A-C illustrate cross-sectional details of the bedroom entertainment wall before and after attachment to the slab.
Figure 37B:
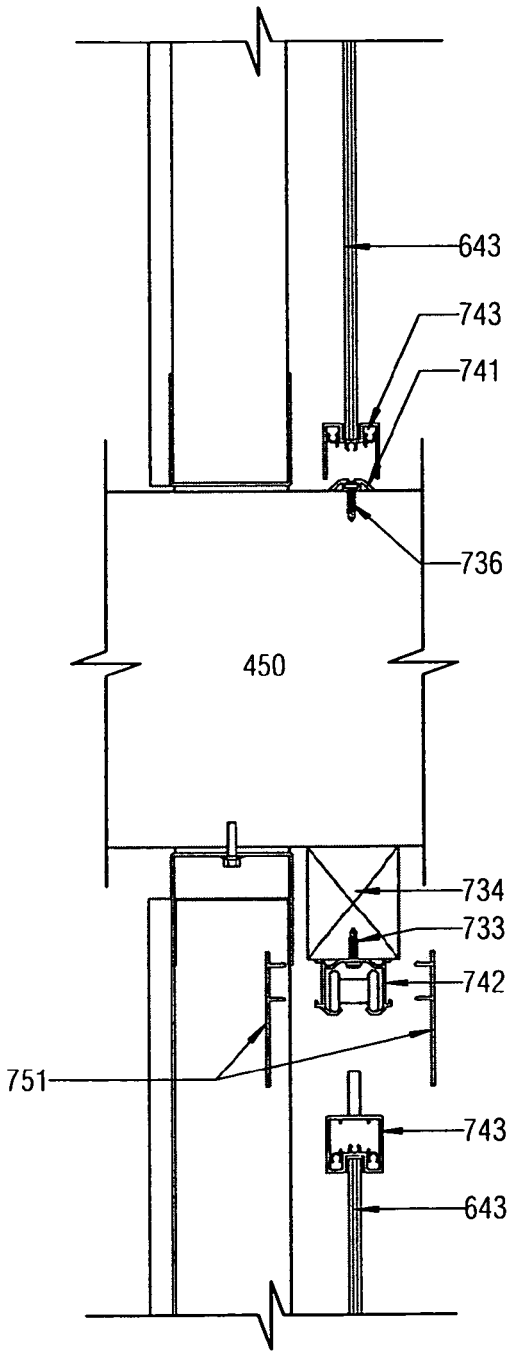
Figure 37C:
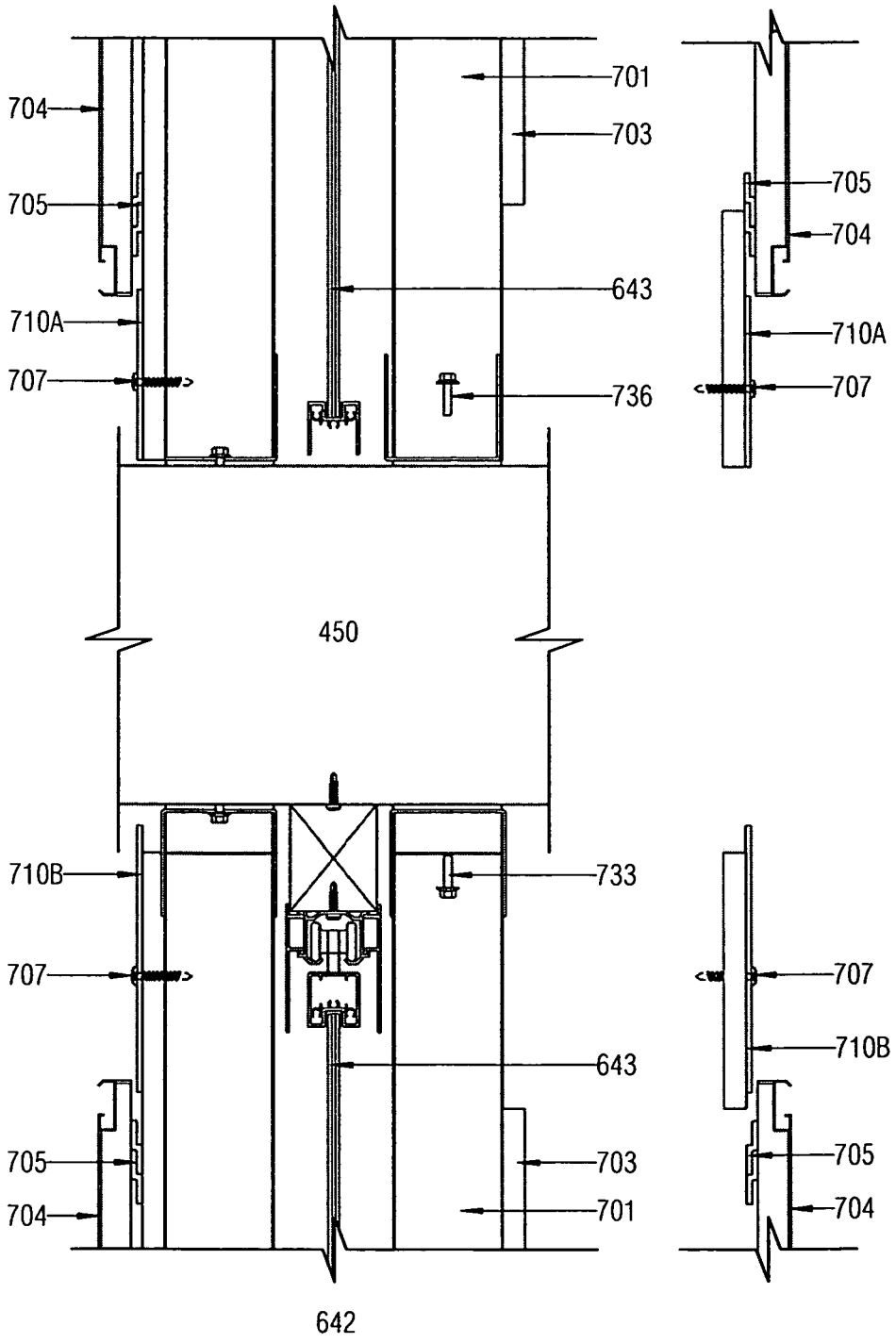

FIGS. 37A-C illustrate an exemplary entertainment wall 642 and glass pocket door 643 as shown in FIGS. 16-17. The exemplary entertainment wall 642 and glass sliding pocket door 643 that can be utilized in addition to, or in lieu of, the glass sliding partition 640 to further separate bedroom areas from living areas. The first partition of exemplary entertainment wall 642 is brought to the construction site as a pre-fabricated and prefinished component ready for installation. As illustrated in FIG. 37A, the components of this wall include metal stud framing 701 and wall sheathing 703 located only on one side of the wall. The cavity side of the wall is left as bare metal stud framing 701. This open cavity wall is set into place over a neoprene pad 708 and secured into place with head anchor 733 and base anchor 736.

As illustrated in FIG. 37B, the glass sliding pocket door 643 is installed similarly to the process for installing exemplary bedroom partition 640 as described in FIGS. 36A-B above. The glass sliding pocket door 643 is suspended from a sliding door track 742 mounted to the underside of the floor slab 450. The sliding bedroom partition 640 is further sitting over a sliding door guide 741 on the slab 450. Blocking and shims 734 are used to perfectly level the sliding door track 742 at the underside of the slab 450. Head anchors 733 and base anchors 736 attach directly to or drill into the surface of the floor slab 450. A glass sliding pocket door 643, whether made of glass or other materials, is attached to a sliding door guide 742 previously attached to the underside of the floor slab 450 via a head anchor 733. The sliding door guide 736 basically guides the glass sliding pocket door 643 at the top portion so that it can slide open and close easily. The protruding frame 743 from the top portion of the glass sliding pocket door 643 extends into the sliding door track 742.

To complete the installation of the entertainment wall 642 as illustrated in FIG. 37C, a second prefabricated and prefinished framing wall is brought to the construction site ready for installation. The components of this wall include metal stud framing 701 and wall sheathing 703 located only on the room side. The cavity side of the wall is left as bare metal stud framing. This wall will arrive to the construction site with the lower portion of interior sheathing left off at the head and base of the wall as a means of allowing access to attach the base and head to the slab with anchors 733 and 736 respectively. Upon attachment of the second prefabricated wall, the interior sheathing strips are attached to wall frame 701. The next step is to cover the inner side of the entertainment wall 642 by attaching the base and head trim 710A-B, preferably made of metal or other similar materials. Base and head trim 710A-B is attached with fastener 707 on both interior sides of the wall. Prefinished panels 704 are further attached to the entertainment wall 642 with cleats 705 to complete the installation as previously described in FIGS. 19-22 relating to the demising wall.

The final step of construction may be assembling the parapet for the roof as shown in FIGS. 38-39. In this application, the installation of the parapet, roof insulation and the roof membrane occur simultaneously with the installation of the interior components. In the preferred application, the parapet, roof insulation, roof membrane and associated components will occur prior to the roof slab being hoisted and set into place. This is one of several options for a unitized prefabricated system of enclosing the roof of the building that may include panelized overhangs, shading devices, canopies, solar panels, and/or fabric tent structures. Therefore, this example is not to be limiting in nature. The exemplary parapet connects to the roof slab 450 and accommodates the building's roofing membrane flashing and garden roof conditions.

Figure 38B:
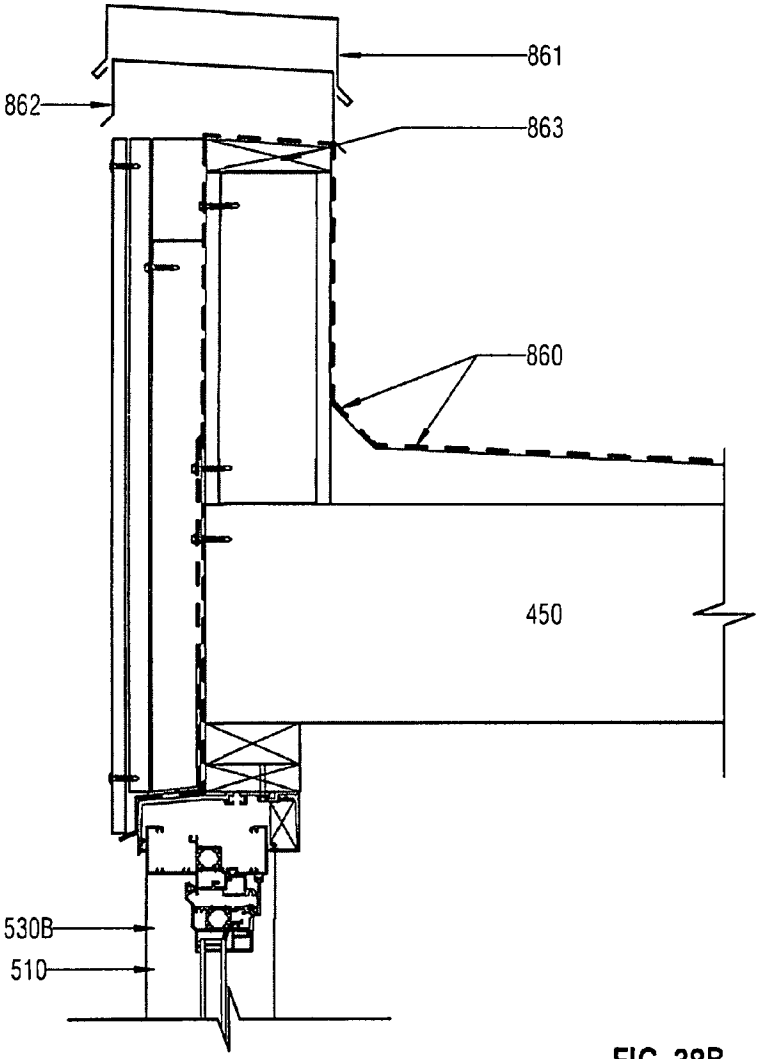
FIGS. 38A-B illustrate cross-sectional details of installing a parapet wall component over a roof.
Figure 38A:
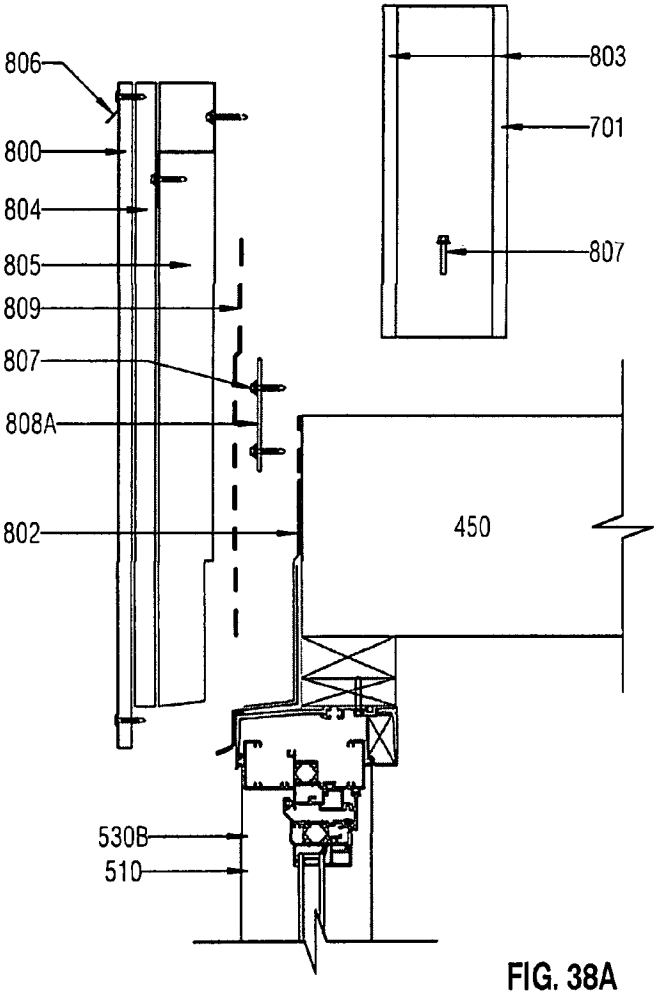

As illustrated in FIG. 38A, the parapet consists metal stud framing 701 and exterior sheathing 803 on both sides. Furthermore, it typically contains integral flashing to prevent water penetrations between the parapet wall and the top of the exterior window wall 530B or the end wall 510. The exterior sheathing 803 is preferably a 12 mm magnesium oxide board, however, other types of wall sheathing panels may be used. Exemplary prefabricated parapet walls may be delivered to the project site in varying lengths, but are preferably about 10 feet in length. As shown in FIG. 38B, the parapet wall is securely anchored on top of the roof slab 450 using a similar method as the end wall 510 as described previously in FIG. 23. Base plates 808A are attached at the face of the slab 450 with fasteners 807 that are drilled at the base condition of the floor slab 450 prior to the parapet wall being moved into place from the roof side of the building as shown in FIG. 38B. The parapet wall utilizes thermally insulated anchors 807 that are securely attached to the slab 450 prior to installing the parapet wall.

Upon attachment of the plate 808A to the slab 450 with fasteners 807, the parapet wall is moved into place with the exterior wall sheathing 803 abutting the base plate 808A. Fasteners 807 are installed in the horizontal direction along the parapet wall through the weather resistive barrier 802 and into the exterior sheathing 803 to securely attach the parapet wall to the floor slab 450. The next step is to attach a "peel and stick" weather resistive barrier 809 over the base plate 808A at the base of the wall and the floor slab 450 of the parapet wall. The exterior cladding 800, metal furring channels 804, rigid insulation 805, and associated flashing pieces 806 with fasteners 807 are then applied to the exterior portion of the parapet wall 760 and integrally flashed with the window wall 530B or end wall.

As shown in FIG. 38B, the roof membrane 860 is next applied over the roof slab 450, up the exterior sheathing 803 on the parapet wall, over the blocking 863 and also over the sheathing layers 803 of the parapet wall and integrally connected into the flashing of the exterior window wall 530B or end wall 510. A flashing cap member 861 is attached over the top of the parapet wall. The cap support member 862 is placed on top of the parapet wall and attached to the upper, roof side of the parapet wall. The cap support member 862 supports the top, horizontal part of the flashing cap member 861. The top portion of the exterior cladding catches the vertical part on the exterior side of the flashing cap member 861, to tightly keep the flashing cap member 861 over the parapet wall.

The majority of the building's roof is a flat membrane roof. In one of the exemplary applications, the roof area has a garden roof system. The garden roof system is a low-maintenance, vegetated roof system which helps reduce heat island effects, retains storm water runoff, and provides insulation benefits. This vegetated roof system may include recycled material in either a complete vegetated system, or a modular vegetated system. The cover provided by the planting minimizes the impact from UV and varying temperatures on the surrounding environment and increases the life of the roof system. In one of the exemplary applications, an Inverted Roof Membrane Assembly (IRMA) also called a Protected Roof Membrane (PRM) system may be installed after the parapet wall is installed. A monolithic, thermoplastic roofing membrane 860 is placed directly on the concrete roof slab 450. This monolithic, thermoplastic roofing membrane 860 is a fully adhered, seamless, self-healing membrane that can be mopped onto the top of the roof slab 450. Upon applying the roofing membrane 860, the roof is covered with a fiberglass-reinforced protective layer or roof barrier, and additionally covered with a layer of CFC-free, closed cell rigid insulation 864 as an air barrier. The thickness of the insulation layers 864 are determined by the local environment and governing thermal design values.

Figure 39B:
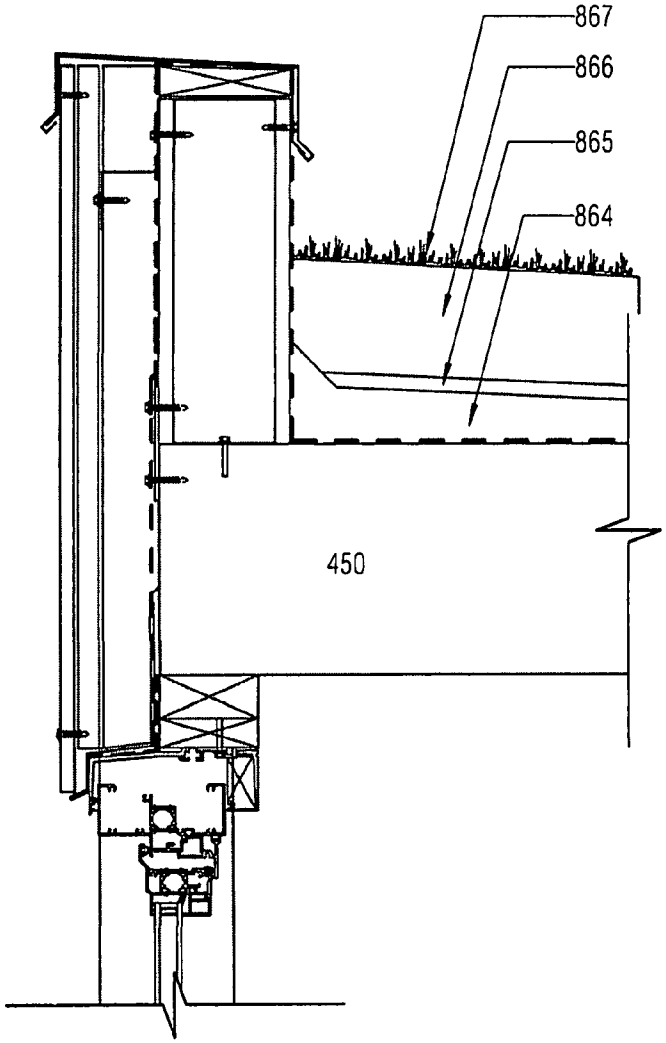
FIGS. 39A-B illustrate cross-sectional details of installing a garden roof drain next to the parapet wall component.
Figure 39A:
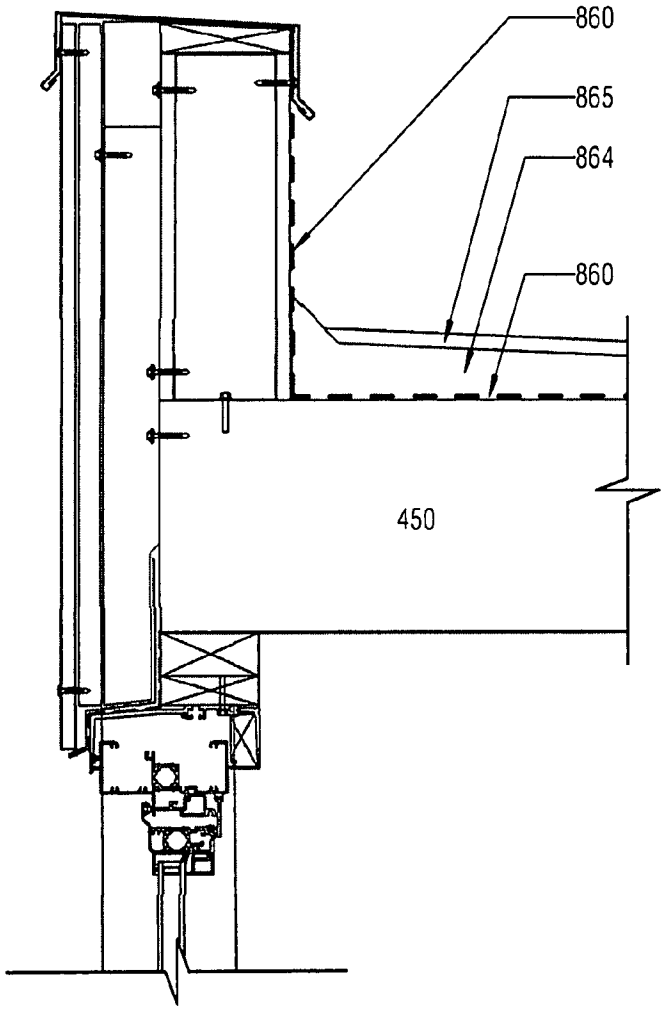

As shown in FIG. 39A, the tapered rigid insulation layer 864 is applied over the roof membrane 860 which is covered by a water retention mat 865 that provides drainage and aeration for the planting 867. The mat 865 also retains some of the run-off water and provides plant irrigation via capillary action. This mat 865 is further covered with soil filter fabric and then a lightweight engineered soil or growth media 866 as illustrated in FIG. 39B. The lightweight growth media 866 is further covered with a wind barrier planting fabric. The wind barrier planting fabric reduces soil erosion and dust while allowing the planting 867 to grow. The planting 867 is a lightweight planting providing superior water holding capacity. If an irrigation system is to be installed, the irrigation system can be installed in conjunction with the placement of growth media 867. Plants used in the planting 867 are typically of shallow root and drought-tolerant variety, but these embodiments are not intended to be of a limiting nature. The planting 867 may be delivered to the site in pre-planted blankets or in pre-planted modular grids.

Sloped roofing may be used in selective locations such as independent walkways, areas with stairs and elevator landings. Translucent roof panels may be used at sloping roofs to allow as much natural light as possible to the areas below.

Any run-off from the roof surfaces are collected and stored as gray water for irrigating plants on the vegetated roof and in-the-site landscape.

Figure 40:
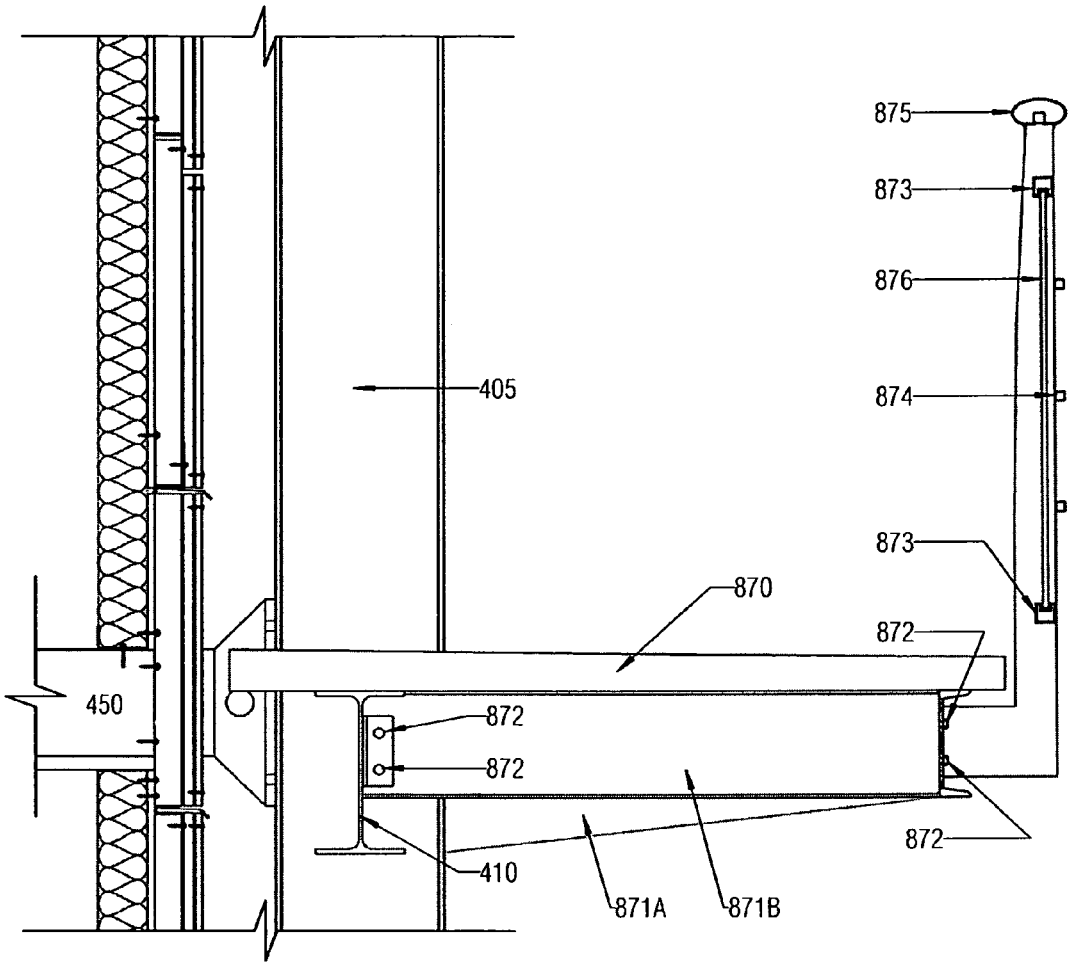
FIG. 40 illustrates cross-sectional details of constructing exterior common walkways.

The application of the exterior walkways is preferably attached to the columns and/or beams 405, 410 immediately following the erection of the structural frame 400 and is determined by the overall building configuration and the need for structural framing adjacent to the face of the building. This preferred sequencing allows the exterior walkways to be utilized in attachment of the slabs to the structural frame as well as allowing easy access to the individual units. In FIG. 40, a continuous horizontal beam 410 is attached between vertical columns 405 on all elevations. The horizontal beams 410 act as drag struts for the brace frame and helps provide torsional restraint for the vertical columns 405 under jacking loads. A column support member 871A-B, or a bolt-on system, may be used for all exterior walkways. The column support member 871A-B is bolted 872 to the horizontal beam framing system 410. Pre-fabricated and prefinished planks 870 are placed on top of the structure 410, 871A-B to provide the walking surface for the exterior walkways. The preferred material is precast concrete, but this is not meant to be limiting in nature. Alternatively, common walkways can be part of the unit floor slab 450 and utilize the same support system as the unit slabs 450. In these conditions, a thermal break is cast into the slab 450 under a unit's exterior wall. The extension of the slab 450 helps reduce reinforcing requirements in the main portion of the slabs 450, and there is no horizontal beam 410 framing to interfere with lifting.

As further illustrated in FIG. 40, a pre-fabricated and pre-bundled guardrail system 875 may be attached and secured to the walkway support system utilizing bolts 872. The preferred guardrail in the present invention includes a glass panel 876, receptor channels 873, and horizontal pickets 874, but this is not meant to be limiting. Several other options include, but are not limited to, aluminum, metal and cable systems.

FIGS. 41-42 refer to the various components of the utility wall as previously described in FIGS. 24-26. As shown in FIG. 41, the utility wall 520 is delivered to the site as a pre-manufactured, pre-plumbed, pre-wired, prefinished, pre-assembled and pre-bundled component. Possible cladding materials may be comprised of various materials allowed by code, such as, but not limited to, composite panels, phenolic resin panels, metal panels, cement board, lightweight precast concrete panels, wood siding, gypsum fiber reinforced cement panels, ceramic tile, and stone panels. The utility wall 520 may be an all-encompassing finished unit on both the interior and exterior sides. This invention does not preclude the elimination of one or more parts of this component to achieve a more efficient installation method in the field. For example, the utility wall 520 could arrive on-site without the furring channels 804, rigid insulation 805, exterior cladding 800, interior finish material 704, and access panel 880 and vent hood 881. Utility wall 520 is composed of metal stud framing 701, an integrated acoustical blanket insulation layer 702 within the interior stud of the utility wall 520, an interior sheathing panel 703 and an interior finish material 704. The utility wall 520 arrives on-site with all the wall plumbing and necessary blocking associated with the kitchen sink, counters, cabinets, toilet, and shower already in place. The utility wall 520 also includes the shower valves, shower head, and associated trim. The utility wall 520 further contains the unit's electrical panel 882 and water heater 883 behind an accessible panel 880. The present invention also contemplates use of a utility wall that does not contain a separate water heater, but instead uses a shared water heater or other similar device. The exterior side of the utility wall 520 is composed of metal stud framing 701, an integrated thermal batt insulation layer 801 within the exterior stud of the utility wall 520, fire-rated exterior sheathing board 803, weather resistive barrier 802, furring 804, rigid insulation 805, exterior cladding 800 and an access panel 880.

As shown in FIG. 42, the supply and waste lines 884A-B are extended beyond the top plate 885 as a means of connecting risers in a vertical orientation within a multi-story building. In an exemplary multi-story building, units are identically stacked vertically on each level of the multi-story building. The utility walls 520 are similarly identical in construction of each unit and are also stacked vertically on each level of the multi-story building. The supply and waste piping extensions of one exemplary utility wall 520 extend through the top plate 885 enough to extend through the floor system and into the bottom plate 886 of the second exemplary utility wall 520 located on the level above of a multi-story building. In an exemplary multi-story building, units and levels are identically stacked vertically throughout the building with the exemplary utility wall 520 stacked as described above. As the utility wall 520 is placed into position, the piping extensions 884A-B penetrate through the top plate 885 and the floor system and into the bottom plate 886 of the utility wall 520 above. The utility wall 520 is subsequently anchored into position using a variety of methods available. After secure attachment of the utility wall 520 to the floor, connections are made through the lower portions of the exemplary utility wall 520 for supply and waste piping 884A-B. This process is repeated for as many levels as required to complete the multi-story building.

Two Through Four Bedroom Units

The steps described in FIGS. 19-42 describe the sequence of assembling a standard sized studio or one bedroom unit 300B-C of FIG. 6A. The present invention may be readily adapted to create units with multiple bedrooms and bathrooms, as described in the next steps for exemplary two through four bedroom units.

A two bedroom unit of the present invention may be one and half times longer than a studio unit. Four bedroom units are typically twice the size of a standard studio unit. There are also standard plans for two and three bedroom corner units and efficiency units as shown in FIG. 6B. Standard wall and partition components are available which accommodate the larger units. If the overall plans for the building include a mix of unit types, the following sequence of assembly is applicable for multiple bedroom units. Living units that are 30 feet and wider may have a room against the exterior wall at the chase wall side of the unit. If these rooms are to be used as bedrooms, building code may require that a door or window be provided that is large enough to accommodate egress. In these types of conditions, exterior walls can be used. The exterior wall is composed and anchored in exactly the same manner as the end walls 510 as shown in FIG. 23. The exterior walls are provided in a different configuration than the end walls 510 since the exterior walls have a window or door included.

The first step of constructing multiple bedroom units is delivering and staging of demising walls 500A-B as described in FIGS. 19-22. As previously described in FIGS. 19-22, the demising walls 500A-B are delivered to the site and staged in each unit for installation.

The next step of constructing multiple bedroom units is placing end walls 510A-B for units as described in FIG. 23.

The longer two and four bedroom units utilize the same end walls 510A-B as a standard studio unit. However, in order to accommodate the longer multi-bedroom unit, an additional exterior wall is to be provided. The exterior walls are composed and anchored in exactly the same manner as the end walls 510A-B. The exterior walls may be provided in a different configuration than the end walls 510A-B and may have a window or door included. If the exterior wall encloses a bedroom, then the building code may require that a door or window be provided that is large enough to accommodate egress within the exterior wall.

Similar to the end walls 510 as shown in FIG. 23, exterior walls are composed of metal stud framing 701 with thermal batt insulation 801, sprinkler plumbing, electrical, and communications components. The wiring and plumbing are pre-installed at a factory and connected at the site. The interior side of the exterior wall receives a layer of fire-rated sheathing 703, with a finished panel 704. The inner wall sheathing 703 is preferably a 12 mm magnesium oxide board, however, other types of fire-rated wall panels with safety mechanisms may be used. The preferred method for finishing the exterior wall is to attach a finish panel 704 over the exterior wall at the site using wood or metal cleats 705 installed on the wall sheathing 703. Several options are available for the exemplary finish panel 704, including but not limited to, stain, paint, magnesium-oxide board, wood veneer, wood paneling, plaster, metal, wallpaper, and cork. Alternately, the finish panel 704 and cleats 705 may be omitted and the wall sheathing finished in a more conventional manner. More specifically, the wall sheathing may be taped and painted so as long as it achieves the required fire rating per local building codes. A final interior trim piece 710A-B is installed with fastener 707 in a similar manner to the demising wall 500A as described above following the secure placement of exterior wall.

The exterior side of the exterior wall receives exterior sheathing 803, a weather resistive barrier 802, furring channels 804, preferably metal or similar material, rigid insulation 805, associated flashing pieces 806, exterior fasteners 807 and an exterior cladding material 800. A section of exterior cladding 800, metal furring channels 804, rigid insulation 805, associated flashing pieces 806, and exterior fasteners 807 is temporarily left off the exterior wall at the slab edge 450 as a means of providing the connection of the exterior wall to the floor slab 450 as described below.

Similar to the end walls 510 as shown in FIG. 23, the exterior walls are attached to the floor slabs as follows: upon attachment of the plates 808A-B to the slab 450 with fasteners 807, the exterior wall is moved into place with the exterior wall sheathing 803 abutting the base and head plates 808A-B. Fasteners 807 are installed in the horizontal direction along the end wall 510 through the weather resistive barrier 802 and into the exterior sheathing 803 to securely attach the exterior wall to the floor slab 450. The next step is to attach a "peel and stick" weather resistive barrier 809 over the base and head plates 808A-B at the base and head of the wall and the floor slab 450 of the exterior wall. The final step involves attaching the final exterior cladding 800, metal furring channels 804, rigid insulation 805, and associated flashing pieces 806 with fasteners 807 that was temporarily left off allowing access to attachment points of the exterior wall to floor slab 450. The installation of this final panel 800 completes the installation of the exterior wall creating a weather-tight and watertight system.

The next step of construction is placing the utility wall 520 as previously described in FIGS. 24-26, 41 and 42.

As previously described in FIGS. 27-28, the next step of constructing multiple bedroom units is installing the exterior window walls 530A-D. The sequence for the delivery and installation of the exterior window walls 520A-D and components are described in FIGS. 27-28.

The next step of constructing multiple bedroom units is installing the entry door 540A-B and its associated parts. Installation of the entry door 540A-B is described in FIGS. 29-31.

The next step of constructing multiple bedroom units is connecting utility components and installing fixtures. The sequence of the utility connections and placement of the plumbing fixtures are described in FIG. 32-33.

The next step of constructing multiple bedroom units is inserting a shower pan 612A-B with an integral drain 613 into a recess 470 within the floor slab 450 as described in FIG. 34.

The next step of constructing multiple bedroom units is installing interior partitions for separating rooms or configuring rooms with different layouts as described in FIGS. 35-37.

The final step of constructing outer structures such as the parapet wall, roof, and exterior or common walkways are the same as previously described in FIGS. 38-40. The sequencing of the installation of the roof and exterior walkways may occur prior to the slabs being hoisted as a means of accessing the attachment points of the slabs to the structural framing.

It should be noted that relative terms are meant to help in the understanding of the structures and are not meant to limit the scope of the invention. Similarly, the term "head" is meant to be relative to the term "base," and the term "top" is meant to be relative to the term "bottom." It should also be noted that the term "right" is meant to be relative to the term "left," and the term "horizontal" is meant to be relative to the term "vertical." Furthermore, the present invention is described in terms of perpendicular and parallel in direction, the terms are not meant to be limiting. It should be further noted that although the present invention is described in terms of first and second walls, the terms are not meant to be limiting. It should be further noted that although the present invention is described using certain structures such as fasteners, however, any other types of means can be used to attach the walls.

The terms and expressions that have been employed in the foregoing specification are used as terms of description and not of limitation, and are not intended to exclude equivalents of the features shown and described. This application is intended to cover any adaptations or variations of the present invention. It will be appreciated by those of ordinary skill in the art that any arrangement that is calculated to achieve the same purpose may be substituted for the specific embodiment shown.

What is claimed is:

1. A multi-story building construction system comprising:

slab construction, wherein a monolithic slab of the slab construction spans an entire story of the multi-story building;

pre-manufactured non-weight bearing walls, wherein the pre-manufactured non-weight bearing walls include an interior surface and an exterior surface, wherein the exterior surface forms at least a portion of an exterior of the multi-story building; and external load-bearing structural framing including:

a plurality of vertical columns;

a horizontal beam coupled to at least two of the vertical columns; and a diagonal brace coupled to at least the horizontal beam or at least two of the vertical columns;

wherein the slab of the slab construction is prefabricated and coupled to the load-bearing structural framing around an exterior perimeter of the slab.

2. The construction system of claim 1 wherein the pre-manufactured non-weight bearing walls include one or more of a utility wall, end wall, exterior wall, and exterior window wall.

3. The construction system of claim 2 wherein the utility wall includes features that allow the stacking and connection of utilities from one building story to the next.

4. The construction system of claim 2 wherein at least one of the pre-manufactured non-weight bearing walls is prefinished prior to installation in the building.

5. The construction system of claim 2 further including at least one of a roof slab and a floor slab, wherein the at least one of the roof slab and the floor slab is configured to couple to the external load-bearing structural framing.

6. The construction system of claim 5 wherein the floor slab includes at least one recess or depression.

7. The construction system of claim 6 wherein the recess or depression permits controlled passage of water from the floor slab to the utility wall.

8. The construction system of claim 1 wherein the monolithic slab of the slab construction includes at least one of steel reinforcing bars or post tensioned cables.

9. The construction system of claim 1, wherein the monolithic slab of the slab construction includes radiant heat coils.

10. The construction system of claim 1, wherein the monolithic slab of the slab construction is configured to act as at least one of a finished floor for a unit above the floor slab or a finished ceiling for a unit below the floor slab.

11. The construction system of claim 1, wherein the monolithic slab of the slab construction includes an acoustical isolation material.

12. The construction system of claim 1 wherein the pre-manufactured non-weight bearing walls are adapted for use in slab construction.

13. The construction system of claim 1 further including a building foundation that supports the load-bearing structural framing.

14. The construction system of claim 13 wherein the external load-bearing structural framing is located around the perimeter of the building foundation.

15. The construction system of claim 1 further including at least one exterior walkway.

16. The construction system of claim 1 wherein the building is at east one of a residential, institutional, and commercial building.

17. The construction system of claim 1 wherein the building has at least two identical units.

18. The construction system of claim 1 wherein the building further includes at least one of a parking level and a retail level.

* * * * *

UNITED STATES PATENT AND TRADEMARK OFFICE

CERTIFICATE OF CORRECTION

PATENT NO. : 9,493,940 B2
APPLICATION NO. : 13/700429
DATED : November 15, 2016
INVENTOR(S) : Collins et al.

It is certified that error appears in the above-identified patent and that said Letters Patent is hereby corrected as shown below:

On the Title Page

In Item (75), under "Inventors", in Column 1, Line 1, Delete "Arlan" and insert -- Arlan E. --, therefor.

In Item (75), under "Inventors", in Column 1, Line 1, Delete "Mark" and insert -- Mark L. --, therefor.

In the Specification

In Column 1, Line 10, delete "§371" and insert -- § 371 --, therefor.

In Column 1, Line 12, delete "§120" and insert -- § 120 --, therefor.

In Column 1, Line 17, delete "§120" and insert -- § 120 --, therefor.

In Column 1, Line 18, delete "filed" and insert -- filed on --, therefor.

In Column 24, Line 28, delete "28A-13" and insert -- 28A-B --, therefor.

In the Claims

In Column 36, Line 21, in Claim 16, delete "east" and insert -- least --, therefor.

Signed and Sealed this
Twentieth Day of June, 2017

Joseph Matal

Joseph Matal
*Performing the Functions and Duties of the*
*Under Secretary of Commerce for Intellectual Property and*
*Director of the United States Patent and Trademark Office*